US011690463B2

(12) United States Patent
Bird et al.

(10) Patent No.: US 11,690,463 B2
(45) Date of Patent: Jul. 4, 2023

(54) DIVIDER WITH SELECTIVELY SECURABLE TRACK ASSEMBLY

(71) Applicant: Fasteners for Retail, Inc., Twinsburg, OH (US)

(72) Inventors: Gregory M. Bird, Solon, OH (US); Shane Obitts, Elyria, OH (US); Thaddeus Brej, Rocky River, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 17/448,143

(22) Filed: Sep. 20, 2021

(65) Prior Publication Data

US 2022/0279941 A1 Sep. 8, 2022

Related U.S. Application Data

(60) Continuation of application No. 16/780,677, filed on Feb. 3, 2020, now Pat. No. 11,122,915, which is a (Continued)

(51) Int. Cl.
*A47F 1/12* (2006.01)
*A47F 5/00* (2006.01)
(Continued)

(52) U.S. Cl.
CPC ..... *A47F 1/125* (2013.01); *A47B 57/58* (2013.01); *A47B 57/583* (2013.01);
(Continued)

(58) Field of Classification Search
CPC .... A47F 1/125; A47F 1/04; A47F 7/17; A47F 1/06; A47F 1/08; A47F 1/12; A47F 1/10;
(Continued)

(56) References Cited

U.S. PATENT DOCUMENTS 153,227 A 7/1874 Walker
154,940 A 9/1874 Adams
(Continued)

FOREIGN PATENT DOCUMENTS

AU 2012301697 A1 4/2014
AU 2012301707 A1 4/2014
(Continued)

OTHER PUBLICATIONS

*RTC Industries, Inc.* v. *Fasteners for Retail Inc., and CVS Corporation*, RTC Industries' Reply to Defendants', Opposition to RTC's Motion to Modify and Temporarily Quash Five Subpoenas for Violation of Federal Rule of Civil ; Procedure 45, Civil Action No. 03C 3137, dated Dec. 11, 2003.
(Continued)

*Primary Examiner* — Jennifer E. Novosad
(74) *Attorney, Agent, or Firm* — Honigman LLP

(57) ABSTRACT

A merchandising system includes a rail having a base. A first wall extends from the base and has a first engagement surface. A second wall extends from the base and includes a second engagement surface facing the first engagement surface and spaced apart from the first engagement surface by a channel. The merchandising system also includes a cooperating member including a first portion received within the channel and a second portion extending from the second wall of the rail. The first portion is operable to selectively engage the first engagement surface and the second engagement surface.

17 Claims, 28 Drawing Sheets

Related U.S. Application Data division of application No. 15/940,167, filed on Mar. 29, 2018, now Pat. No. 10,588,426, which is a division of application No. 15/141,151, filed on Apr. 28, 2016, now Pat. No. 9,955,802, which is a continuation-in-part of application No. 15/076,329, filed on Mar. 21, 2016, now Pat. No. 9,770,121.

(60) Provisional application No. 62/188,221, filed on Jul. 2, 2015, provisional application No. 62/144,672, filed on Apr. 8, 2015.

(51) Int. Cl.
*A47B 57/58* (2006.01)
*A47F 7/28* (2006.01)

(52) U.S. Cl.
CPC ..... *A47B 57/585* (2013.01); *A47F 5/005* (2013.01); *A47F 7/28* (2013.01)

(58) Field of Classification Search
CPC .... A47F 5/005; A47F 3/14; A47F 7/28; A47F 5/0068; A47F 5/16; A47F 5/0018; A47F 5/0025; A47F 5/0043; A47F 7/0246; A47F 7/024; A47B 57/58; A47B 57/583; A47B 57/585; A47B 57/586; A47B 57/588; A47B 57/50
USPC ..... 211/59.3, 59.2, 119.003, 184, 150, 175; 108/60, 61, 71
See application file for complete search history.

(56) References Cited

U.S. PATENT DOCUMENTS 355,511 A 1/1887 Danner
431,373 A 7/1890 Mendenhall
436,704 A 9/1890 Green
452,673 A 5/1891 Hunter
551,642 A 12/1895 Kleine
607,890 A 7/1898 Smith
607,891 A 7/1898 Smith
632,231 A 9/1899 Blades
808,067 A 12/1905 Briggs
847,863 A 3/1907 Watts
927,988 A 7/1909 Massey
1,030,317 A 6/1912 Middaugh
1,156,140 A 10/1915 Hair
1,271,508 A 7/1918 Hall
1,282,532 A 10/1918 Bochenek
1,674,582 A 6/1928 Wheeler
1,682,580 A 8/1928 Pratt
1,703,987 A 3/1929 Butler
1,712,080 A 5/1929 Kelly
1,714,266 A 5/1929 Johonson
1,734,031 A 11/1929 Carlson
1,786,392 A 12/1930 Kemp
1,849,024 A 3/1932 McKee
1,863,625 A 6/1932 Fenstermaker
1,910,516 A 5/1933 Besenberg
1,964,597 A 6/1934 Rapellin
1,971,749 A 8/1934 Hamilton
1,991,102 A 2/1935 Kemaghan
2,013,284 A 9/1935 Michaud
2,057,627 A 10/1936 Ferris
2,076,941 A 4/1937 Farr
2,079,754 A 5/1937 Waxgiser
2,085,470 A 6/1937 Pieper
2,085,479 A 6/1937 Shaffer
2,110,299 A 3/1938 Hinkle
2,111,496 A 3/1938 Scriba
2,129,122 A 9/1938 Follett
2,185,605 A 1/1940 Murphy
2,218,444 A 10/1940 Vineyard
2,284,849 A 6/1942 Schreyer
2,308,851 A 1/1943 Anderson
2,499,088 A 2/1950 Brill
2,516,122 A 7/1950 Hughes
2,522,896 A 9/1950 Rifkin
2,538,165 A 1/1951 Randtke
2,538,908 A 1/1951 McKeehan
2,555,102 A 5/1951 Anderson
2,563,570 A 8/1951 Williams
2,652,154 A 9/1953 Stevens
2,670,853 A 3/1954 Schneider
2,678,045 A 5/1954 Erhard
2,730,825 A 1/1956 Wilds
2,732,952 A 1/1956 Skelton
2,738,881 A 3/1956 Michel
2,750,049 A 6/1956 Hunter
2,767,042 A 10/1956 Kesling
2,775,365 A 12/1956 Mestman
2,784,871 A 3/1957 Gabrielsen
2,828,178 A 3/1958 Dahlgren
2,893,596 A 7/1959 Gabrielsen
2,918,295 A 12/1959 Milner
2,934,212 A 4/1960 Jacobson
2,948,403 A 8/1960 Vallez
2,964,154 A 12/1960 Erickson
3,083,067 A 3/1963 Vos
3,103,396 A 9/1963 Portnoy
3,110,402 A 11/1963 Mogulescu
3,121,494 A 2/1964 Berk
3,122,236 A 2/1964 Michiel
3,124,254 A 3/1964 Davidson
3,151,576 A 10/1964 Patterson
3,161,295 A 12/1964 Chesley
3,166,195 A 1/1965 Taber
3,285,429 A 11/1966 Propst
3,308,961 A 3/1967 Chesley
3,308,964 A 3/1967 Pistone
3,329,280 A 7/1967 Norris
3,331,337 A 7/1967 MacKay
3,346,126 A 10/1967 Bloom
3,348,732 A 10/1967 Schwarz
3,405,716 A 10/1968 Cafiero
3,452,899 A 7/1969 Libberton
3,497,081 A 2/1970 Field
3,501,016 A 3/1970 Eaton
3,501,019 A 3/1970 Armstrong
3,501,020 A 3/1970 Krikorian
3,512,652 A 5/1970 Armstrong
D219,058 S 10/1970 Kaczur
3,550,979 A 12/1970 Protzmann
3,598,246 A 8/1971 Galli
3,625,371 A 12/1971 Dill
3,652,154 A 3/1972 Gebel
3,667,826 A 6/1972 Wood
3,698,568 A 10/1972 Armstrong
3,709,371 A 1/1973 Luck
3,751,129 A 8/1973 Wright et al.
3,767,083 A 10/1973 Webb
3,776,388 A 12/1973 Mattheis
3,780,876 A 12/1973 Elkins
3,814,490 A 6/1974 Dean et al.
3,815,519 A 6/1974 Meyer
3,830,169 A 8/1974 Madey
3,836,008 A 9/1974 Mraz
3,848,745 A 11/1974 Smith
3,868,021 A 2/1975 Heinrich
3,870,156 A 3/1975 O'Neill
3,893,739 A 7/1975 Bernard
3,923,159 A 12/1975 Taylor et al.
3,949,880 A 4/1976 Fortunato
3,960,273 A 6/1976 Weston
4,007,841 A 2/1977 Seipel
4,015,886 A 4/1977 Wickenberg
4,042,096 A 8/1977 Smith
4,106,668 A 8/1978 Gebhardt et al.
4,205,763 A 6/1980 Merl
4,266,355 A 5/1981 Moss
4,269,326 A 5/1981 Delbrouck
4,300,693 A 11/1981 Spamer
4,303,162 A 12/1981 Suttles

(56) References Cited

U.S. PATENT DOCUMENTS 4,314,700 A 2/1982 Dylag
4,331,243 A 5/1982 Doll
4,351,439 A 9/1982 Taylor
4,378,872 A 4/1983 Brown
4,397,606 A 8/1983 Bruton
4,416,380 A 11/1983 Flum
4,437,572 A 3/1984 Hoffman
4,448,653 A 5/1984 Wegmann
4,454,948 A 6/1984 Spamer
4,454,949 A 6/1984 Flum
4,460,096 A 7/1984 Ricci
D275,058 S 8/1984 Flum
4,463,854 A 8/1984 MacKenzie
4,467,927 A 8/1984 Nathan
4,470,943 A 9/1984 Preis
4,476,985 A 10/1984 Norberg et al.
4,478,337 A 10/1984 Flum
4,482,066 A 11/1984 Dykstra
4,488,653 A 12/1984 Belokin
4,500,147 A 2/1985 Reister
4,504,100 A 3/1985 Chaumard
4,550,838 A 11/1985 Nathan et al.
4,588,093 A 5/1986 Field
4,589,349 A 5/1986 Gebhardt et al.
4,590,696 A 5/1986 Squitieri
4,593,823 A 6/1986 Fershko et al.
4,602,560 A 7/1986 Jacky
4,606,280 A 8/1986 Poulton et al.
4,610,491 A 9/1986 Freeman
4,615,276 A 10/1986 Garabedian
4,620,489 A 11/1986 Albano
4,629,072 A 12/1986 Loew
4,651,883 A 3/1987 Gullett et al.
4,685,574 A 8/1987 Young et al.
4,705,175 A 11/1987 Howard et al.
4,706,821 A 11/1987 Kohls et al.
4,712,694 A 12/1987 Breslow
4,724,968 A 2/1988 Wombacher
4,729,481 A 3/1988 Hawkinson et al.
4,730,741 A 3/1988 Jackie, III et al.
4,742,936 A 5/1988 Rein
4,744,489 A 5/1988 Binder et al.
4,762,235 A 8/1988 Howard et al.
4,762,236 A 8/1988 Jackie, III et al.
4,768,661 A 9/1988 Pfeifer
4,771,898 A 9/1988 Howard et al.
4,775,058 A 10/1988 Yatsko
4,776,472 A 10/1988 Rosen
4,790,037 A 12/1988 Phillips
4,801,025 A 1/1989 Flum et al.
4,809,855 A 3/1989 Bustos
4,809,856 A 3/1989 Muth
4,817,900 A 4/1989 Whittington et al.
4,828,144 A 5/1989 Garrick
4,830,201 A 5/1989 Breslow
4,836,390 A 6/1989 Polvere
4,846,367 A 7/1989 Guigan et al.
4,883,169 A 11/1989 Flanagan, Jr.
4,887,724 A 12/1989 Pielechowski et al.
4,887,737 A 12/1989 Adenau
4,896,779 A 1/1990 Jureckson
4,898,282 A 2/1990 Hawkinson et al.
4,899,668 A 2/1990 Valiulis
4,899,893 A 2/1990 Robertson
4,901,853 A 2/1990 Maryatt
4,901,869 A 2/1990 Hawkinson et al.
4,901,872 A 2/1990 Lang
4,905,847 A 3/1990 Hanson
4,907,707 A 3/1990 Crum
4,923,070 A 5/1990 Jackle et al.
4,934,645 A 6/1990 Breslow
4,944,924 A 7/1990 Mawhirt et al.
4,958,739 A 9/1990 Spamer
RE33,515 E 1/1991 Fershko et al.
4,981,224 A 1/1991 Rushing
4,997,094 A 3/1991 Spamer et al.
5,012,936 A 5/1991 Crum
5,025,936 A 6/1991 Lamoureaux
5,027,957 A 7/1991 Skalski
5,054,629 A 10/1991 Breen
5,082,125 A 1/1992 Ninni
5,085,154 A 2/1992 Merl
5,088,607 A * 2/1992 Risafi ..... A47F 1/125
211/59.3
5,110,192 A 5/1992 Lauterbach
5,111,942 A 5/1992 Bernardin
5,123,546 A 6/1992 Crum
5,131,563 A 7/1992 Yablans
5,148,927 A 9/1992 Gebka
5,159,753 A 11/1992 Torrence
5,161,702 A 11/1992 Skalski
5,161,704 A 11/1992 Valiulis
5,170,968 A 12/1992 Helmner
5,178,258 A 1/1993 Smalley et al.
5,183,166 A 2/1993 Belokin, Jr. et al.
5,190,186 A 3/1993 Yablans et al.
5,197,610 A 3/1993 Bustos
5,203,463 A 4/1993 Gold
5,215,199 A 6/1993 Bejarano
5,240,126 A 8/1993 Foster et al.
5,255,802 A 10/1993 Krinke et al.
5,265,738 A 11/1993 Yablans et al.
5,295,596 A 3/1994 Squitieri
5,316,154 A 5/1994 Hajec, Jr.
5,322,668 A 6/1994 Tomasso
5,325,792 A 7/1994 Mulloy
5,341,945 A 8/1994 Gibson
5,351,839 A 10/1994 Beeler et al.
5,366,099 A 11/1994 Schmid
5,379,905 A 1/1995 Bustos et al.
5,381,908 A 1/1995 Hepp
5,390,802 A 2/1995 Pappagallo et al.
5,397,006 A 3/1995 Terrell
5,397,016 A 3/1995 Torrence et al.
5,405,193 A 4/1995 Herrenbruck
5,408,775 A 4/1995 Abramson et al.
5,411,146 A 5/1995 Jarecki et al.
5,413,229 A 5/1995 Zuberbuhler et al.
5,415,297 A 5/1995 Klein et al.
5,419,066 A 5/1995 Harnois et al.
5,439,122 A 8/1995 Ramsay
5,450,969 A 9/1995 Johnson et al.
5,458,248 A 10/1995 Alain
5,464,105 A 11/1995 Mandeltort
5,469,975 A 11/1995 Fajnszlajn
5,469,976 A 11/1995 Burchell
5,505,315 A 4/1996 Carroll
5,542,552 A 8/1996 Yablans et al.
5,562,217 A 10/1996 Salveson et al.
5,577,337 A 11/1996 Lin
5,597,150 A 1/1997 Stein et al.
5,605,237 A 2/1997 Richardson et al.
5,613,621 A 3/1997 Gervasi et al.
D378,888 S 4/1997 Bertilsson
5,615,780 A 4/1997 Nimetz et al.
5,624,042 A 4/1997 Flum et al.
5,634,564 A 6/1997 Spamer et al.
5,638,963 A 6/1997 Finnelly et al.
5,641,082 A 6/1997 Grainger
5,645,176 A 7/1997 Jay
5,653,349 A * 8/1997 Dana ..... F16B 12/34
248/221.12
5,655,670 A 8/1997 Stuart
5,657,702 A 8/1997 Ribeyrolles
5,665,304 A 9/1997 Heinen et al.
5,673,801 A 10/1997 Markson
D386,363 S 11/1997 Dardashti
5,682,824 A * 11/1997 Visk ..... A47F 5/005
211/184
5,685,664 A 11/1997 Parham et al.
5,685,864 A 11/1997 Shanley et al.
5,690,038 A 11/1997 Merit et al.
5,695,076 A 12/1997 Jay
5,695,077 A 12/1997 Jay

(56) References Cited

U.S. PATENT DOCUMENTS 5,707,034 A 1/1998 Cotterill
5,711,432 A 1/1998 Stein et al.
5,715,957 A 2/1998 Merl
5,720,230 A 2/1998 Mansfield
5,730,320 A 3/1998 David
5,738,019 A 4/1998 Parker
5,740,944 A 4/1998 Crawford
5,743,428 A 4/1998 Rankin, VI
5,746,328 A 5/1998 Beeler et al.
5,749,478 A 5/1998 Ellis
5,765,390 A 6/1998 Johnson et al.
5,788,090 A 8/1998 Kajiwara
5,803,276 A 9/1998 Vogler
5,806,690 A 9/1998 Johnson et al.
5,826,731 A 10/1998 Dardashti
5,839,588 A 11/1998 Hawkinson
5,848,709 A 12/1998 Gelphman et al.
5,855,283 A 1/1999 Johnson
5,862,923 A 1/1999 Nordquist et al.
D405,632 S 2/1999 Parham
5,865,324 A 2/1999 Jay et al.
5,873,473 A 2/1999 Pater
5,873,489 A 2/1999 Ide et al.
5,878,895 A 3/1999 Springs
5,881,910 A 3/1999 Rein
5,887,732 A 3/1999 Zimmer et al.
5,904,256 A 5/1999 Jay
5,906,283 A 5/1999 Kump et al.
5,921,411 A 7/1999 Merl
5,921,412 A 7/1999 Merl
5,944,201 A 8/1999 Babboni et al.
5,951,228 A 9/1999 Pfeiffer et al.
5,970,887 A 10/1999 Hardy
5,971,173 A 10/1999 Valiulis et al.
5,971,204 A 10/1999 Apps
5,975,318 A 11/1999 Jay
5,992,652 A 11/1999 Springs
5,992,653 A 11/1999 Anderson et al.
6,006,678 A 12/1999 Merit et al.
6,007,248 A 12/1999 Fulterer
6,015,051 A 1/2000 Battaglia
6,021,908 A 2/2000 Mathews
6,026,984 A 2/2000 Perrin
6,035,569 A 3/2000 Nagel et al.
6,041,720 A 3/2000 Hardy
6,044,982 A 4/2000 Stuart
6,047,647 A 4/2000 Laraia, Jr.
6,068,142 A 5/2000 Primiano
6,076,670 A 6/2000 Yeranossian
6,082,556 A * 7/2000 Primiano ..... A47F 1/12 211/74
6,082,557 A 7/2000 Leahy
6,082,558 A 7/2000 Battaglia
6,089,385 A 7/2000 Nozawa
6,102,185 A 8/2000 Neuwirth et al.
6,112,938 A 9/2000 Apps
6,129,218 A 10/2000 Henry et al.
6,132,158 A 10/2000 Pfeiffer et al.
6,142,316 A 11/2000 Harbour et al.
6,142,317 A 11/2000 Merl
6,155,438 A 12/2000 Close
6,164,462 A 12/2000 Mumford
6,164,491 A 12/2000 Bustos et al.
6,168,032 B1 1/2001 Merl
6,173,845 B1 1/2001 Higgins et al.
6,186,725 B1 2/2001 Konstant
6,189,734 B1 2/2001 Apps et al.
6,196,401 B1 3/2001 Brady et al.
6,209,731 B1 4/2001 Spamer et al.
6,209,733 B1 4/2001 Higgins et al.
6,226,910 B1 5/2001 Ireland
6,227,385 B1 * 5/2001 Nickerson ..... A47F 1/126 211/59.3
6,227,386 B1 5/2001 Close
6,234,325 B1 5/2001 Higgins et al.
6,234,326 B1 5/2001 Higgins et al.
6,234,328 B1 5/2001 Mason
6,237,784 B1 5/2001 Primiano
6,241,121 B1 6/2001 Yasaka
D445,615 S 7/2001 Burke
6,253,954 B1 7/2001 Yasaka
6,299,004 B1 * 10/2001 Thalenfeld ..... A47F 5/005 211/184
6,305,559 B1 * 10/2001 Hardy ..... A47F 5/005 211/184
6,308,839 B1 10/2001 Steinberg et al.
6,309,034 B1 10/2001 Credle, Jr. et al.
6,311,852 B1 11/2001 Ireland
6,325,221 B2 12/2001 Parham
6,325,222 B1 12/2001 Avery et al.
6,330,758 B1 12/2001 Feibelman
6,357,606 B1 3/2002 Henry
6,357,985 B1 3/2002 Anzani et al.
6,375,015 B1 4/2002 Wingate
6,378,727 B1 4/2002 Dupuis et al.
6,382,431 B1 5/2002 Burke
6,389,991 B1 5/2002 Morrisson
6,390,310 B1 5/2002 Insalaco
6,398,044 B1 6/2002 Robertson
6,401,942 B1 6/2002 Eckert
6,405,880 B1 6/2002 Webb
6,409,026 B2 6/2002 Watanabe
6,409,027 B1 6/2002 Chang et al.
6,409,028 B2 6/2002 Nickerson
6,419,100 B1 7/2002 Menz et al.
6,428,123 B1 8/2002 Lucht et al.
6,431,808 B1 8/2002 Lowrey et al.
6,435,359 B1 8/2002 Priminano
6,439,402 B2 8/2002 Robertson
6,464,089 B1 10/2002 Rankin, VI
6,471,053 B1 10/2002 Feibelman
6,471,081 B1 10/2002 Weiler
6,484,891 B2 11/2002 Burke
6,490,983 B1 12/2002 Nicholson et al.
6,497,185 B1 12/2002 Barrett et al.
6,497,326 B1 12/2002 Osawa
6,505,747 B1 1/2003 Robertson
6,523,664 B2 2/2003 Shaw et al.
6,523,702 B1 2/2003 Primiano et al.
6,523,703 B1 2/2003 Robertson
6,527,127 B2 3/2003 Dumontet
6,533,131 B2 3/2003 Bada
D472,411 S 4/2003 Burke
6,553,702 B1 4/2003 Bacnik
6,554,143 B1 4/2003 Robertson
6,571,498 B1 * 6/2003 Cyrluk ..... G09F 3/204 211/119.003
6,598,754 B2 7/2003 Weiler
6,604,638 B1 8/2003 Primiano et al.
6,615,995 B2 9/2003 Primiano et al.
6,622,874 B1 9/2003 Hawkinson
6,637,604 B1 10/2003 Jay
6,648,151 B2 11/2003 Battaglia et al.
6,651,828 B2 11/2003 Dimattio et al.
6,655,536 B2 12/2003 Jo et al.
6,659,293 B1 12/2003 Smith
6,666,533 B1 12/2003 Stavros
D485,699 S 1/2004 Mueller et al.
6,679,033 B2 1/2004 Hart et al.
6,679,389 B1 1/2004 Robertson et al.
6,688,567 B2 2/2004 Fast et al.
6,691,891 B2 2/2004 Maldonado
6,695,152 B1 2/2004 Fabrizio et al.
6,715,621 B2 4/2004 Boron
6,722,509 B1 4/2004 Robertson et al.
RE38,517 E 5/2004 Pfeiffer et al.
6,739,461 B1 5/2004 Robinson
6,745,905 B2 6/2004 Bernstein
6,749,070 B2 6/2004 Corbett, Jr. et al.
6,756,975 B1 6/2004 Kishida et al.
6,758,349 B1 7/2004 Kwap et al.
6,769,552 B1 8/2004 Thalenfeld
6,772,888 B2 8/2004 Burke
6,779,670 B2 8/2004 Primiano et al.

(56) References Cited

U.S. PATENT DOCUMENTS 6,786,341 B2 9/2004 Stinnett et al.
6,793,185 B2 * 9/2004 Joliey ..... G09F 3/204 40/658
6,796,445 B2 9/2004 Cyrluk
6,799,523 B1 10/2004 Cunha
6,820,754 B2 11/2004 Ondrasik
6,823,997 B2 11/2004 Linden et al.
6,824,009 B2 11/2004 Hardy
6,830,146 B1 12/2004 Scully et al.
6,830,157 B2 12/2004 Robertson et al.
6,843,382 B2 1/2005 Kanouchi et al.
6,843,632 B1 1/2005 Hollander
6,860,046 B1 3/2005 Squitieri
6,866,156 B2 3/2005 Nagel et al.
6,867,824 B2 3/2005 Eiraku et al.
6,874,646 B2 4/2005 Jay
6,886,699 B2 5/2005 Johnson et al.
6,889,854 B2 5/2005 Burke
6,889,855 B2 5/2005 Nagel
6,902,285 B2 6/2005 Eiraku et al.
6,918,495 B1 7/2005 Hoy
6,918,736 B2 7/2005 Hart et al.
6,919,933 B2 7/2005 Zhang et al.
6,923,330 B1 8/2005 Nagel
6,929,133 B1 8/2005 Knapp, III et al.
6,948,900 B1 9/2005 Neuman
6,955,269 B2 10/2005 Menz
6,957,941 B2 10/2005 Hart et al.
6,962,260 B2 11/2005 Jay et al.
6,963,386 B2 11/2005 Poliakine et al.
6,964,235 B2 * 11/2005 Hardy ..... A47F 1/126 211/184
6,964,344 B1 11/2005 Kim
6,976,598 B2 12/2005 Engel
6,981,597 B2 1/2006 Cash
7,004,334 B2 2/2006 Walsh et al.
7,007,790 B2 3/2006 Brannon
7,028,450 B2 4/2006 Hart et al.
7,028,852 B2 4/2006 Johnson et al.
7,063,217 B2 6/2006 Burke
7,080,969 B2 7/2006 Hart et al.
7,083,054 B2 8/2006 Squitieri
7,086,541 B2 8/2006 Robertson
7,093,546 B2 8/2006 Hardy
7,104,026 B2 9/2006 Welborn et al.
7,104,410 B2 9/2006 Primiano
7,108,143 B1 9/2006 Lin
7,111,914 B2 9/2006 Avendano
7,114,606 B2 10/2006 Shaw et al.
7,124,898 B2 10/2006 Richter et al.
7,140,499 B2 11/2006 Burke
7,140,705 B2 11/2006 Dressendorfer et al.
7,150,365 B2 12/2006 Hardy et al.
7,152,536 B2 12/2006 Hardy
7,168,546 B2 1/2007 Plesh, Sr.
7,168,579 B2 1/2007 Richter et al.
7,182,209 B2 2/2007 Squitieri
7,195,123 B2 3/2007 Roslof et al.
7,198,340 B1 4/2007 Ertz
7,200,903 B2 4/2007 Shaw et al.
7,201,281 B1 * 4/2007 Welker ..... A47F 1/126 211/59.3
7,216,770 B2 * 5/2007 Mueller ..... A47F 1/126 211/59.3
7,229,143 B2 6/2007 Gilman
7,293,663 B2 11/2007 Lavery, Jr.
7,299,934 B2 11/2007 Hardy et al.
7,318,532 B1 1/2008 Lee et al.
7,347,335 B2 3/2008 Rankin, VI et al.
7,357,469 B2 4/2008 Ertz
7,395,938 B2 7/2008 Merit et al.
7,398,876 B2 7/2008 Vestergaard
7,404,494 B2 7/2008 Hardy
7,419,062 B2 9/2008 Mason
7,424,957 B1 * 9/2008 Luberto ..... A47F 1/126 312/61
7,451,881 B2 11/2008 Hardy et al.
7,458,473 B1 12/2008 Mason
7,478,731 B1 1/2009 Mason
7,497,342 B2 * 3/2009 Hardy ..... A47F 1/126 211/151
7,500,571 B2 3/2009 Hawkinson
7,530,452 B2 5/2009 Vestergaard
7,614,350 B2 11/2009 Tuttle et al.
7,621,409 B2 11/2009 Hardy et al.
7,626,913 B2 12/2009 Usami
7,631,771 B2 12/2009 Nagel et al.
7,641,057 B2 * 1/2010 Mueller ..... A47F 1/126 211/59.3
7,644,827 B2 1/2010 Hanretty
7,681,743 B2 3/2010 Hanretty et al.
7,681,744 B2 3/2010 Johnson
7,686,185 B2 3/2010 Zychinski
7,703,614 B2 4/2010 Schneider et al.
7,717,276 B2 5/2010 Alves
7,768,399 B2 8/2010 Hachmann et al.
7,784,623 B2 8/2010 Mueller et al.
7,784,644 B2 8/2010 Albert et al.
7,792,711 B2 9/2010 Swafford, Jr. et al.
7,815,060 B2 * 10/2010 Lellimo ..... B65G 1/023 211/151
7,823,724 B2 11/2010 Mowe et al.
7,823,734 B2 11/2010 Hardy
7,828,158 B2 11/2010 Colelli et al.
7,882,969 B2 2/2011 Gerstner et al.
7,891,503 B2 2/2011 Hardy
7,896,172 B1 3/2011 Hester
7,918,353 B1 * 4/2011 Luberto ..... A47F 1/126 312/61
7,931,156 B2 4/2011 Hardy
7,934,609 B2 5/2011 Alves et al.
7,980,398 B2 7/2011 Kahl et al.
7,993,088 B2 8/2011 Sonon et al.
8,016,139 B2 9/2011 Hanners et al.
8,025,162 B2 * 9/2011 Hardy ..... A47F 1/126 211/151
8,038,017 B2 10/2011 Close
8,096,427 B2 * 1/2012 Hardy ..... A47F 1/126 211/59.3
8,113,360 B2 2/2012 Olson
8,113,601 B2 2/2012 Hardy
D655,107 S 3/2012 Clark et al.
8,127,944 B2 3/2012 Hardy
8,162,154 B2 4/2012 Trulaske, Sr.
8,167,149 B2 5/2012 Wamsley et al.
8,177,076 B2 * 5/2012 Rataiczak, III ..... A47F 1/126 211/59.3
8,215,520 B2 7/2012 Miller et al.
8,225,946 B2 7/2012 Yang et al.
8,267,258 B2 9/2012 Allwright et al.
8,276,772 B2 10/2012 Kim
8,312,999 B2 11/2012 Hardy
8,322,544 B2 12/2012 Hardy
8,333,285 B2 12/2012 Kiehnau et al.
8,342,340 B2 1/2013 Rataiczak, III et al.
8,360,253 B2 1/2013 Hardy
8,376,154 B2 2/2013 Sun
8,397,922 B2 3/2013 Kahl et al.
8,485,391 B2 7/2013 Vlastakis et al.
8,556,092 B2 10/2013 Valiulis et al.
8,573,379 B2 11/2013 Brugmann
8,579,123 B2 11/2013 Mueller et al.
8,622,227 B2 1/2014 Bird et al.
8,627,965 B2 * 1/2014 Hardy ..... A47F 1/126 211/59.3
8,657,126 B1 2/2014 Loftin et al.
8,662,319 B2 3/2014 Hardy
8,662,325 B2 * 3/2014 Davis ..... A47F 5/005 211/151
8,672,150 B2 3/2014 Chen et al.
8,739,984 B2 6/2014 Hardy

(56) References Cited

U.S. PATENT DOCUMENTS 8,746,468 B2* 6/2014 Poulokefalos ..... A47F 5/005 211/59.3
8,752,717 B2 6/2014 Bird et al.
8,763,819 B2 7/2014 Theisen et al.
8,844,431 B2 9/2014 Davis et al.
8,967,394 B2 3/2015 Hardy et al.
8,973,765 B2 3/2015 Wamsley et al.
8,978,904 B2 3/2015 Hardy
9,016,483 B2 4/2015 Howley
9,060,624 B2 6/2015 Hardy
9,138,075 B2 9/2015 Hardy et al.
9,149,132 B2 10/2015 Hardy
9,173,504 B2 11/2015 Hardy
9,173,505 B2 11/2015 Hardy
9,259,102 B2 2/2016 Hardy et al.
9,380,889 B2 7/2016 Howard
9,565,952 B1* 2/2017 Luberto ..... A47F 1/126
9,629,479 B2 4/2017 Sosso et al.
9,629,480 B2 4/2017 Ewing et al.
9,635,957 B2 5/2017 Hardy
9,668,590 B1 6/2017 Bruegmann
9,687,085 B2 6/2017 Hardy
9,706,857 B2 7/2017 Hardy et al.
9,713,394 B1 7/2017 Bruegmann
9,723,934 B2 8/2017 Hardy
9,730,528 B2 8/2017 Hardy
9,730,529 B2 8/2017 Colelli et al.
9,730,531 B2* 8/2017 Hardy ..... A47B 57/581
9,750,354 B2 9/2017 Hardy
9,770,121 B2* 9/2017 Walker ..... A47F 7/28
9,782,017 B1* 10/2017 Luberto ..... A47F 1/125
9,801,466 B2 10/2017 Hardy
9,805,539 B2 10/2017 Swafford, Jr. et al.
9,861,211 B2 1/2018 Miller, Jr. et al.
9,955,802 B2* 5/2018 Bird ..... A47B 57/58
10,172,481 B2* 1/2019 Walker ..... A47F 1/125
10,588,426 B2* 3/2020 Bird ..... A47B 57/58
D927,988 S 8/2021 O'Neill
11,122,915 B2* 9/2021 Bird ..... A47B 57/58
2002/0170866 A1* 11/2002 Johnson ..... A47F 1/126 211/59.3
2003/0189018 A1 10/2003 Hopkins et al.
2003/0200688 A1 10/2003 Richter
2004/0200793 A1* 10/2004 Hardy ..... A47F 5/0068 211/119.003
2004/0245197 A1* 12/2004 McElvaney ..... A47F 5/005 211/59.3
2004/0256341 A1 12/2004 Donnell et al.
2005/0139560 A1* 6/2005 Whiteside ..... A47F 5/005 211/119.003
2006/0186064 A1* 8/2006 Merit ..... A47F 5/005 211/59.3
2006/0260518 A1* 11/2006 Josefsson ..... A47F 5/0068 108/61
2007/0068885 A1 3/2007 Busto et al.
2007/0080126 A1 4/2007 Music
2007/0138114 A1* 6/2007 Dumontet ..... A47F 1/126 211/59.3
2007/0187344 A1* 8/2007 Mueller ..... A47F 1/126 211/59.3
2007/0267364 A1* 11/2007 Barkdoll ..... A47F 1/126 211/59.3
2007/0267365 A1 11/2007 Saito
2009/0008406 A1 1/2009 Vardaro et al.
2010/0012602 A1* 1/2010 Valiulis ..... A47F 1/126 211/59.3
2010/0051564 A1 3/2010 Chen
2010/0089847 A1* 4/2010 Rataiczak, III ..... A47F 1/126 211/59.3
2010/0133214 A1* 6/2010 Evans ..... A47F 1/12 211/49.1
2010/0206829 A1 8/2010 Clements et al.
2010/0224582 A1 9/2010 Loy, II et al.
2010/0230369 A1* 9/2010 Weshler ..... A47F 5/005 211/183
2010/0252519 A1* 10/2010 Hanners ..... A47F 5/005 211/184
2010/0258513 A1* 10/2010 Meyer ..... A47F 1/126 211/59.3
2011/0094980 A1* 4/2011 Cousin ..... A47F 5/005 29/525
2011/0100942 A1* 5/2011 Spizman ..... A47B 57/045 211/150
2011/0180498 A1 7/2011 Kidd et al.
2011/0215060 A1* 9/2011 Niederhuefner ..... A47F 1/125 211/59.3
2012/0006773 A1* 1/2012 Mueller ..... A47F 1/126 211/59.3
2013/0206713 A1* 8/2013 Hardy ..... A47F 1/00 211/49.1
2013/0270204 A1* 10/2013 Bird ..... A47F 5/005 211/49.1
2014/0217042 A1 8/2014 Hardy
2014/0263133 A1* 9/2014 Walker ..... A47F 5/005 24/561
2014/0263134 A1* 9/2014 Walker ..... A47B 57/58 211/184
2014/0299560 A1* 10/2014 Kim ..... A47F 1/126 211/59.2
2014/0326690 A1 11/2014 Hardy
2014/0326691 A1 11/2014 Hardy
2015/0208830 A1 7/2015 Hardy
2015/0359358 A1 12/2015 Miller, Jr. et al.
2016/0081491 A1 3/2016 Hardy
2016/0088935 A1* 3/2016 Brej ..... A47F 5/005 211/126.6
2017/0020304 A1 1/2017 Hardy
2017/0035218 A1 2/2017 Riley et al.
2017/0042344 A1 2/2017 Hardy
2017/0071361 A1 3/2017 Hardy
2017/0086601 A1 3/2017 Hardy et al.
2017/0119174 A1 5/2017 Hardy
2017/0119175 A1 5/2017 Hardy
2017/0127853 A1 5/2017 Colelli et al.
2017/0172316 A1 6/2017 Hardy et al.
2017/0196355 A1 7/2017 Hardy et al.
2017/0202369 A1 7/2017 Mercier et al.
2017/0215602 A1 8/2017 Bruegmann
2017/0245659 A1 8/2017 Hardy
2017/0295954 A1 10/2017 Hardy
2017/0303705 A1 10/2017 Hardy
2017/0303706 A1 10/2017 Hardy

FOREIGN PATENT DOCUMENTS

BE 906083 A2 4/1987
BE 1013877 A6 11/2002
BR 112014010771 A2 4/2017
CA 2593137 A1 1/2008
CH 412251 A 4/1966
CN 2642158 Y 9/2004
CN 101472509 A 7/2009
CN 106413484 A 2/2017
CN 106572758 A 4/2017
CN 107072413 A 8/2017
CN 107249399 A 10/2017
DE 697994 C 10/1940
DE 969003 C 4/1958
DE 1819158 U 10/1960
DE 2002720 A1 7/1971
DE 7311113 U 8/1973
DE 197311113 8/1973
DE 2232398 A1 1/1974
DE 2825724 A1 12/1979
DE 8308485 U1 9/1983
DE 3211880 A1 10/1983
DE 8426651 U1 2/1985
DE 8717386 U1 3/1988
DE 3707410 A1 9/1988
DE 9300431 U1 3/1993
DE 29618870 U1 12/1996

(56) References Cited

FOREIGN PATENT DOCUMENTS

| | | | |
|---|---|---|---|
| DE | 29902688 | U1 | 7/1999 |
| DE | 19808162 | A1 | 9/1999 |
| DE | 202007011927 | U1 | 11/2007 |
| DE | 202013102529 | U1 | 6/2013 |
| EP | 4921 | A1 | 10/1979 |
| EP | 18003 | A2 | 10/1980 |
| EP | 69003 | A1 | 1/1983 |
| EP | 176209 | A2 | 4/1986 |
| EP | 224107 | A2 | 6/1987 |
| EP | 270016 | A2 | 6/1988 |
| EP | 298500 | A2 | 1/1989 |
| EP | 336696 | A2 | 10/1989 |
| EP | 337340 | A2 | 10/1989 |
| EP | 398500 | A1 | 11/1990 |
| EP | 408400 | A1 | 1/1991 |
| EP | 454586 | A1 | 10/1991 |
| EP | 478570 | A1 | 4/1992 |
| EP | 555935 | A1 | 8/1993 |
| EP | 568396 | A1 | 11/1993 |
| EP | 587059 | A2 | 3/1994 |
| EP | 779047 | A1 | 6/1997 |
| EP | 779447 | A2 | 6/1997 |
| EP | 782831 | A1 | 7/1997 |
| EP | 979628 | A1 | 2/2000 |
| EP | 0986980 | A1 | 3/2000 |
| EP | 1010647 | A1 | 6/2000 |
| EP | 1077040 | A1 | 2/2001 |
| EP | 1151941 | A2 | 11/2001 |
| EP | 1174060 | A1 | 1/2002 |
| EP | 1208773 | A1 | 5/2002 |
| EP | 1256296 | A2 | 11/2002 |
| EP | 1312285 | A1 | 5/2003 |
| EP | 1356752 | A1 | 10/2003 |
| EP | 1372436 | A1 | 1/2004 |
| EP | 1395152 | A1 | 3/2004 |
| EP | 1406527 | A1 | 4/2004 |
| EP | 1420669 | A2 | 5/2004 |
| EP | 1462035 | A2 | 9/2004 |
| EP | 1510156 | A2 | 3/2005 |
| EP | 1514493 | A1 | 3/2005 |
| EP | 1541064 | A1 | 6/2005 |
| EP | 1549182 | A1 | 7/2005 |
| EP | 1579789 | A1 | 9/2005 |
| EP | 1662944 | A1 | 6/2006 |
| EP | 1514493 | B1 | 4/2007 |
| EP | 1806076 | A2 | 7/2007 |
| EP | 1617745 | B1 | 8/2007 |
| EP | 1857021 | A2 | 11/2007 |
| EP | 1864597 | A1 | 12/2007 |
| EP | 1940263 | A2 | 7/2008 |
| EP | 1993407 | A2 | 11/2008 |
| EP | 2005402 | A2 | 12/2008 |
| EP | 2159169 | A1 | 3/2010 |
| EP | 2181945 | A1 | 5/2010 |
| EP | 2222208 | A1 | 9/2010 |
| EP | 2237703 | A1 | 10/2010 |
| EP | 2282660 | A1 | 2/2011 |
| EP | 2308353 | A1 | 4/2011 |
| EP | 2338384 | A1 | 6/2011 |
| EP | 2353458 | A2 | 8/2011 |
| EP | 2398358 | A1 | 12/2011 |
| EP | 2415371 | A1 | 2/2012 |
| EP | 2531077 | A1 | 12/2012 |
| EP | 2545813 | A1 | 1/2013 |
| EP | 2591703 | A1 | 5/2013 |
| EP | 2600752 | A1 | 6/2013 |
| EP | 2625987 | A1 | 8/2013 |
| EP | 2750554 | A1 | 7/2014 |
| EP | 2750555 | A1 | 7/2014 |
| EP | 2773242 | A1 | 9/2014 |
| EP | 2946698 | A1 | 11/2015 |
| EP | 2967235 | A2 | 1/2016 |
| EP | 3007593 | A1 | 4/2016 |
| EP | 3125727 | A1 | 2/2017 |
| EP | 3151705 | A1 | 4/2017 |
| EP | 3202286 | A1 | 8/2017 |
| EP | 3217846 | A1 | 9/2017 |
| EP | 3236809 | A1 | 11/2017 |
| FR | 2385365 | A1 | 10/1978 |
| FR | 2526338 | A1 | 11/1983 |
| FR | 2617385 | A1 | 1/1989 |
| FR | 2724098 | A1 | 3/1996 |
| FR | 2729839 | A1 | 8/1996 |
| FR | 2859364 | A1 | 3/2005 |
| GB | 697994 | A | 10/1953 |
| GB | 740311 | A | 11/1955 |
| GB | 881700 | A | 11/1961 |
| GB | 1082150 | A | 9/1967 |
| GB | 1088654 | A | 10/1967 |
| GB | 2027339 | A | 2/1980 |
| GB | 2037553 | A | 7/1980 |
| GB | 2281289 | A | 3/1995 |
| GB | 2283407 | A | 5/1995 |
| GB | 2290077 | A | 12/1995 |
| GB | 2297241 | A | 7/1996 |
| GB | 2304102 | A | 3/1997 |
| GB | 2386116 | A | 9/2003 |
| GB | 2392667 | A | 3/2004 |
| GB | 2426433 | A | 11/2006 |
| GB | 2439624 | A | 1/2008 |
| JP | S54168195 | U | 11/1979 |
| JP | S59218113 | A | 12/1984 |
| JP | S62060521 | A | 3/1987 |
| JP | S63029463 | A | 2/1988 |
| JP | S63097114 | A | 4/1988 |
| JP | S63099810 | A | 5/1988 |
| JP | H2191413 | A | 7/1990 |
| JP | H03005457 | A | 1/1991 |
| JP | H03099639 | A | 4/1991 |
| JP | H03115289 | A | 5/1991 |
| JP | H03115812 | A | 5/1991 |
| JP | H05277023 | A | 10/1993 |
| JP | H8507447 | A | 8/1996 |
| JP | H9238787 | A | 9/1997 |
| JP | H1086856 | A | 4/1998 |
| JP | H10263710 | A | 10/1998 |
| JP | H11006284 | A | 1/1999 |
| JP | H11018889 | A | 1/1999 |
| JP | 2973297 | B2 | 11/1999 |
| JP | H11313737 | A | 11/1999 |
| JP | H11342054 | A | 12/1999 |
| JP | 2000023802 | A | 1/2000 |
| JP | 2000106988 | A | 4/2000 |
| JP | 3045766 | B2 | 5/2000 |
| JP | 2000157378 | A | 6/2000 |
| JP | 3115289 | B2 | 12/2000 |
| JP | 2000350642 | A | 12/2000 |
| JP | 2001104117 | A | 4/2001 |
| JP | 2003463 | A | 1/2003 |
| JP | 2003210286 | A | 7/2003 |
| JP | 2007307244 | A | 11/2007 |
| JP | 4023463 | B2 | 12/2007 |
| JP | 6077614 | B2 | 2/2017 |
| JP | 6202945 | B2 | 9/2017 |
| KR | 20100010091 | A | 2/2010 |
| MX | 2016007026 | A | 1/2017 |
| NL | 106617 | C | 11/1963 |
| NL | 1018330 | C2 | 5/2002 |
| RU | 2016106625 | A | 8/2017 |
| SE | 394537 | B | 6/1977 |
| SU | 1600615 | A3 | 10/1990 |
| TW | 200822888 | A | 6/2008 |
| WO | 1991015141 | A1 | 10/1991 |
| WO | 1992001614 | A1 | 2/1992 |
| WO | 199702774 | A1 | 1/1997 |
| WO | 1998006305 | A1 | 2/1998 |
| WO | 2000048488 | A1 | 8/2000 |
| WO | 2000054632 | A1 | 9/2000 |
| WO | 2000071004 | A1 | 11/2000 |
| WO | 2001065981 | A1 | 9/2001 |
| WO | 0197660 | A1 | 12/2001 |
| WO | 2002089104 | A2 | 11/2002 |
| WO | 2002091885 | A1 | 11/2002 |
| WO | 2003005862 | A2 | 1/2003 |

(56) References Cited

FOREIGN PATENT DOCUMENTS

| | | | |
|---|---|---|---|
| WO | 2003013316 | A2 | 2/2003 |
| WO | 2003032775 | A2 | 4/2003 |
| WO | 200390587 | A1 | 11/2003 |
| WO | 2004105556 | A2 | 12/2004 |
| WO | 2005021406 | A2 | 3/2005 |
| WO | 2006019947 | A2 | 2/2006 |
| WO | 200627871 | A1 | 3/2006 |
| WO | 200627872 | A1 | 3/2006 |
| WO | 200628245 | A1 | 3/2006 |
| WO | 2006094058 | A2 | 9/2006 |
| WO | 200720725 | A1 | 2/2007 |
| WO | 2007073294 | A1 | 6/2007 |
| WO | 2007133086 | A1 | 11/2007 |
| WO | 2008051996 | A2 | 5/2008 |
| WO | 2008153561 | A1 | 12/2008 |
| WO | 2009029099 | A1 | 3/2009 |
| WO | 2009094454 | A1 | 7/2009 |
| WO | 2009152246 | A1 | 12/2009 |
| WO | 2010014742 | A1 | 2/2010 |
| WO | 2011018059 | A1 | 2/2011 |
| WO | 2012047480 | A1 | 4/2012 |
| WO | 2012125301 | A1 | 9/2012 |
| WO | 2012127847 | A1 | 9/2012 |
| WO | 2013033545 | A1 | 3/2013 |
| WO | 2013033555 | A1 | 3/2013 |
| WO | 2013066686 | A1 | 5/2013 |

OTHER PUBLICATIONS

*RTC Ind. Inc.* v. *Fasteners for Retail*, Minute Order of Dec. 12, 2003 by Honorable Joan B. Gottschall, Case No. 1:03.
FFR Yellow pages, 2003 product Catalog, "Merchandising Ideas Made Easy for Every Retain Environment," dated pp. 1-14.
*RTC Industries, Inc.* v. *Fasteners for RetailInc.*,Complaint, dated May 12, 2003 p. 1-6.
*RTC Industries, Inc.* v. *Fasteners for Retail, Inc., and Super Valu, Inc. d/b/a Cub Foods*, Complaint, dated Dec. 2005 ; p. 1-25.
Jun. 11, 2014—(EP) European Search Report—App. 14164097.
Jan. 6, 2015—(JP) Office Action—App 2014-528646.
Jun. 11, 2014—(EP) European Search Report—App 14164097.9.
Sep. 9, 2015—(PCT) International Search Report and Written Opinion—PCT/US2015/034499.
Aug. 25, 2015—(EP) Office Action—App 12772157.9.
Sep. 25, 2015 (CA)—Office Action—App. 2847521.
http://www.posexpert.pl/public/files/PDF/Popychacze%20produkt%C3%B3w.pdf; Sep. 2006.
http://www.Ipportal.com/feature-articles/item/15-product-protection%E2%80%94beyond-eas.html; Mar. 2004.
http://www.posexpert.pl/public/files/PDF/Zarz%C4%85dzanie%20p%C3%133%C5%82k%C4%85%20(ang.)pdf; 2006.
http://www.storereadysolutions. com/srs. nsf/I_rinc/A 56 F52C F98E 1289386257 449006011 DD !Open Document.
=Box-to-Shelf Pusher System- http://www.displaypeople.com/pdf/BOX_ TO_SHELF SELL_SHEET_Jan_19_ V3. pdf. Jan. 19, 2011.
FFR DSI—Power Zone Trak-Set Self-facing System—http://www.ffr-dsi.com/sell-sheets/Power%20Zone%20Trak-Set%—dated Jan. 6, 2011.
*RTC Industries, Inc.*, v. *Fasteners for Retail, Inc., and SuperValu, Inc. d/b/a Cub Foods*, Stipulation of Dismissal, Civil No. 05 C 6940, Apr. 2006.
*RTC Industries, Inc.*, v. *Fasteners for Retail, Inc., and SuperValu, Inc. d/b/a Cub Foods*, Complaint, Civil Action No. 6940.
*RTC Industries, Inc.* v. *Fasteners for Retail Inc.*, Plaintiff RTC Industries Inc.'s Complaint, Civil Action No. 03C 3137, May 12, 2003.
*RTC Industries, Inc.*, v. *Fasteners for Retail Inc., and CVS Corporation*, Amended Complaint, Civil Action No. 03C dated Aug. 6, 2003.
*RTC Industries, Inc.* v. *Fasteners for Retail, Inc. and CVS Pharmacy, Inc.*, to Vulcan Spring & Mfg. Co., Subpoena in a Case, Case No. 03C 3137 N.D. Illinois, dated Oct. 28, 2003.
Non-FInal Office Action dated Jun. 20, 2017, issued by the U.S. Patent and Trademark Office relating to U.S. Appl. No. 15/141,151.
Non-FInal Office Action dated May 3, 2019, by the U.S. Patent and Trademark Office relating to U.S. Appl. No. 15/950,167.
Final Office Action dated Aug. 28, 2019, by the U.S. Patent and Trademark Office relating to U.S. Appl. No. 15/950,167.
U.S. Patent and Trademark Office Non-Final Office Action dated Feb. 10, 2017, relating to U.S. Appl. No. 15/076,329.
http://www.posexpert.pl/publicifiles/PDF/Popychacze%20produkt%CrkB3w.pdf; Sep. 2006.
http://www.hl-display.sk/eng/Catalogue2005/Optimal-eng-pdf; 2005.
http://www.triononline.com/trionshelfworks/sw2.php; May 2007.
http://web .archive. org/web/20070516135906/hllp :1 Iwww. Triononline.com/ productlines/wonderBar. php; May 2007.
http://www.Ipportal.comifeature-articles/item/15-product-protection%E2%80%94beyond-eas.html; Mar. 2004.
http://www.posexpert.pl/publicifiles/PDF/Zarz%C4%85dzanie%20p%CrkB3%C5%82k%C4%85%20(ang.)pdf; 2006.
http://www.postuning.de/fileadmin/PDF-Downloads/Prospekte/EN_Tabak. pdf; 2006.
http://www.postuning.de/fileadmin/PDF-Downloads/Prospekte/EN_ePusher.pdf: Feb. 2005.
Vue 3040 Sanden; Apr. 2005.
http://www.storereadysolutions. com/srs. nsf/I_rinc/A56 F52C F98E 1289386257 449006011 DD !Open Document; 2006.
http://ers.rtc. com/SRS Fi les/SRS Flyer ProfitPusher. pdf; 2006.
Box-to-Shelf Pusher System—http://www.displaypeople.com/pdf/BOX_ TO_SHELF SELL_SHEET_Jan_19_ V3.pdf. Dated Jan. 19, 2011.
Shelf Works—Expandable Wire Tray System—http://www.Iriononline.com/pdf/ExpWTray.pdf. dated Jan. 6, 2003.
FFR DSI—Power Zone Trak-Set Self-facing System—http://www.ffr-dsi.com/sell-sheets/Power%20Zone%20Trak-Set%20Self-facing%20System.pdf.—dated Jan. 6, 2011.
International Search Report & Written Opinion for PCT/US2012/053374 dated Nov. 27, 2012. (12 pages).
International Search Report & Written Opinion for PCT/US2012/053357 dated Nov. 22, 2012. (13 pages).
Final Office Action dated Nov. 5, 2013 for Japanese Application No. 2012-8725, 8 pages.
*RTC Industries, Inc.*, v. *Fasteners for Retail, Inc., and SuperValu, Inc. d/b/a Cub Foods*, Stipulation of Dismissal, Civil Action No. 05 C 6940, Apr. 2006.
*RTC* vs. *Fasteners for Retail*, Case No. 05C 6940, Document No. 26, filed Apr. 25, 2006.
*RTC Industries, Inc.*, v. *Fasteners for Retail, Inc., and SuperValu, Inc. d/b/a Cub Foods*, Complaint, Civil Action No. 05C 6940.
*RTC Industries, Inc.* v. *Fasteners for Retail Inc.*, Plaintiff RTC Industries Inc.'s Complaint, Civil Action No. 03C 3137, dated May 12, 2003.
*RTC Industries, Inc.*, v. *Fasteners for Retail Inc., and CVS Corporation*, Amended Complaint, Civil Action No. 030 3137, dated Aug. 6, 2003.
*RTC Industries, Inc.* v. *Fasteners for Retail Inc., and CVS Corporation*, Reply, Civil Action No. 03C 3137, dated Sep. 17, 2003.
*RTC Industries, Inc.* v. *Fasteners for Retail, Inc. and CVS Pharmacy, Inc.*, to Vulcan Spring & Mfg. Co., Subpoena in a Civil Case, Case No. 03C 3137 N.D. Illinois, dated Oct. 28, 2003.
*RTC Industries, Inc.* v. *Fasteners for Retail Inc., and CVS Pharmacy, Inc.*, to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc., and CVS Pharmacy, Inc.* to Rexam Cosmetic Packaging, Inc., Subpoena in a Civil Case, Case No. 03C 3137 N.D. Illinois, dated Nov. 11, 2003.
*RTC Industries, Inc.* v. *Fasteners for Retail Inc., and CVS Corporation*, Notice of Motion to Modify and Temporarily Quash Five Subpoenas for Violation of Federal Rule of Civil Procedure 45, Civil Action No. 03C 3137, dated Dec. 8, 2003.
*RTC Industries, Inc.* v. *Fasteners for Retail, Inc. and CVS Pharmacy, Inc.*, Defendants' Opposition to Plaintifrs Motion; to Modify and Temporarily Quash Five Subpoenas for Violation of Federal Rule of Civil Procedure 45, Case No. 03C; 3137, dated Dec. 10, 2003.

(56) References Cited

OTHER PUBLICATIONS

*RTC Ind. Inc*. v. *Fasteners for Retail*, Minute Order of Dec. 12, 2003 by Honorable Joan B. Gottschall, Case No. 1:03-cv-03137.
FFR Yellow pages, 2003 product Catalog, "Merchandising Ideas Made Easy for Every Retain Environment," dated 2003. pp. 1-14.
*RTC Industries, Inc*. v. *Fasteners for Retail, Inc., and Super Valu, Inc. d/b/a Cub Foods*, Complaint, dated Dec. 18, 2005; p. 1-25.
European Search Report for Application No. 14164097 dated Jun. 11, 2014, 6 pages.
Jul. 10, 2015—(PCT) International Search Report—PCT/US2015/024482.
Oct. 5, 2016—(WO) International Search Report and Written Opinion—App. PCT/US2016/042580.
Aug. 24, 2016—(AU) Patent Examination Report—App 2016200607.
Oct. 18, 2016—(EP) Examination Report—App. 10838083.
Apr. 5, 2016—(CN) Office Action—App 201280053272.7.
May 30, 2016—(CN) Office Action—App 201280053387.
Feb. 26, 2016—(CA) Office Action—App. 2847521.
Feb. 9, 2016—(AU) Office Action—App. 2014228865.
Apr. 19, 2016—(EU) Examination Report—App 15172675.
Sep. 28, 2015—(EP) European Search Report—App EP15172675.9.
Mar. 22, 2016—(PCT) International Search Report and Written Opinion—App PCT/US2015/067494.
*RTC Industries, Inc*. v. *Fasteners for Retail Inc., and CVS Pharmacy, Inc*. to Rexam Cosmetic Packaging, Inc., in a Civil Case, Case No. 03C 3137 N.D. Illinois, dated Nov. 11, 2003.
*RTC Industries, Inc*. v. *Fasteners for Retail Inc., and CVS Corporation*, Notice of Motion to Modify and Temporarily Five Subpoenas for Violation of Federal Rule of Civil Procedure 45, Civil Action No. 03C 3137, dated Dec. 8, 2003.

* cited by examiner

FIG. 26
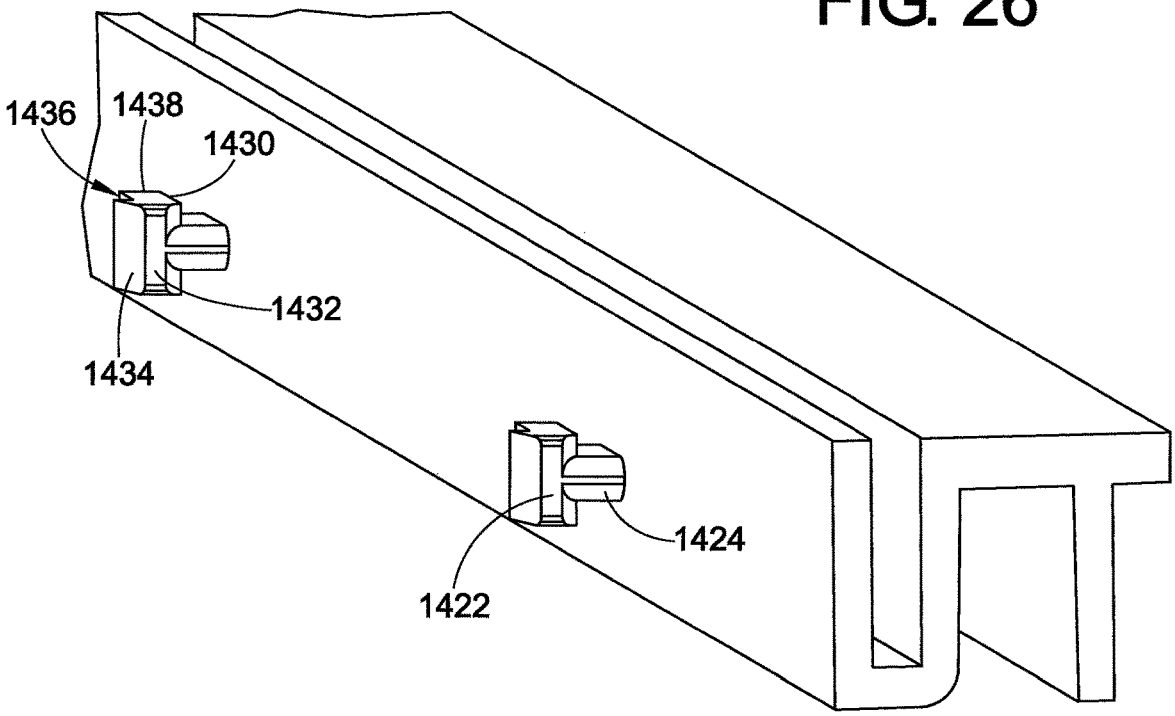
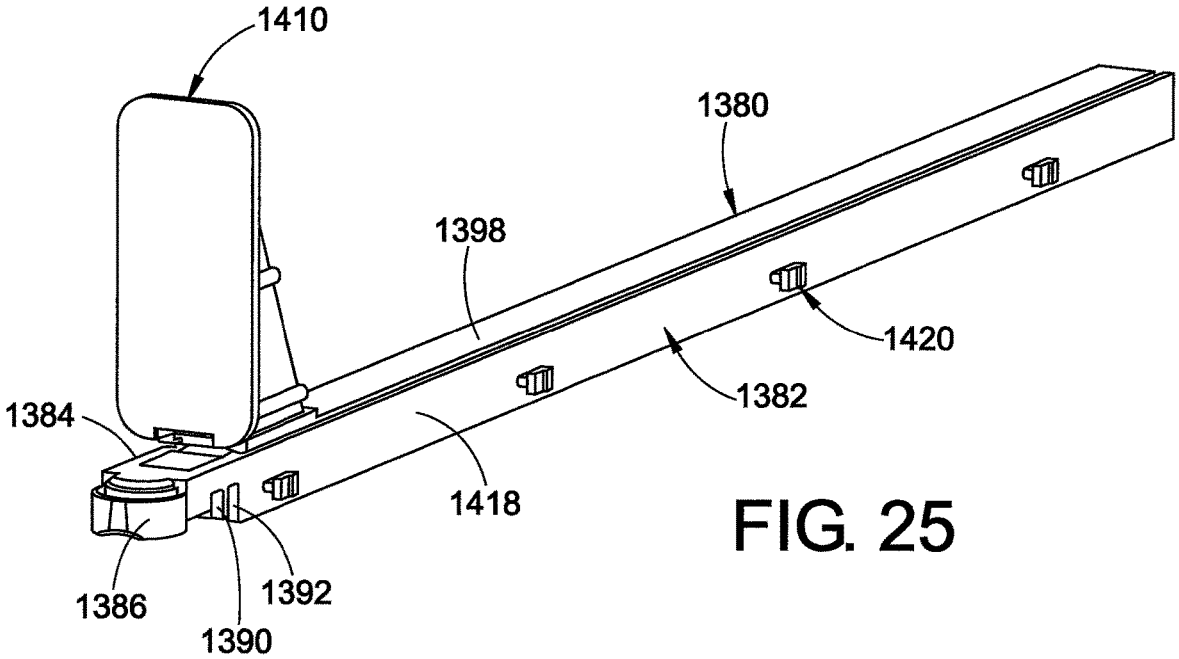
FIG. 25

DIVIDER WITH SELECTIVELY SECURABLE TRACK ASSEMBLY

This application is a continuation application of, and claims priority under 35 U.S.C. § 120 from, U.S. application Ser. No. 16/780,677, filed on Feb. 3, 2020, which is a divisional application of U.S. application Ser. No. 15/940,167, filed on Mar. 29, 2018, which is a divisional application of U.S. application Ser. No. 15/141,151, filed on Apr. 28, 2016, now U.S. Pat. No. 10,172,481, which is a continuation-in-part of U.S. application Ser. No. 15/076,329, filed on Mar. 21, 2016, now U.S. Pat. No. 9,770,121, which claims the benefit of U.S. Provisional Application No. 62/144,672, filed on Apr. 8, 2015, and U.S. Provisional Application No. 62/188,221, filed on Jul. 2, 2015. The disclosures of these prior applications are considered part of the disclosure of this application and are hereby incorporated by reference in their entireties.

BACKGROUND

The present disclosure relates to a merchandising system. More specifically, the disclosure relates to a merchandising system for forward feeding products having a variety of shapes and sizes and automatically delivering such products to the front of a shelf. The disclosure pertains particularly to a track assembly that can be selectively secured to a divider construction.

Shelving is used extensively for stocking and storing products or merchandise in a variety of stores, such as grocery stores, drug stores and mass merchandisers, such as Wal-Mart, Kmart and the like. Most consumer product stores contain fixed shelving which is arranged back to back between aisle ways with the merchandise being stocked on such shelving. It is desirable for the merchandise to be displayed at the front edge of a shelf so that customers can see the merchandise and be induced to purchase the merchandise. In such stores, if the shelves are not positioned at eye level, it is difficult for the customer to see the items being displayed if such items are not located adjacent the front edge of the shelf. Also, fixed shelves make it difficult to rotate product, i.e., move the older stock to the front of the shelf and position the newer stock behind the older stock. Rotating products is an important consideration if the goods are perishable or subject to becoming stale (such as cigarettes, fruit juices, dairy products and the like). It is important for such articles that they be removed following a first in, first out system in order to maintain freshness. Forward feed devices are employed by merchants to automatically move an item forward on a shelf, as the item before it in a column of merchandise is removed from the shelf.

Such forward feed devices generally fall into three categories. The first category pertains to inclined tracks which rely on gravity to feed, slide or roll products forward on the shelf. Gravity feeding, however may be unpredictable in that various materials or packages slide more easily than others because of different weights and frictional interfaces between the products and the track. The second category employs conveyor belts which still use gravity to effect forward movement. These devices are typically cumbersome, expensive and complicated due to the need to properly tension the track and the conveyor belts. The third category uses spring biased pusher paddles to feed product forward on the shelf. Such paddle-based forward feed devices have become very popular with merchants because they have been found useful for a variety of merchandise.

In the third category, separate dividers and tracks containing pusher paddles are usually employed along with end dividers to separate the merchandise into columns arrayed across the width of the shelf. Some have considered it advantageous to provide an integrated track and divider system because such an integrated track and divider makes assembly of the merchandising system on a shelf easier for store personnel because there are less components to handle. However, an integrated track and divider is disadvantageous from the perspective that the divider cannot be removed from the track should that become necessary. In some circumstances, such as for wide products, tracks which are separate from dividers, so called drop-in tracks, are advantageous so that two or more pusher paddles can urge a column of merchandise forward on the shelf. Currently, a separate drop-in track has to be produced for this purpose.

It would be advantageous to provide a two component track and divider assembly in which a track assembly can be selectively connected to or disconnected from a divider assembly. In other words, it would be desirable to provide a connection structure to selectively engage the track assembly with the divider assembly or disengage the track assembly from the divider assembly, as may be required in a particular merchandising environment. It would also be desirable to provide a track assembly which can either be secured to the divider assembly or spaced from the divider assembly and can be mounted on the front rail either separately or as joined together with the divider assembly.

It would also be desirable to selectively lock the divider assembly to the front rail in order to retard a sideward or lateral movement, of the divider assembly as product is being urged forward on the track assembly by the pusher assembly. In other words, it would be desirable to allow the divider assembly to selectively engage a front rail in such a y that the divider assembly is allowed to move sideways or laterally in relation to the front rail when deemed necessary, but is otherwise retarded from such lateral movement along the length of the front rail. At the same time, it would be desirable to provide an automatic locking feature, so that the divider assembly is automatically locked against the front rail, unless a tab or the like is manually actuated to unlock the divider assembly from the front rail. Ideally, the divider assembly should be movable in the lateral direction parallel to the front rail, while being secured in a direction perpendicular to the front rail when a locking member is disengaged. However, the divider assembly should resist movement in the lateral direction parallel to the front rail and should remain secured in a direction perpendicular to the front rail when the locking member is engaged.

Moreover, it would be desirable to provide a track assembly which, when separately mounted on the front rail would resist movement in a direction perpendicular to the front rail and allow limited movement in a lateral direction along the length of the front rail once a frictional interface between the track assembly and the front rail has been overcome. Put another way, it would be desirable to allow a track assembly to be selectively mounted on the front rail in such a way that it is disconnected from the divider assembly and is inhibited from lateral movement. However, such movement would be allowed once a frictional resistance between the track and the front rail had been overcome.

BRIEF SUMMARY OF THE DISCLOSURE

In accordance with one embodiment of the present disclosure, a merchandising system comprises an elongated mounting member, a first cooperating ember and a second cooperating member. The first cooperating member includes a first engagement structure for engaging the mounting member in order to retard a movement of the first cooperating member relative to the mounting member in at least one direction. The second cooperating member includes a second engagement structure for engaging the mounting member to retard a movement of the second cooperating member relative to the mounting member in at least one direction. A third engagement structure is provided for selectively connecting the first cooperating member to the second cooperating member, wherein the first cooperating member and the second cooperating member are selectively independently mountable to the mounting member and are selectively attachable is each other and mountable as a combined structure to the mounting member.

In accordance with another embodiment of the present disclosure, a merchandising system comprises an elongated mounting member including a wall, and a first cooperating member including a front end that is adapted to be received on the mounting member and adapted to selectively engage the wall thereof. A first engagement structure is mounted to the first cooperating member and includes a resilient member which is adapted to bias the first engagement structure into engagement with the mounting member wall so as to retard a lateral movement of the first cooperating r ember in relation to the mounting member. A second cooperating member includes a second engagement structure for selectively engaging the second cooperating member with the elongated mounting member wall. A third engagement structure is adapted to selectively connect the first cooperating member with the second cooperating member.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein:

FIG. 25 is a front perspective view of a track assembly which can be selectively connected to the divider assembly of FIG. 24;

FIG. 26 is a greatly enlarged fragmentary rear perspective view of the track assembly of FIG. 25;

DETAILED DESCRIPTION

Figure 1:
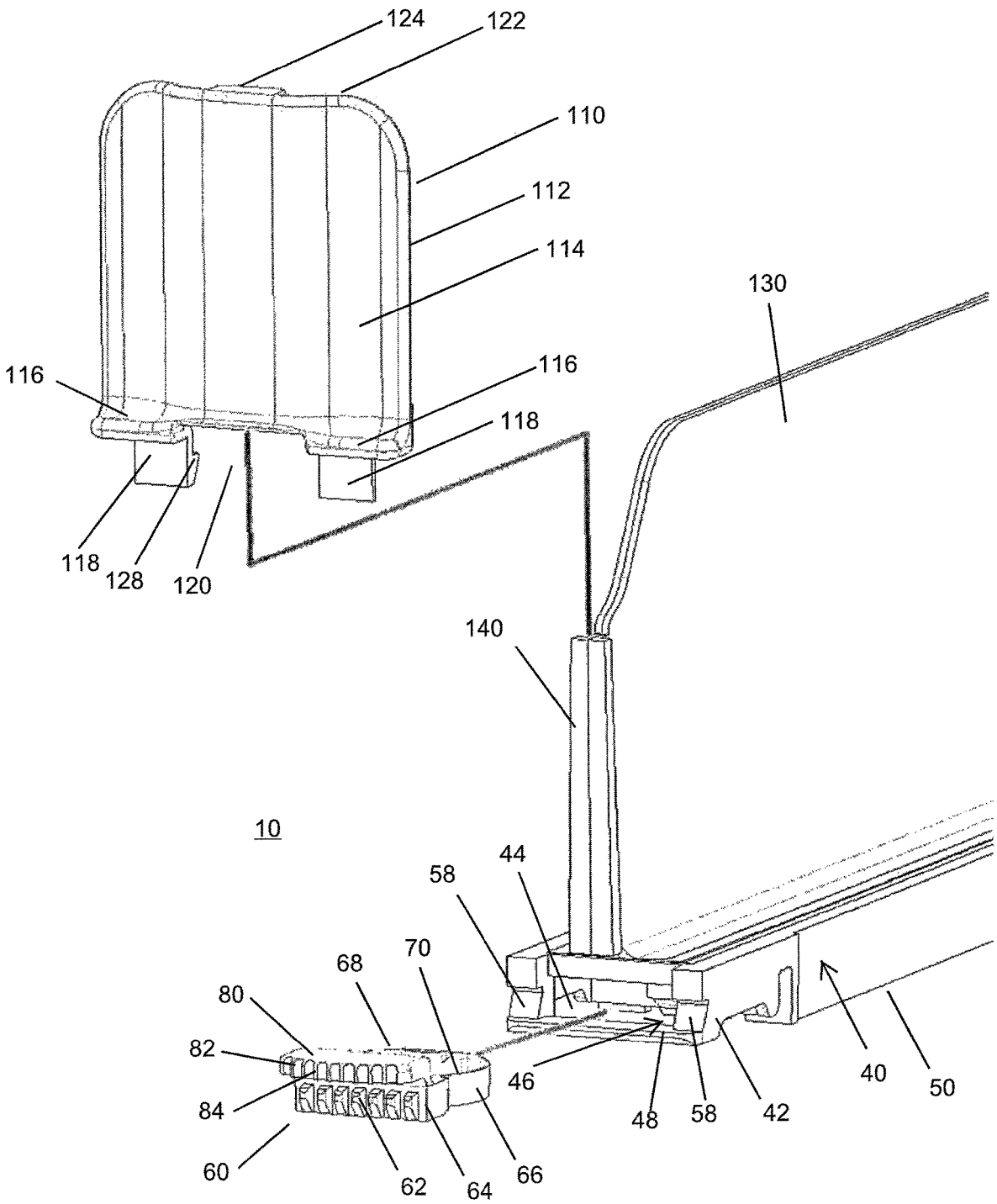
FIG. 1 is an exploded perspective view of a base and divider assembly of a merchandising system which constitutes one embodiment of a cooperating member according to one embodiment of the present disclosure, showing an elongated base and divider, a lock and a front wall.
Figure 2:
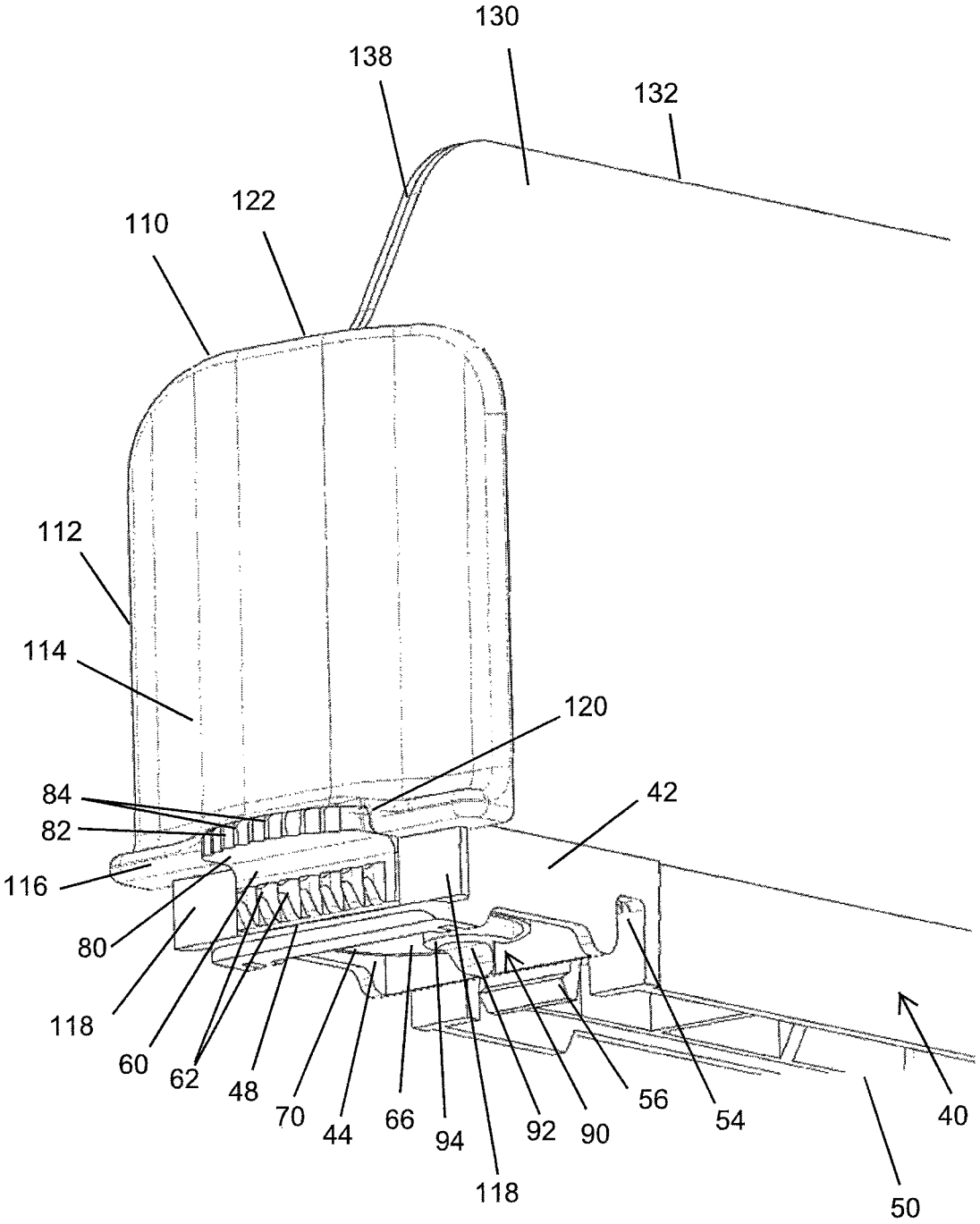
FIG. 2 is an assembled perspective view of the cooperating member of FIG. 1.

Referring now to the drawings wherein the showings are for purposes of illustrating several embodiments of the disclosure only, FIG. 1 shows a merchandising system 10 which includes a cooperating member 40 comprising a base 50. A divider 130 can be either selectively or permanently mounted on or secured to the base 50. The cooperating member 40 includes a front end 42 in which a slot 46 is defined. The slot 46 provides access to a chamber 44 defined in the base 50. As best seen in FIG. 2, located behind the chamber 44 is a groove 54 defined in the base 50. The groove 54 which is defined in the walls of the base 50 can comprise an engaging element or member. At least a portion of groove 54 can be defined by at least one resilient tab member 58.

A lock 60 can be received in the slot 46 and selectively mounted within the chamber 44. At least one body 58 borders the slot 46 and retards the lock 60 from moving laterally in relation to the base 50. Also, a wall 48 can extend beneath the slot 46. In one embodiment, the lock 60 includes at least one tooth 62 located at a first or front end 64 thereof. Alternatively, a plurality of spaced teeth 62 can be provided on the first end 64. A resilient biasing member 66 is located at a second or rear end 68 of the lock 60. The resilient member 66 can comprise a generally ring-shaped element 70. The element 70 is resilient due to the resilient nature of the material from which the lock 60 is made, such as a known thermoplastic. A tab or plateau-like portion 80 can also be defined on the first end 64 of the lock. Tab 80 includes a front face 82 adapted for manual contact by digits of users such as store personnel. Defined in the front face 82 are a plurality of spaced ridges 84 which can aid in pushing the tab 80 during manual contact thereof. As is evident from FIGS. 3A, 3B, and 7, cooperating member 40 with lock 60 can be received on an elongated mounting member 20, sometimes termed a front rail. Cooperating member 40 is oriented in a direction generally transverse to a longitudinal axis of the elongated mounting member 20.

It should be appreciated that while particular designs of teeth 24 and 62 are illustrated, any suitable types of engaging elements can be employed for this purpose. In other words, differently shaped teeth can be provided. In the embodiments illustrated, the teeth are shown as generally being trapezoidal in shape. If so desired, the shapes of the teeth can be rounded, or teeth 62 can be rounded while teeth 24 can have a different shape, such as a trapezoid or a rectangle.

Figure 7:
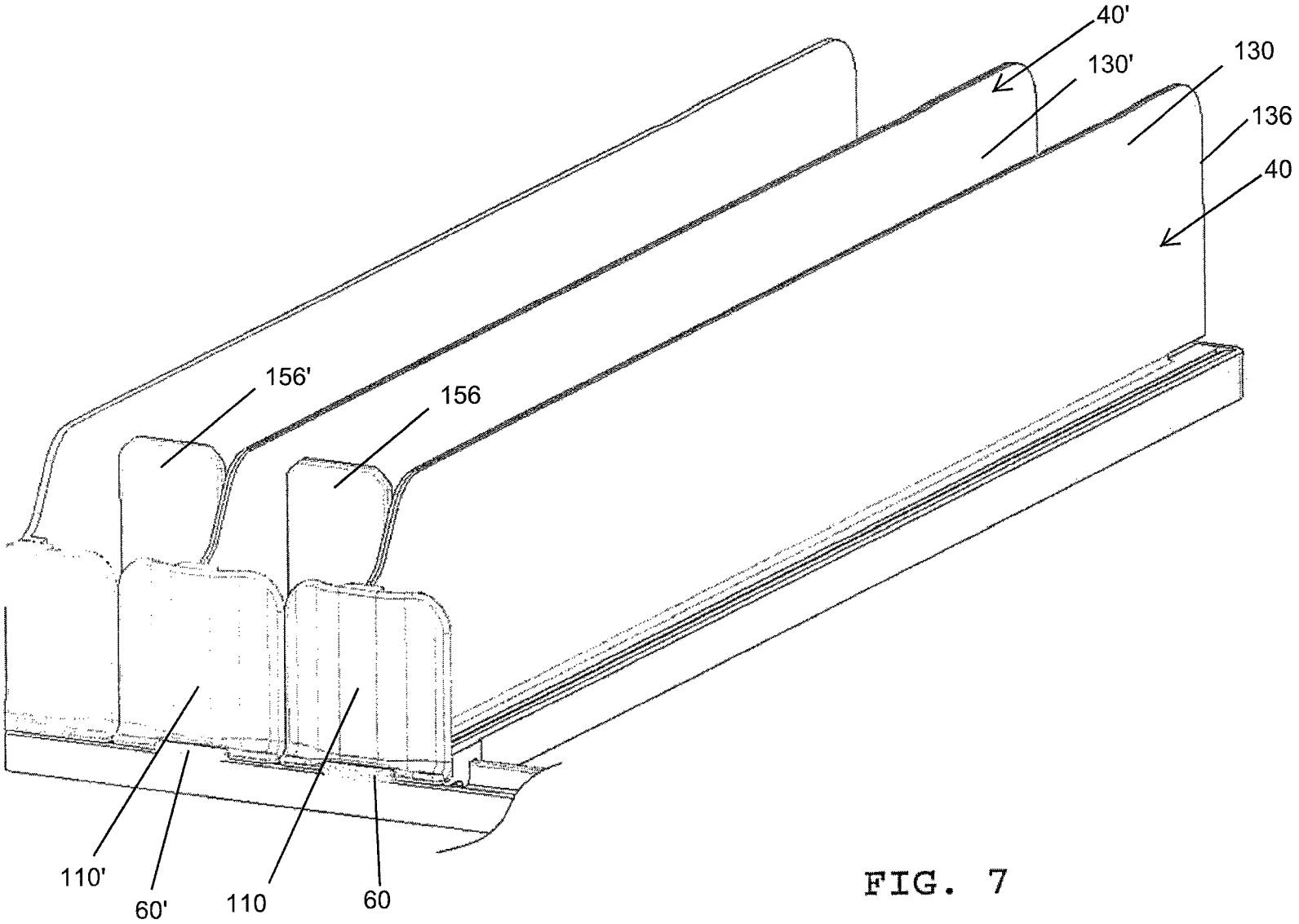
FIG. 7 is a reduced perspective view of the merchandising system according to FIGS. 3A and 3B including several cooperating members located in a side by wide relationship as they would be when mounted on a subjacent shelf (not shown) with an elongated mounting member, and illustrating the use of a track positioned between two cooperating members.

Referring again to FIG. 2, in one embodiment the divider 130 can comprise a top portion 132 and a front portion 138. With reference now also to FIG. 7, the divider 130 also comprises a rear portion 136. In one embodiment, a locking feature can be provided for selectively securing the divider 130 to the base 50. Further information concerning the locking feature can be found in U.S. Pat. No. 8,752,717 issued on Jun. 17, 2014, the subject matter of that patent is incorporated hereinto by reference in its entirety. It should be appreciated that there are also other types of connecting structures which can selectively connect a base and a divider to each other, but which allow the base to be separated from the divider when the divider is not needed. Due to the resiliency of the thermoplastic material from which at least one of the divider 130 and the base 50 are made, the divider can be selectively separated from the base and be selectively connected thereto any desired number of times within reason. If desired, a snap fit can be provided between the base 50 and the divider 130. Alternatively, the divider 130 and base 50 can be of one piece.

Figure 8:
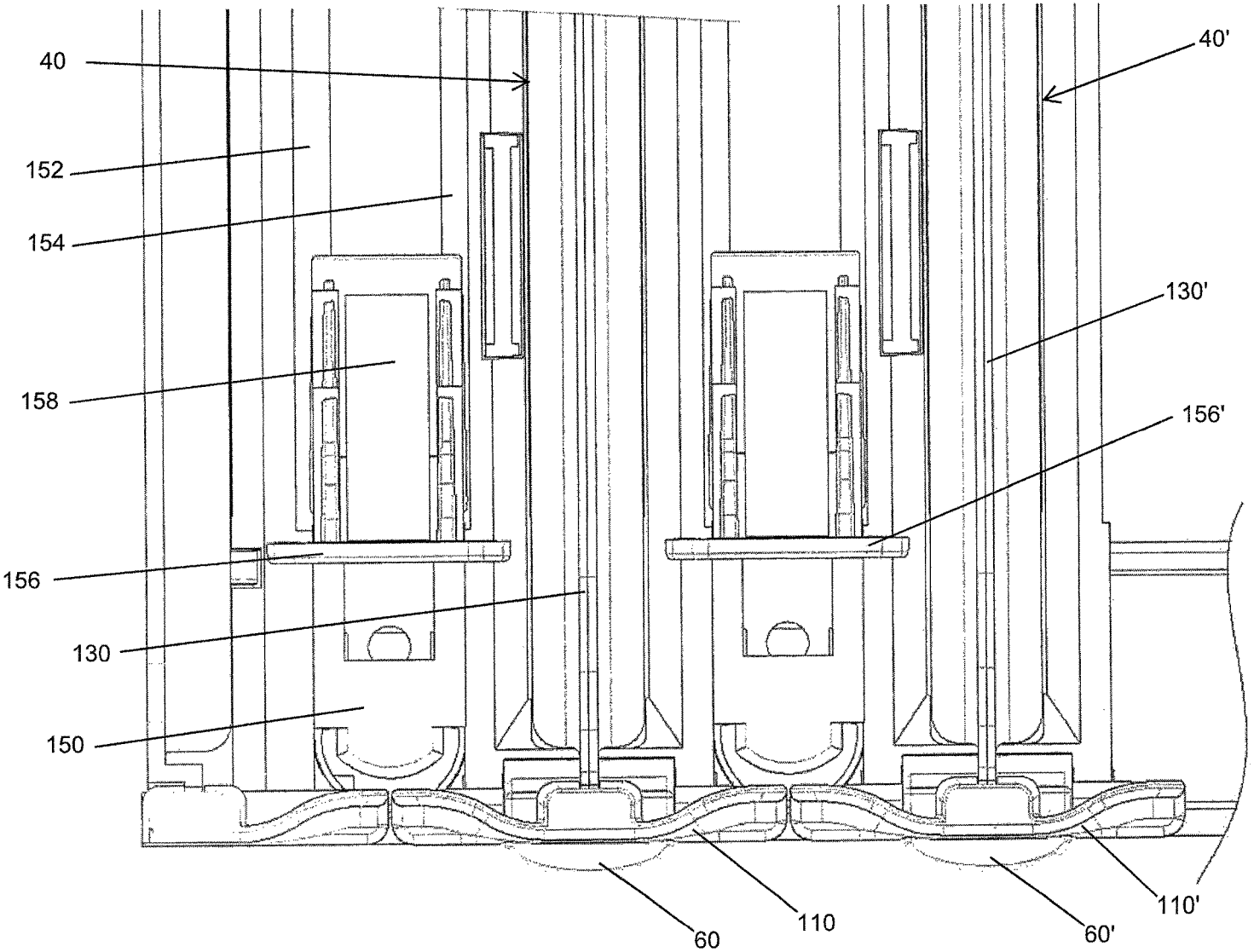
FIG. 8 is an enlarged top plan view of the merchandising system of FIG. 7.

While one embodiment of a cooperating member 40 is illustrated in FIG. 1, namely a divider, it should be appreciated that the cooperating member could, instead be a free-standing pusher track, such as track 150 illustrated in FIGS. 7 and 8. Alternatively, a combination track and divider assembly could be provided.

With reference now to FIG. 8, located on a top surface of the cooperating member or track 150 can be first and second spaced rails 152 and 154. These slidably accommodate a pusher 158 which is mounted on the rails. The pusher 156 can be urged forwardly on the rails by a coil spring 158 or like biasing member. The operation of a coil spring for urging a pusher assembly forward on a track is well known in the art.

Figure 9:
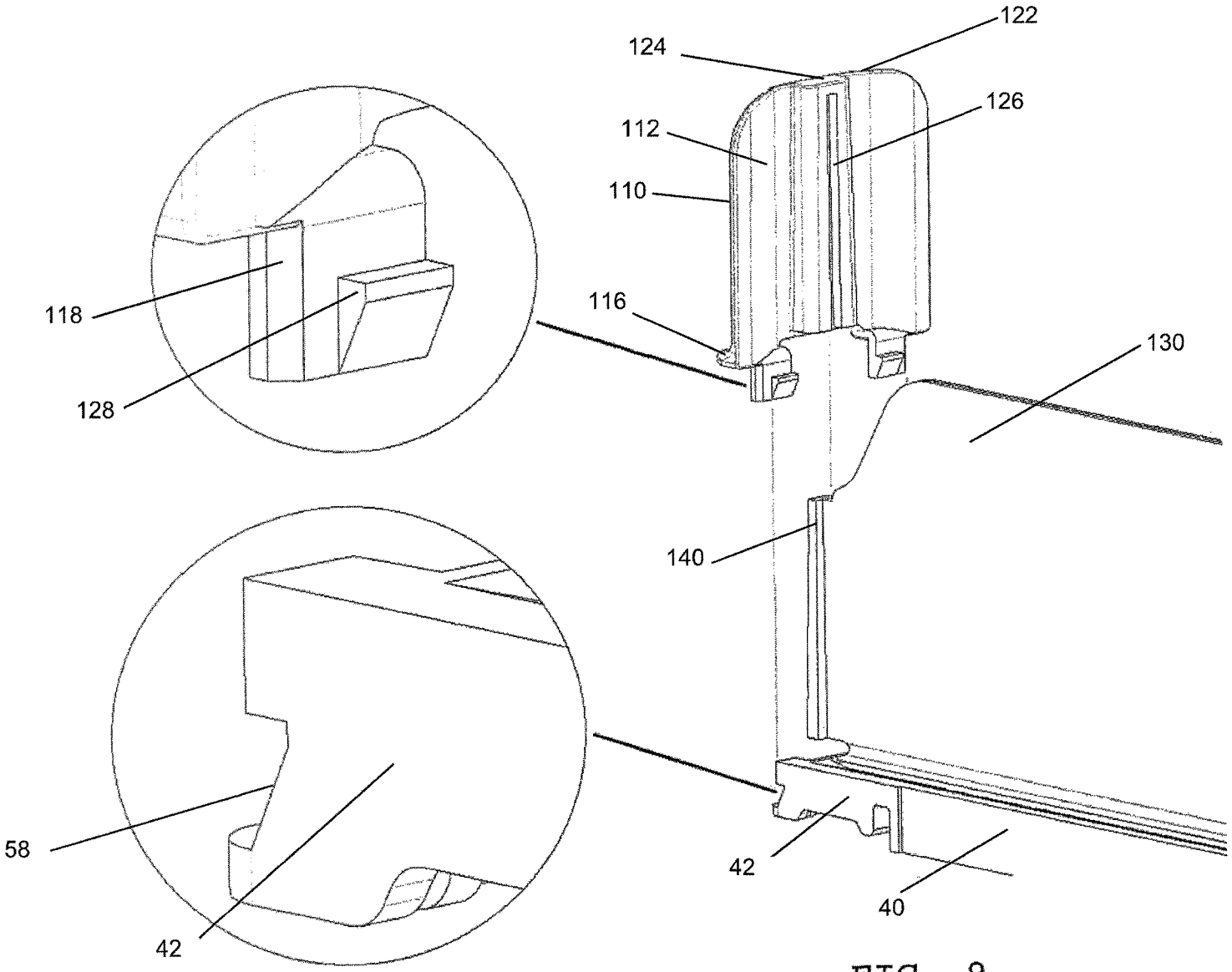
FIG. 9 is an exploded perspective view of a base and divider assembly of a merchandising system showing the engaging element for locking a front wall to the cooperating member of the present disclosure.

With reference once more to FIG. 1, defined on the front portion 138 of the divider 130 is a first engaging portion which can be in the form of a flange or shoulder section 140. Shoulder section 140 can accommodate a front wall 110 which is oriented generally transverse to the longitudinal axis of the divider 130, as is evident from FIG. 7. The front wall 110 can be in the form of a laterally extending support section or body 112. Defined on a rear face of the front wall 110 is housing 124. A vertically oriented slot 126 can extend in the housing, as best shown in FIG. 9. The slot 126 can be located approximately equidistant between the two side edges of front wall, if so desired. The walls of the housing 124 defining the slot 126 can be considered a second engaging portion, which cooperates with the first engaging portion.

As is evident from FIG. 9, the slot 128 in the housing 124 accommodates the shoulder section 140 of the divider 130. The body 112 of front wall 110 extends laterally in relation to the housing 124. The purpose of the front wall 110 is to provide a retarding wall which can be employed to retard a forward most one of a column of merchandise from falling over the mounting member 20 and off the subjacent shelf. Front squall 110 can also be made from a suitable known plastic material which is transparent, so that the merchandise abutted by the front wall can be seen. It should be appreciated that in order to form the front wall, it can be molded from the suitable known transparent plastic material so that the front wall is of one piece.

With reference to FIG. 2, the body 112 of front wall 110 can be generally planar and comprises a front face 114 from which extends a gripping portion or handle 116 as well as an engaging element or protrusion 118 for locking the front wall to the cooperating member 40. The handle 116 includes a recess 120 for cooperating with the front end 42 of cooperating member 40 to further define slot 46. In one embodiment, the protrusion 18 is spaced from the handle 116, with the protrusion being located beneath the handle. With reference now to FIG. 9, in this regard, front end 42 of cooperating member 40 includes at least one body 58 which can comprise a seat portion for receiving the protrusion 128.

In the orientation illustrated in FIG. 9, the protrusion 118 of the front wall 110 can include a ledge 128 having a sloped portion which contacts the front end 42 of the cooperating member. The sloped portion of ledge 125 urges the protrusion 118 forwardly as it comes into contact with the front end 42 during, for example, a linear downward sliding movement of the front wall 110. Upon further linear downward motion of the front wall 110, the ledge 12 is allowed to retract or snap into the seat portion 58 of the front end of cooperating member. The retraction of the ledge 128 into the seat portion 58 provides a locking engagement of the front wall 110 with the cooperating member 40.

All of the components of the merchandising system, namely, the mounting member 20, cooperating member 40, lock 60, and front wall 110, can be made from suitable known materials such as a variety of known somewhat resilient or flexible thermoplastics although other resilient materials could also be used.

The limits of movement of the front wall 110 can be regulated by the ledge 128 and how it interacts with the front end 42 of the cooperating member. More particularly, the condition or position of the merchandising system illustrated in FIG. 2, front wall 110 is fully engaged with the cooperating member 40 and the ledge 128 fits in the seat portion 58. Further downward movement of the front wall 110 past this position is, thus, prevented or at least retarded.

With reference now again to FIG. 2, cooperating member 40, lock 60, front wall 110, and divider 130 are shown in assembled condition. Lock 60 is shown as being selectively mounted within chamber 40 with tab 80 extending forward from both the slot 46 and the recess 120 of front wall 110. The recess 120 additionally provides access to the tab 80 from the handle 116.

Figure 4A:
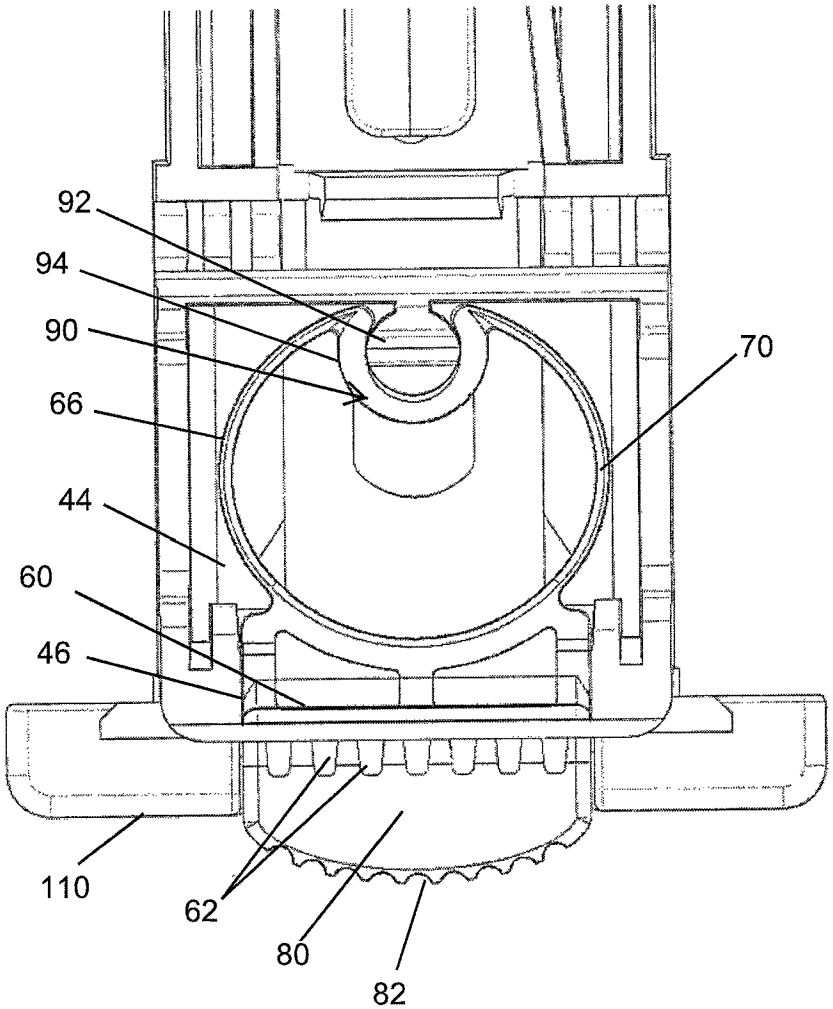
FIG. 4A is a bottom plan view of the cooperating member of FIG. 3A when the lock is in an engaged condition.
Figure 4B:
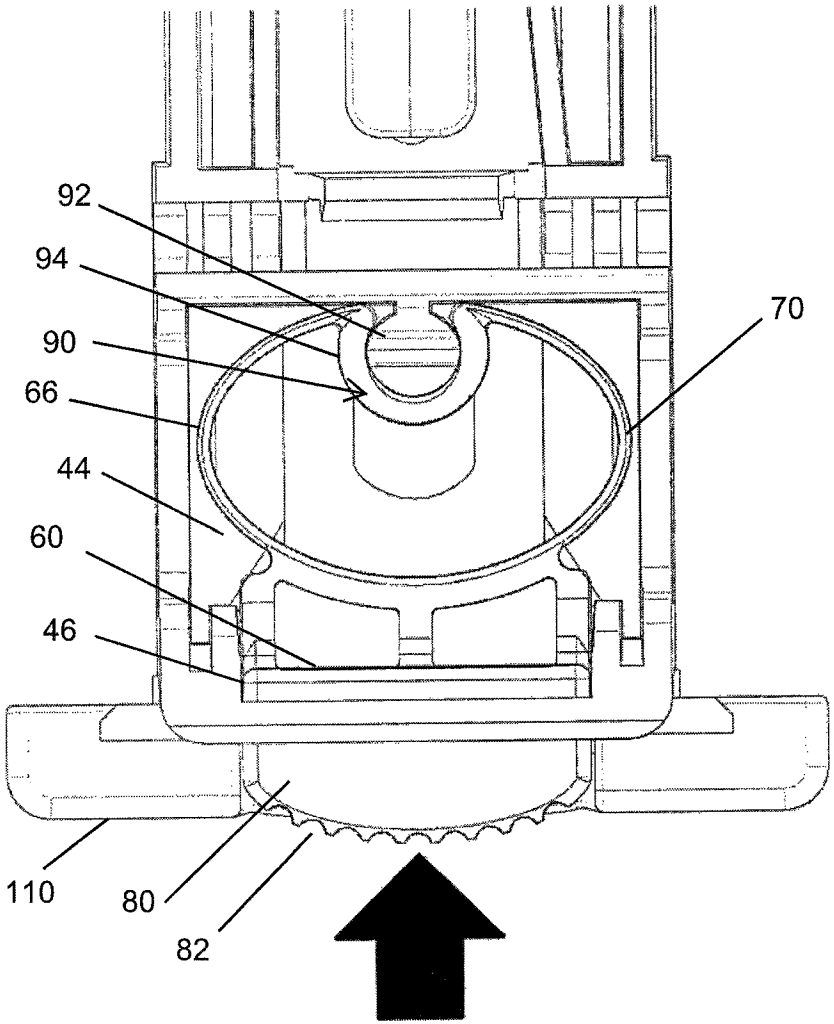
FIG. 4B is a bottom plan view of the cooperating member of FIG. 3B when the lock is in a disengaged condition.
Figure 6:
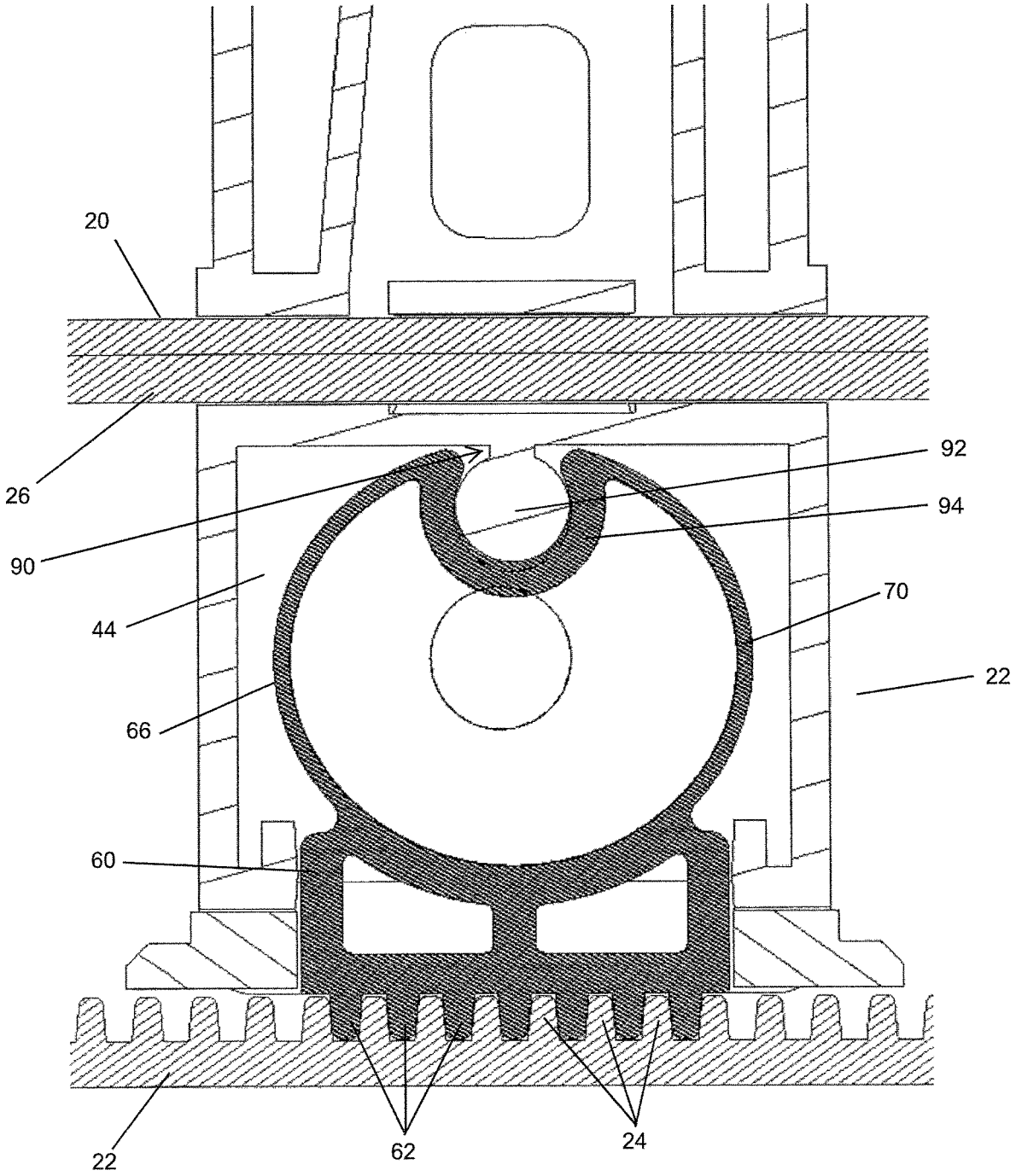
FIG. 6 is an enlarged cross-sectional bottom plan view of the cooperating member and the lock of FIG. 3A when the lock is in an engaged condition.

In one embodiment, a connection system 90 is provided for connecting the lock 60 to the cooperating member 40. As shown in FIGS. 4A and 4B, connection system 90 can include protrusion 92 extending downwardly from the body of the base 50 such that it is located in the chamber 44 defined in the cooperating member 40. A clip 94 can be provided on the second end 68 of lock 60. With reference now also to FIG. 6, in one embodiment the clip 94 can be defined within the resilient ring-shaped element 70 of the lock. The clip 94 selectively mounts to the protrusion 92 in order to hold the lock 60 in the slot 46 of the cooperating member 40.

Figure 5:
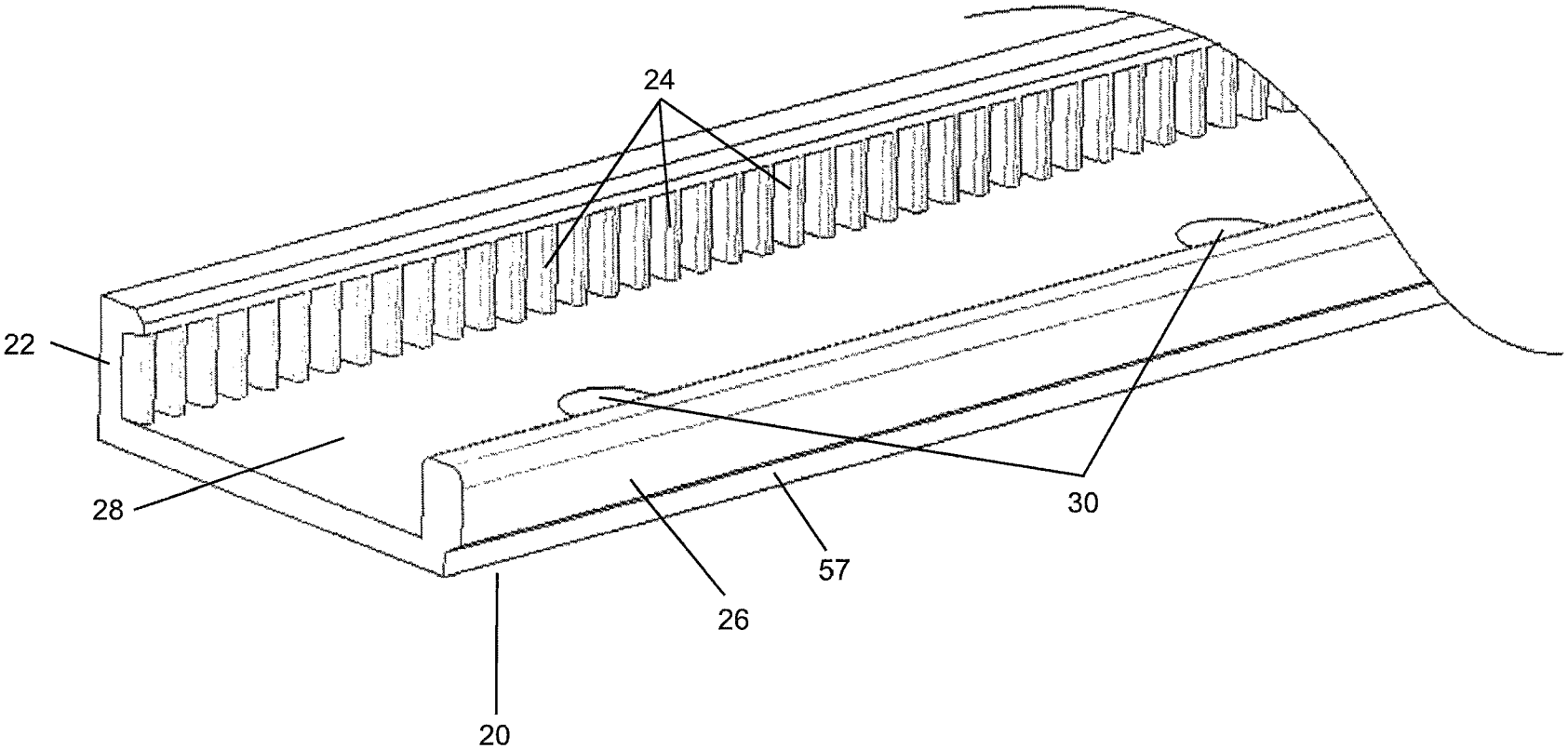
FIG. 5 is an enlarged perspective view of a portion of the mounting member of FIGS. 3A and 3B.

With reference now to FIG. 5, the elongated mounting member or front rail 20 includes a vertically oriented front wall 22, a back wall 26, and a channel 26 defined between the front wall and the back wall. It should be appreciated from FIGS. 3A and 3D, for example, that the back wall 26 of the elongated mounting member or front rail 20 protrudes into the groove 54 defined in the base 50 of the cooperating member 40 when the cooperating member is mounted to the mounting member. Thus, the back wall 26 defines a first engaging member and the slot 56 defines a second engaging member, such that when the first and second engaging members are engaged with each other, a movement of the cooperating member in a direction perpendicular to a longitudinal axis of the mounting member in the plane of such longitudinal axis is retarded, if not entirely prevented.

A suitable conventional fastener (not illustrated) can extend through at least one opening 30 so as to secure the mounting member in place on a subjacent shelf (not illustrated). Such a construction is shown in U.S. Pat. No. 7,216,770 which is dated May 15, 2007. That patent is incorporated herein by reference, in its entirety. Moreover, reference is made to U.S. Pat. No. 8,177,076 which is dated May 15, 2012 for its disclosure of various embodiments of a merchandising assembly. That patent is also incorporated herein by reference, in its entirety. As shown in FIGS. 3A and 5, the tab member 56 engages a groove 57 defined in the rear wall 26 of the mounting member 20.

Defined on a rear face of the front wall 22 of the mounting member 20 is at least one vertically oriented tooth 24. In one embodiment, a plurality of spaced teeth 24 can be provided. As shown in FIG. 3A, the front end 42 of cooperating member 40 is adapted to be received behind the front wall 22 of the mounting member 20. Thus, at least a portion of the front end 42 can be received in the channel 26 of the mounting member 20. As can further be seen from FIGS. 3A and 3B, when front end 42 is received in channel 26, the front wall 22 of the mounting member 20 extends in front of the slot 46 of cooperating member 40 and the back wall 26 is located inside the groove 54 of cooperating member. The chamber 44 is thus located between the front wall 22 and the back wall 26 and within channel 28. The at least one tooth 24 defined in the front wall 22 of the mounting member 20 engages the at least one tooth 62 of the lock 60 which is mounted within chamber 44. The at least one resilient tab portion 56 of groove 54 locks the back wall 26 of mounting member within the groove. If desired, a snap fit can be provided between the tab 56 and the back wall 26. The protrusion 80 mounted on lock 60 extends over the front wall 22 such that the front face 82 makes the lock accessible to store personnel from the front wall of the mounting member 20, as can be seen in FIG. 7.

With particular reference to FIG. 3A, the resilient member 66 of lock 60, which can also be termed a third engaging member, is naturally adapted to bias the lock forwardly in chamber 44. This natural bias causes the at least one tooth 62 of the lock 60 to enter grooves defined between the spaced teeth 24 of the mounting member or front rail 20 and come into engagement with a side wall of the at least one tooth 24 of the mounting member. In the embodiment shown, the natural bias causes the plurality of spaced teeth 62 of the lock 60 to come into engagement with the plurality of spaced teeth 24 of the mounting member 20, as best shown in FIG. 6. In the condition or position of the merchandising system illustrated in FIG. 3A, the cooperating member 40 is retarded from, and preferably prevented from, movement laterally in relation to the mounting member 20.

It should be appreciated that the resilient member 66 allows the lock 60 to be resiliently biased into contact with the front wall teeth 24, due to the inherent resilient nature of the thermoplastic material from which the lock can be made. However, it should be appreciated that the lock could also be made from other suitable materials, such as various metals or the like. It should thus be appreciated that the lock could be made from a different material than the cooperating member or the mounting member. In addition, various sections of the lock could be made from different materials, if so desired. For example, the resilient member 66 could be made from a more resilient material than the tab 80.

Figure 3B:
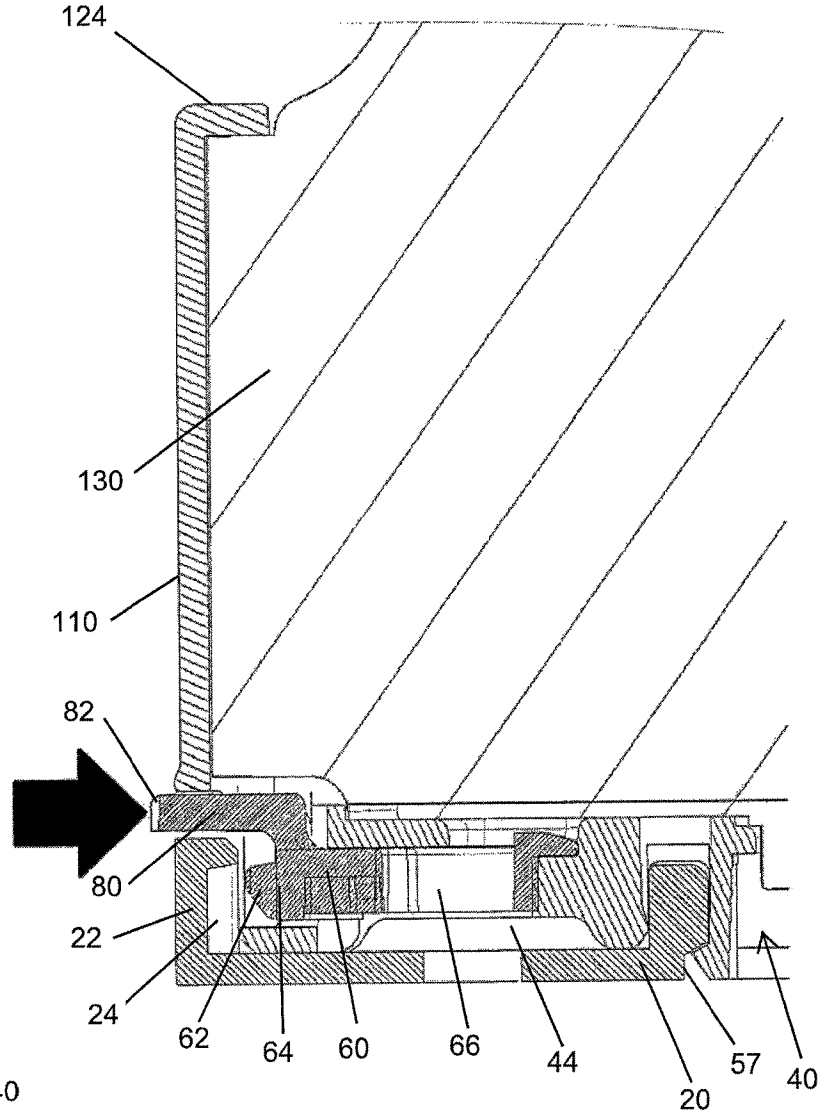
FIG. 3B is an assembled view of the merchandising system of FIG. 3A illustrating permissible movement of the lock in relation to the mounting member when it is desired that the lock be in a disengaged condition such that the resilient member is compressed.
Figure 3A:
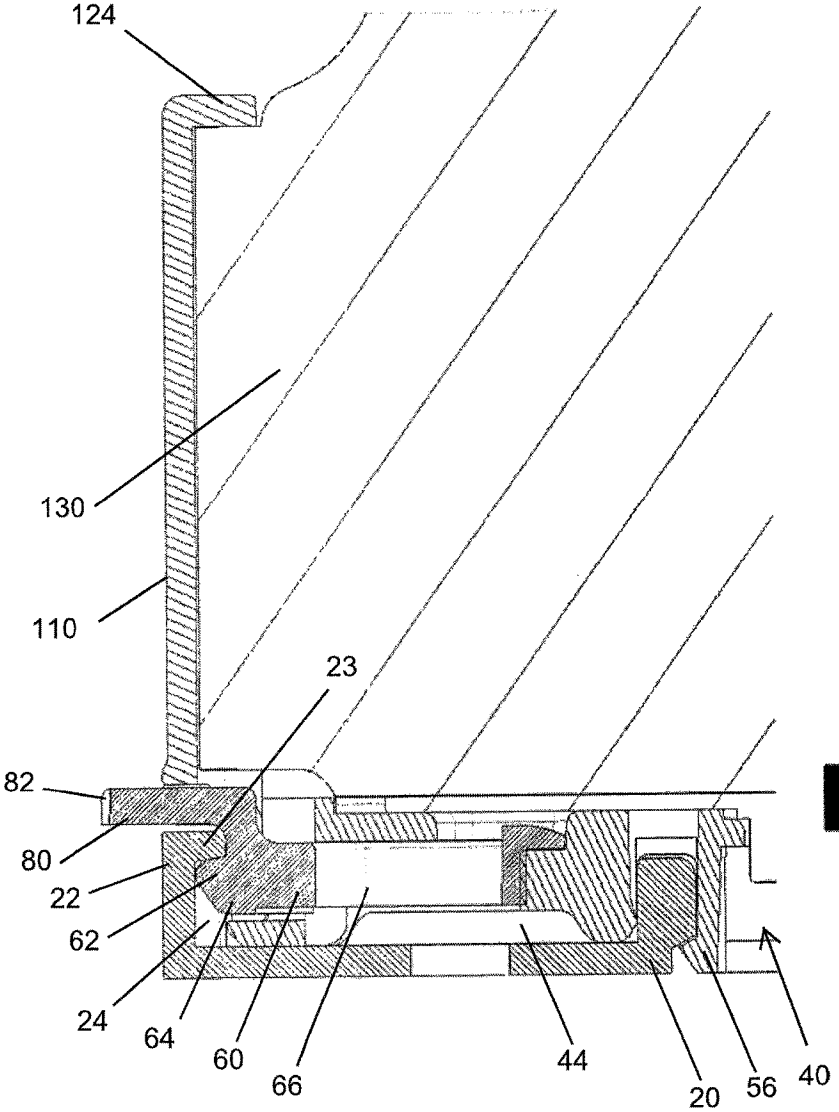
FIG. 3A is an enlarged cross-sectional side view of the cooperating member of FIG. 2 mounted on a mounting member and illustrating an engaged condition of the lock with the mounting member when a resilient member of the lock is in its natural biasing position.

With reference now to FIG. 3B, the tab 80 of lock 60 is shown as being urged in a direction counter to the natural bias of the resilient member 66, as indicated by the arrow. A finger or digit of store personnel pushing on the tab can accomplish this action. It should be appreciated that the movement of the lock 60 is a linear movement. More particularly, the lock is slid rearwardly away from the mounting member and in a direction which is axially aligned with the longitudinal axis, of the cooperating member. This counter bias causes the at least one tooth 62 of the lock 60 to disengage from the at least one tooth 24 of the mounting member 20 such that the first end 64 of the lock is spaced away from the front wall 22 of the mounting member. Once this is done, the plurality of spaced teeth 62 of the lock 60 disengage from the plurality of spaced teeth 24 of the mounting member 20 such that the first end 64 of the lock is spaced away from the front wall 22 of the mounting member.

In the condition or position of the merchandising system illustrated in FIG. 3B, the cooperating member 40 is allowed to move laterally, such as via a sliding motion, in relation to the mounting member 20. However, when the tab 80 of lock 60 is no longer being contacted, as shown in FIG. 3A, the resilient member 66 automatically biases the at least one tooth or teeth 62 of the lock to re-engage the at least one tooth or teeth 24 of the mounting member. Thus, any further lateral or sideways movement of the cooperating member in relation to the mounting member is prevented or at least retarded. The locking engagement of the plurality of spaced teeth 62 of lock 60 with the plurality of spaced teeth 24 of mounting member 20 is best shown in FIG. 6.

The cooperating member is allowed to slide laterally in relation to the mounting member in the condition or position of the merchandising system illustrated in FIG. 3B. However, the engagement of the cooperating member with the mounting member, via the resilient tab member 56 of groove 54 accommodating the back wall 26 of mounting member 20, retards the cooperating member from moving in a direction perpendicular to the counting member regardless of whether lateral movement is permitted. Thus, the cooperating member is retarded from a movement perpendicular to the longitudinal axis of the mounting member, both in a direction rearwardly on the shelf away from the mounting member and in a direction upwardly away from the shelf and the mounting member, even when a lateral movement is permitted for the cooperating member, that is, a movement parallel to the longitudinal axis of the mounting member.

However, when the one or more teeth 62 and 24 are disengaged, the cooperating member 40 can be lifted vertically away from the mounting member 20 and removed from the merchandising assembly by snapping the tooth or protrusion 56 out of groove 57. But, when the one or more teeth 62 and 24 are engaged, such vertical movement of the cooperating member 40 is retarded if not prevented by the engagement of the one or more teeth 62 with a flange 23 which extends rearwardly from the front wall 22 of the mounting member 20 and over the teeth 24, as can be seen from FIG. 3A.

The orientation illustrated in FIG. 4A corresponds to the condition or position of the merchandising system illustrated in FIG. 3A, however the mounting member 20 is not shown for simplicity. FIG. 4A shows the resilient member 66 in its natural bias. In other words, the resilient ring-shaped element 70 of resilient member 66 naturally biases the lock 60 forwardly in chamber 44. The front face 82 of tab 80 is shown as being easily accessible from the front wall 110. Connection system 90 includes the protrusion 92 positioned rearward in the chamber 44. A clip 94, located on the resilient member or ring-shaped element 70, enables the lock 60 to be selectively mounted on the protrusion 92 extending into the chamber 44. In other words, the lock 60 can be detached from the cooperating member 40 when so desired. The clip 94 also acts to hold the lock 60 in the slot 46 of the cooperating member when tab 80 is urged in the counter bias direction, as is evident from FIG. 4B.

The orientation illustrated in FIG. 4B corresponds to the condition or position of the merchandising system illustrated in FIG. 3B. Again, mounting member 20 is not shown for simplicity. FIG. 4B shows the tab 80 of lock 60 as being urged in a direction counter to the natural bias of the resilient member 66, as indicated by the arrow. In this condition, the ring-shaped element 70 compresses against the bias of the resilient member 66 such that the lock 60 can be disengaged. The limits of movement or compression of the ring-shaped element 70 can be regulated by the size and shape of the chamber 44. More particularly, connection system 90 acts against the ring-shaped element 70 as it is urged rearward. In addition, the resilient member 66 fits within the chamber 44 and movement past the chamber is, thus, prevented or at least retarded.

As illustrated in FIGS. 7 and 8, a plurality of cooperating members 40 can be located on a shelf in a spaced side-by-side manner so as to allow multiple columns of merchandise to be urged forwardly on a shelf. Moreover, one or more tracks 150 can also be provided. It should be evident from FIG. 8, that cooperating members can include a type which comprises a base on which are defined rails for accommodating a pusher 156. On the other hand, cooperating members, such as at 40 can include types which only comprise a divider portion 130' and do not also include a track located on a base. Disposed between such cooperating members can be one or more tracks 150. In one embodiment, the tracks do not include a divider as disclosed herein, but merely include a pusher assembly 156. In the disclosed embodiment, the tracks do not have a front wall member of the type illustrated in FIGS. 1-4, nor do they have a lock member of the type illustrated in FIGS. 1-4, and 6. Of course, other embodiments of such tracks could include at least one of a front wall and/or a lock if so desired. On the other hand, cooperating member 40' does include such a front wall 110' and lock 60'.

Figure 10:
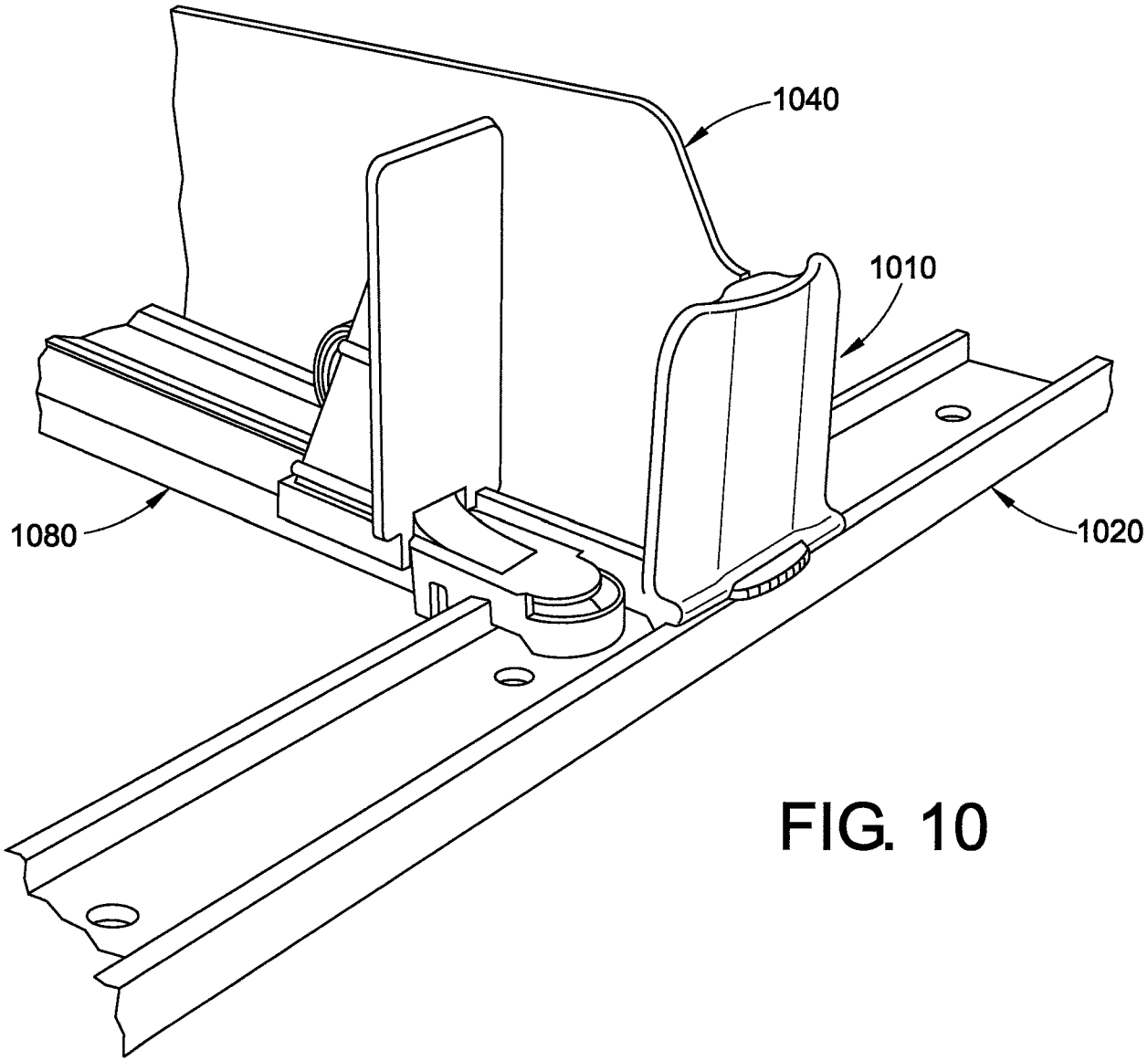
FIG. 10 is a front left perspective view of a merchandising system according to another embodiment of the present disclosure illustrating a mounting member and two cooperating members, with one of the cooperating members secured to the other of the cooperating members, and the combination being positioned on the mounting member.

According to another embodiment of the present disclosure, FIG. 10 shows a merchandising system 1010 comprising a mounting member 1020, a first cooperating member in the form of a divider assembly 1040 and a second cooperating member in the form of a track assembly 1080, such that the track assembly is mounted to the divider assembly and both are mounted on the mounting member. Both the divider assembly 1040 and the track assembly 1080 can be considered cooperating members because they can each cooperate with the mounting member. Either the divider assembly 1040 or the track assembly 1080 can be individually mounted on the mounting member 1020 or, as illustrated in FIG. 10, the track assembly can be connected to the divider assembly and the combined construction can then be mounted on the mounting member 1020.

Figure 11:
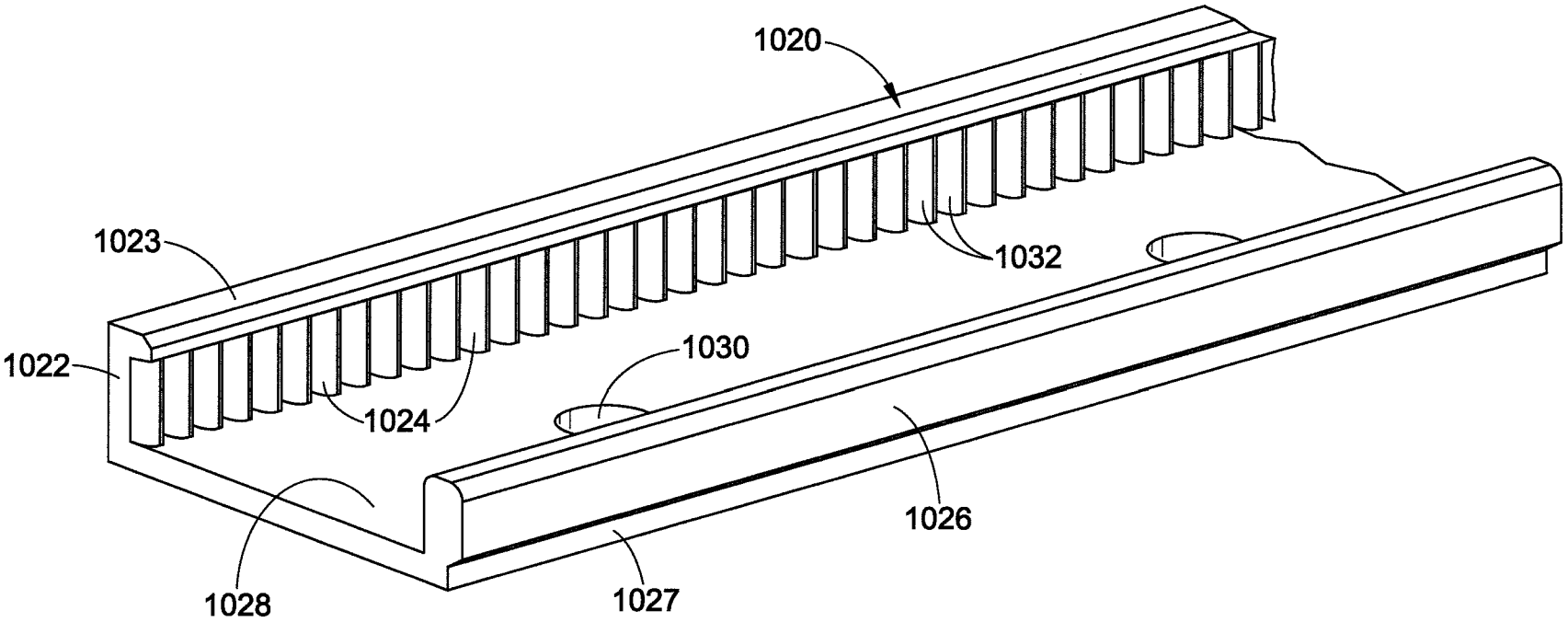
FIG. 11 is an enlarged perspective view of a portion of the mounting member of FIG. 10.

With reference now to FIG. 11, the mounting member in one embodiment comprises a front wall 1022 which has a rearwardly extending top flange 1023. Defined on a rear surface of the front wall 1022 are one or more vertically extending protrusions or teeth 1024. In one embodiment, the one or more teeth 1024 are located beneath the top flange 1023. Of course, other embodiments are also contemplated. Spaced from the front wall 1022 is a rear wall 1026. Defined on a rear face of the rear wall is a groove 1027. In the embodiment illustrated, the groove 1027 is located at the base of the rear wall 1026. Defined between the front wall 1022 and the rear wall 1026 is a channel 1028. The channel 1028, which can be generally U-shaped, is meant to accommodate the one or more cooperating members which can be mounted to the mounting member 1020. One or more apertures 1030 may be provided on the mounting member. Such apertures are sometimes desirable to allow the mounting member to be connected to a subjacent shelf (not illustrated) via a known connector (not illustrated). Such a construction is shown in U.S. Pat. No. 7,216,770 dated May 15, 2007. That patent is incorporated herein by reference in its entirety. Moreover, reference is made to U.S. Pat. No. 8,177,076 dated May 15, 2012 for its disclosure of various embodiments of a merchandising assembly. That patent also incorporated herein by reference in its entirety.

Figure 16:
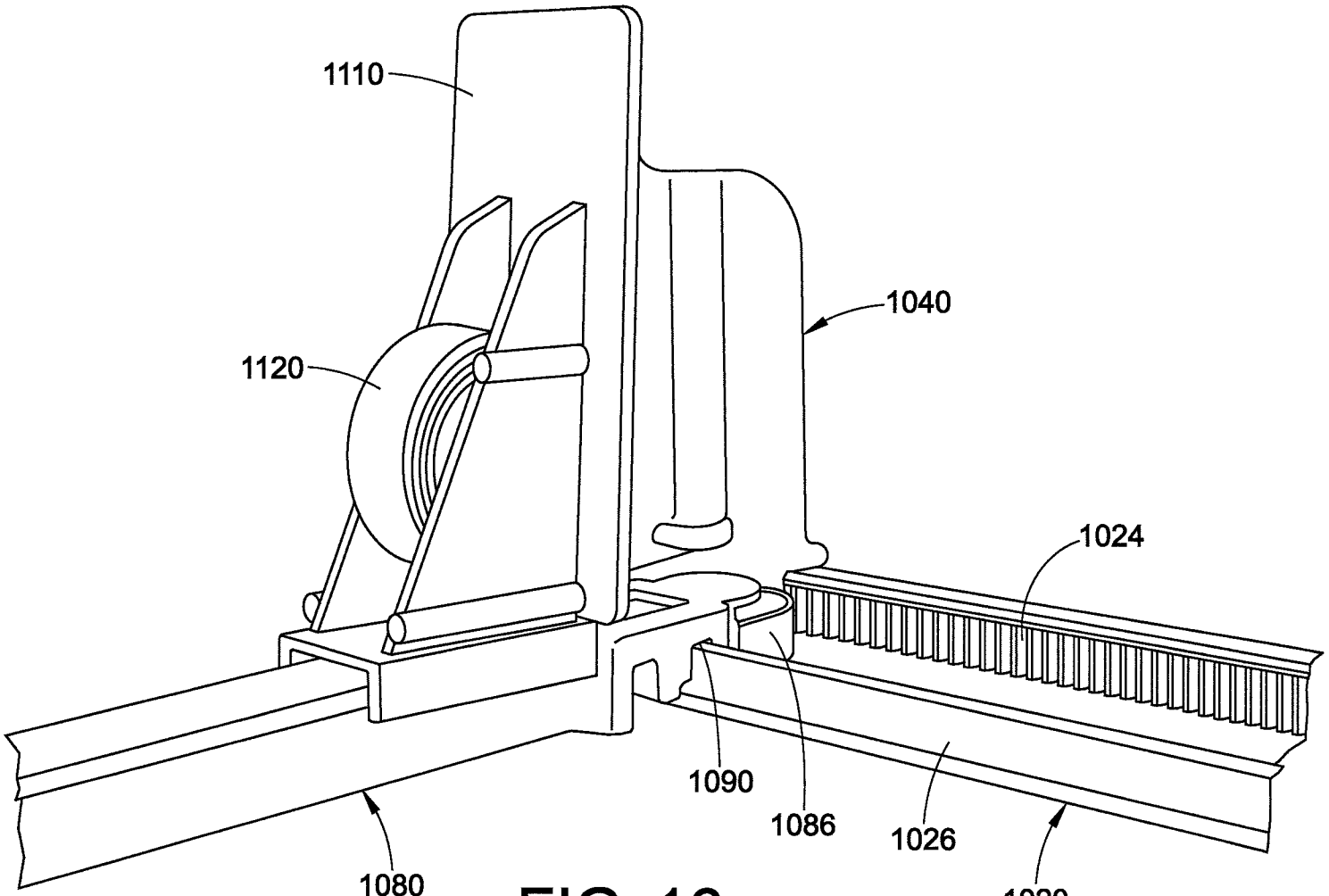
FIG. 16 is a perspective view taken from the left rear of the merchandising assembly of FIG. 10.

As mentioned, defined on a rear face of the mounting member front wall 1022 is at least one protrusion or tooth 1024. In one embodiment, a plurality of spaced teeth 1024 can be provided, separated by depressions or grooves 1032. The teeth can be aligned and extend the length of the mounting member 1020, as can be seen in FIG. 16.

Figure 13:
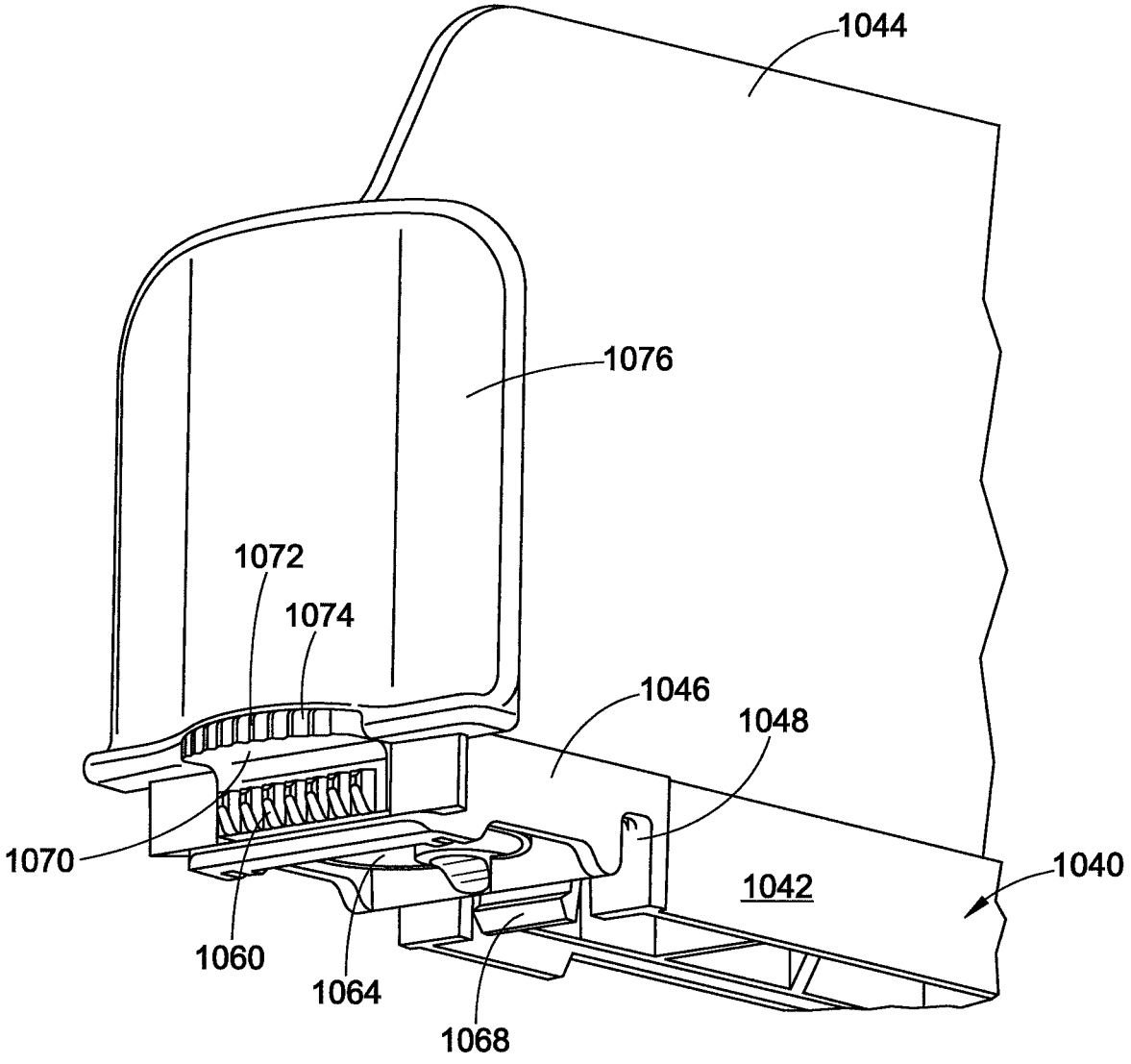
FIG. 13 is a perspective view oaf one of the cooperating members of FIG. 1, namely, a divider assembly, showing an elongated base on which is located a divider, a lock and a front wall.
Figure 20:
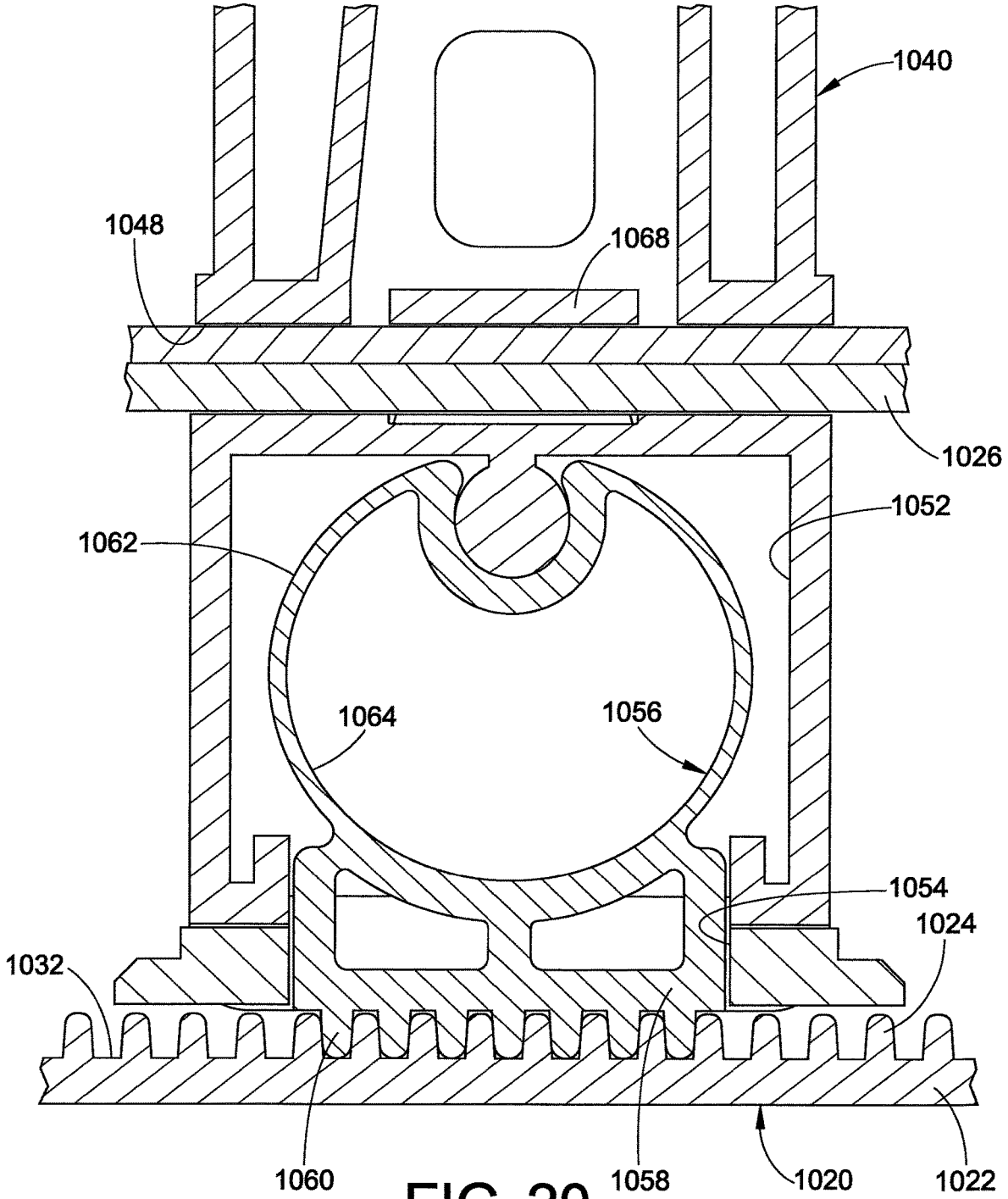
FIG. 20 is an enlarged cross sectional bottom view of the cooperating member and lock of FIG. 12A when the lock is in an engaged condition with the mounting member.
Figure 21:
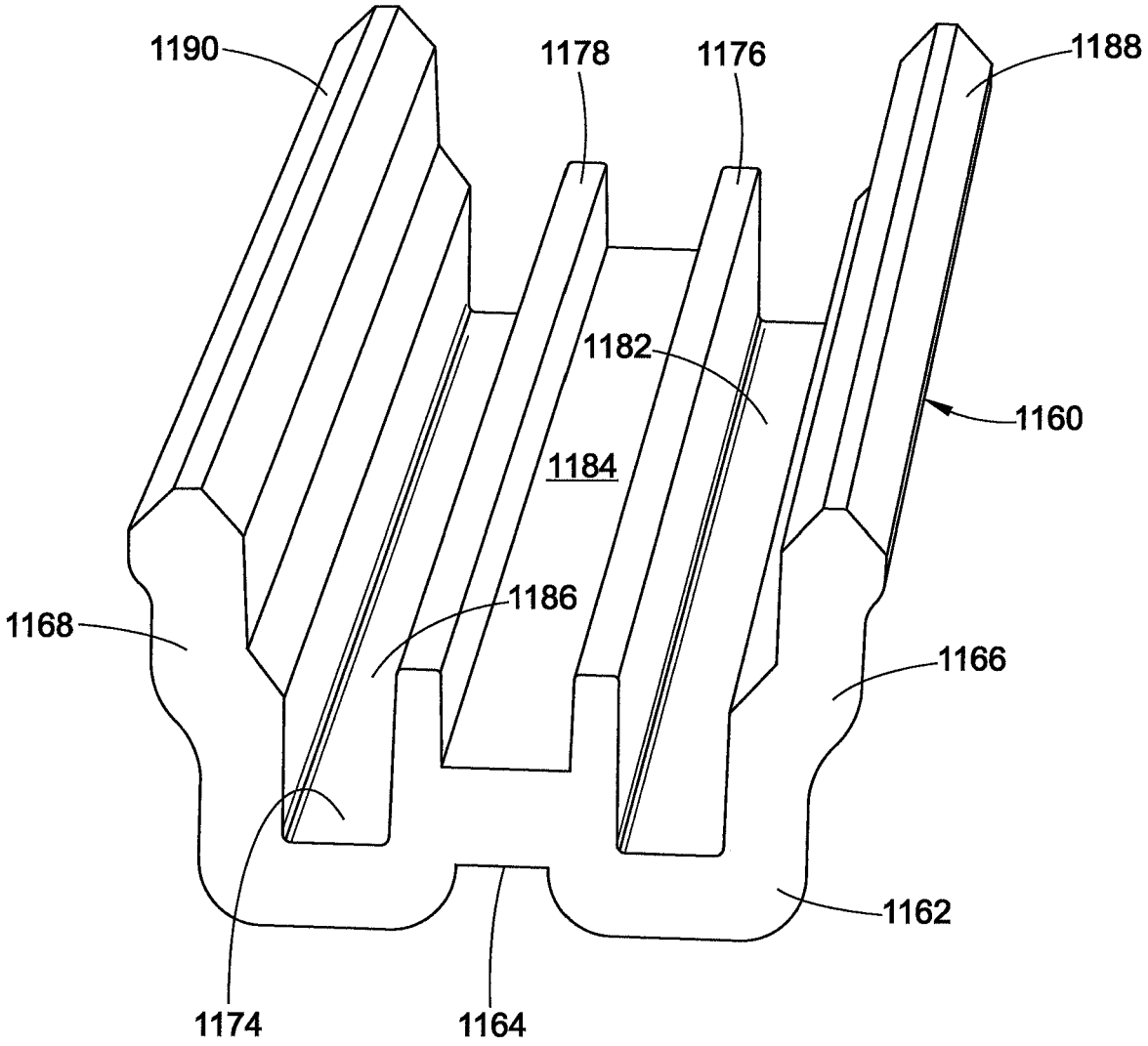
FIG. 21 is a perspective view of a clip employed to selectively connect a track assembly to a divider assembly of a merchandising system according to another embodiment of the present disclosure.

With reference now to FIG. 13, the divider assembly 1040 comprises a base 1042 extending upwardly away from which is a planar divider member 1044. The base includes a front end 1046 in which is defined a transverse groove 1048. Also defined in the front end 1046 is a chamber 1052 which communicates with a slot 1054. Mounted in the chamber is an engaging member 1056. With reference also to FIG. 20, the engaging member, which can also be termed a lock, includes a front end 1058, which can be planar, on which is provided at least one protrusion or tooth 1060 and a rear end 1062 which comprises a biasing member 1064. The front end 1046 of the base 1042 further comprises a tab 1068 which is located behind the groove 1048.

Figure 12B:
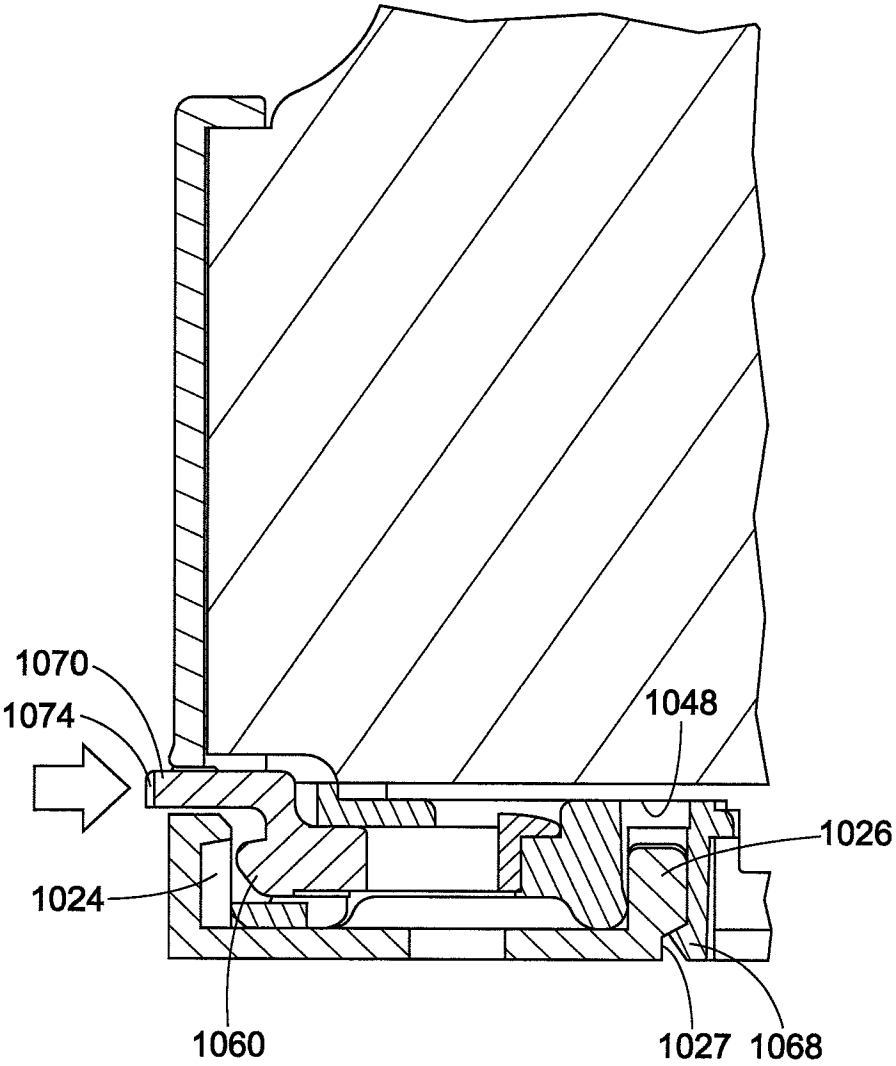
FIG. 12B illustrates the merchandising system of FIG. 12A with the lock shown in a disengaged condition.
Figure 12A:
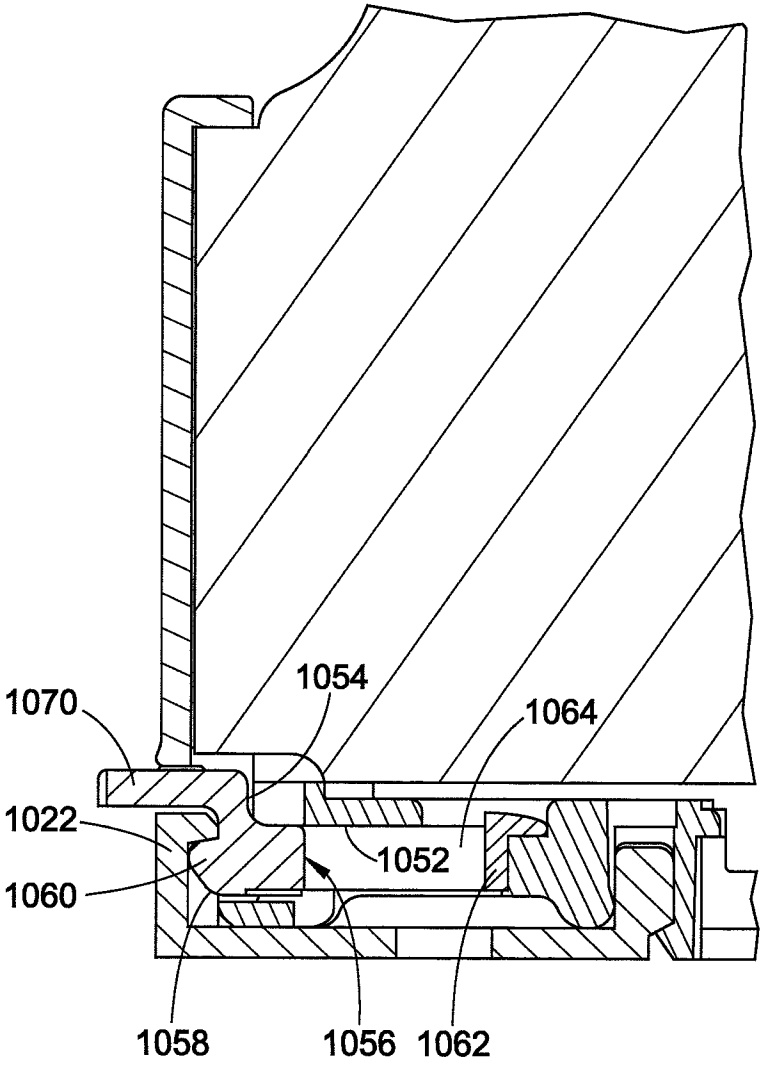
FIG. 12A is an enlarged side elevational view in cross section of the cooperating member of FIG. 10 mounted on the mounting member and illustrating an engaged condition of a lock of the cooperating member engaging the mounting member.

With reference again to FIG. 13 and to FIG. 12B, the lock 1056 further comprises a tab or contact element 1070 which includes a front face 1072 which can be ridged as at 1074 to make it adapted for manual contact. The tab 1070 is vertically spaced above the teeth 1060. Also, the tab 1070 protrudes forwardly from the remainder of the lock 1056, as can also be seen from FIG. 12A.

In one embodiment, the divider assembly 1040 further comprises a front wall 1076 which extends transversely to a longitudinal axis of the base 1042 of the divider member 1044. In one embodiment, the front wall 1076 can be secured or mounted to the divider member 1044. Of course, other embodiments are also contemplated. The purpose for the front wall 1076 is to retard a forward-most one of a column of products held on the merchandising assembly from falling off the shelf on which the merchandising assembly is mounted. One such construction is illustrated in FIG. 17.

Figure 14:
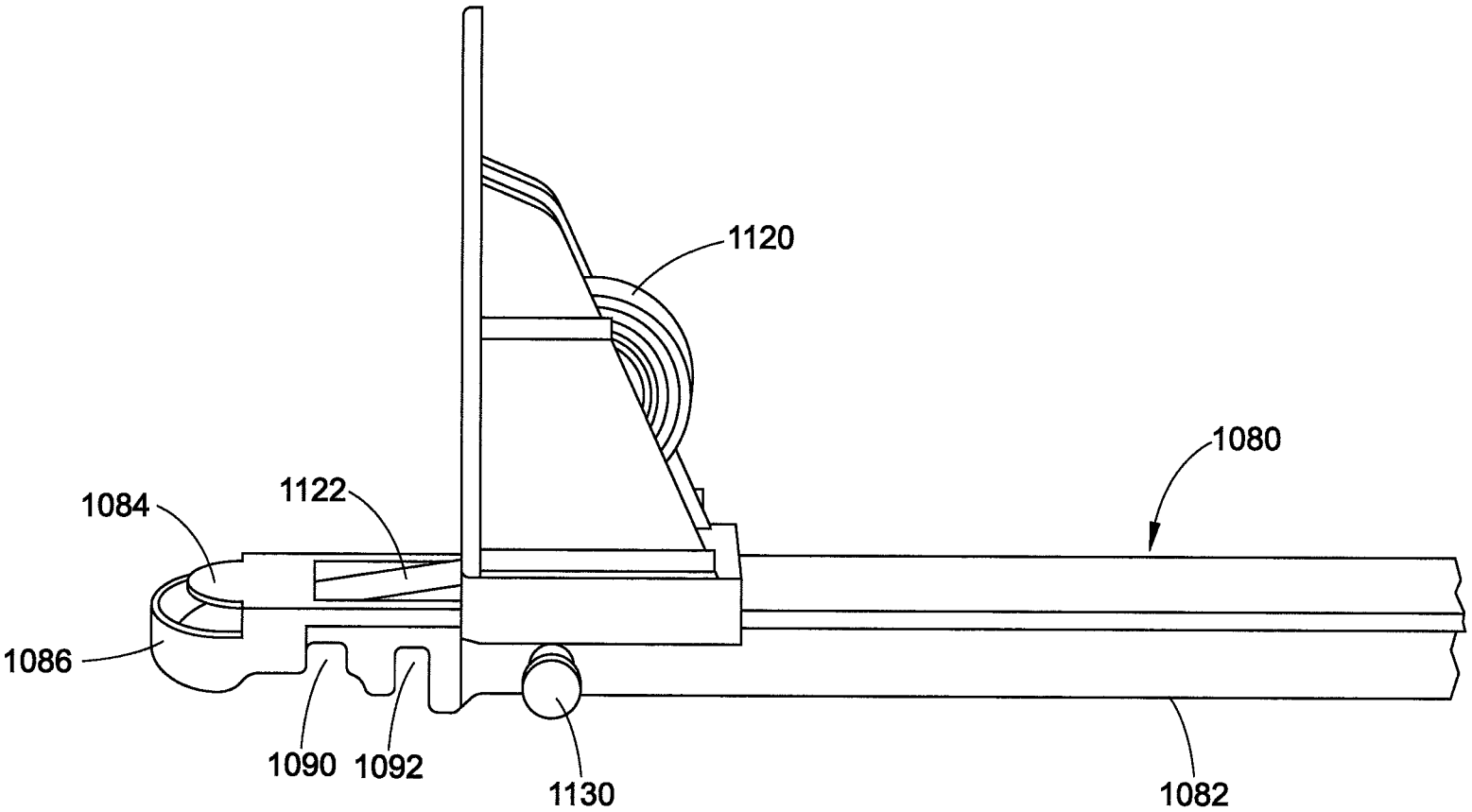
FIG. 14 is a side perspective view of another of the cooperating members of FIG. 10, in the form of a track assembly according to the present disclosure.
Figure 18:
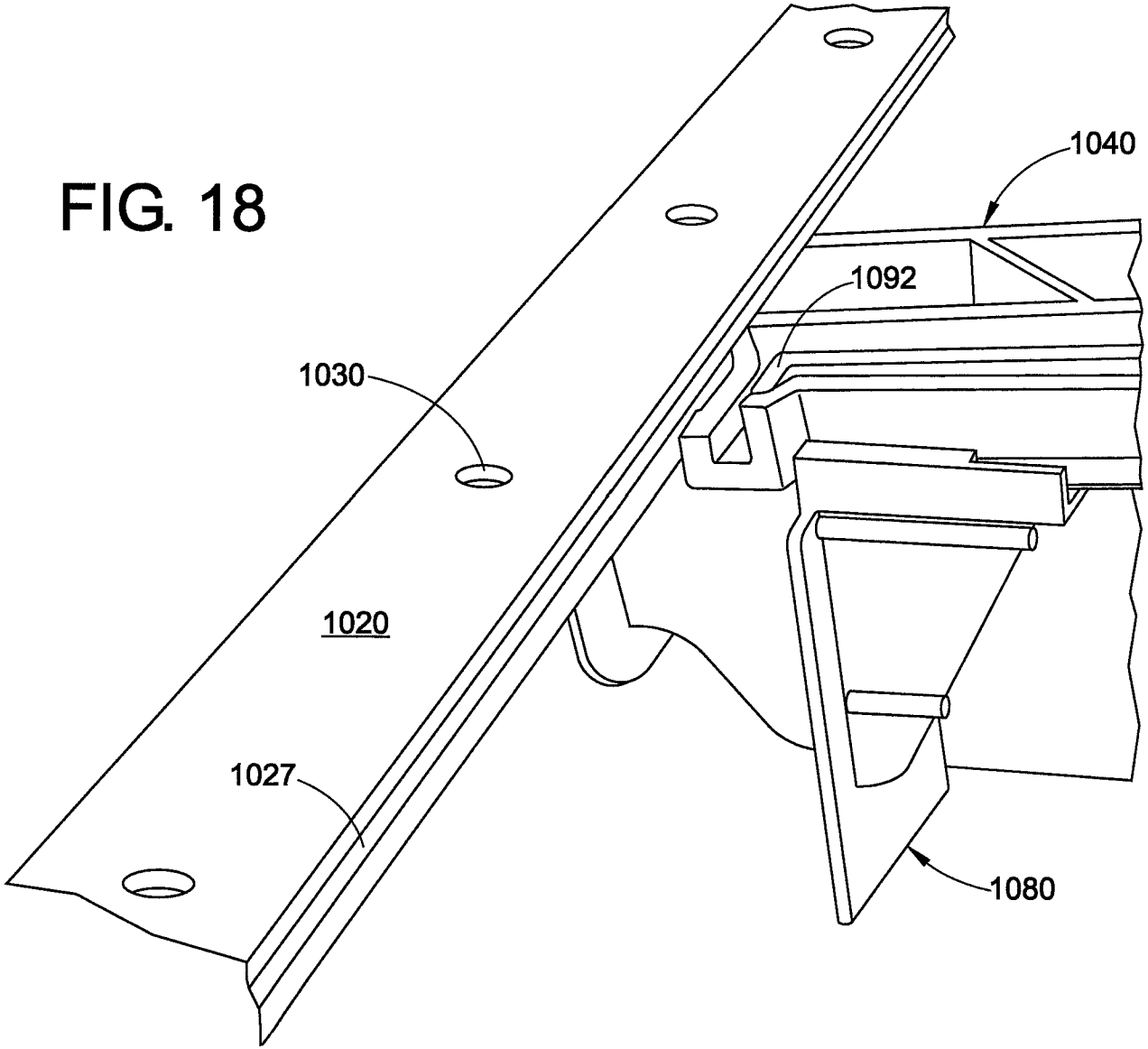
FIG. 18 is a bottom perspective view of the merchandising assembly of FIG. 10.
Figure 19:
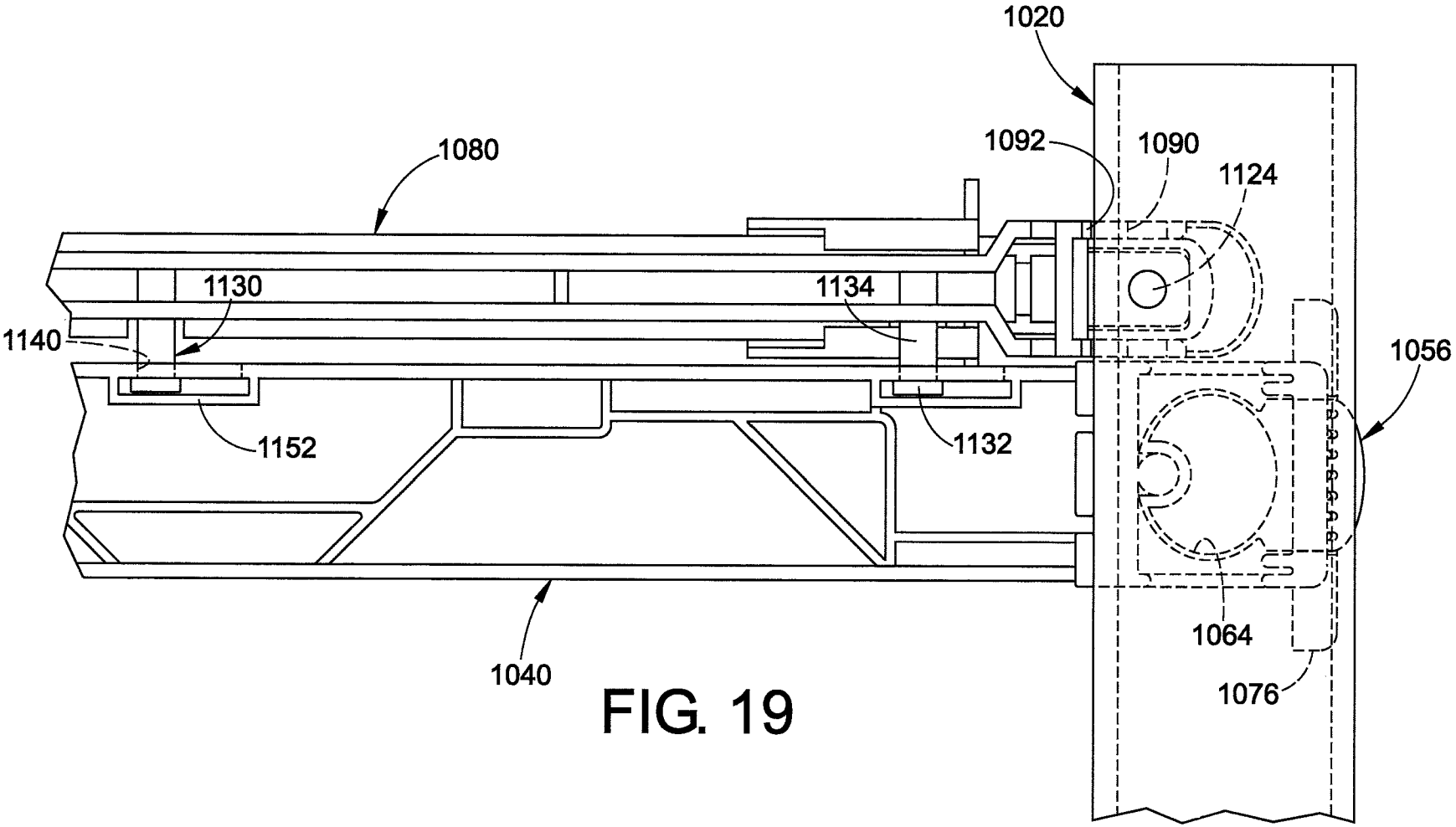
FIG. 19 is a bottom plan view of a portion of the track assembly connected to the divider assembly as in FIG. 18 and illustrating the mounting member in dashed outline.

As illustrated in FIG. 10, the merchandising system 1010 further comprises a second cooperating member in the form of the track assembly 1080. With reference now to FIG. 14, the track assembly 1080 comprise an elongated base 1082 including an enlarged front end 1084. The front end comprises at its proximal end a contact member 1086 which can be resilient. In one embodiment, the resilient contact member can be in the form of a ribbon-like convex contact surface which is spaced forwardly from the remainder of the front end such that the contact surface is allowed to flex when contacting the rear face of the front wall 1022 of the mounting member 1020. Such flexure would occur when the track assembly 1080 is mounted to the mounting member 1020 separately from the divider assembly 1040. Defined on the front end 1084 of the track assembly is a, first transverse groove 1090 and, spaced therefrom, a second transverse groove 1092. Each of these is adapted to accommodate the mounting member rear rail 1026. As best illustrated in FIG. 19, the front end also comprises a tab 1094 which is located behind the second groove 1092. As may be best seen in FIG. 18, the tab 1010 is capable of flexing as it is laterally separated from the walls of the front end.

Figure 17:
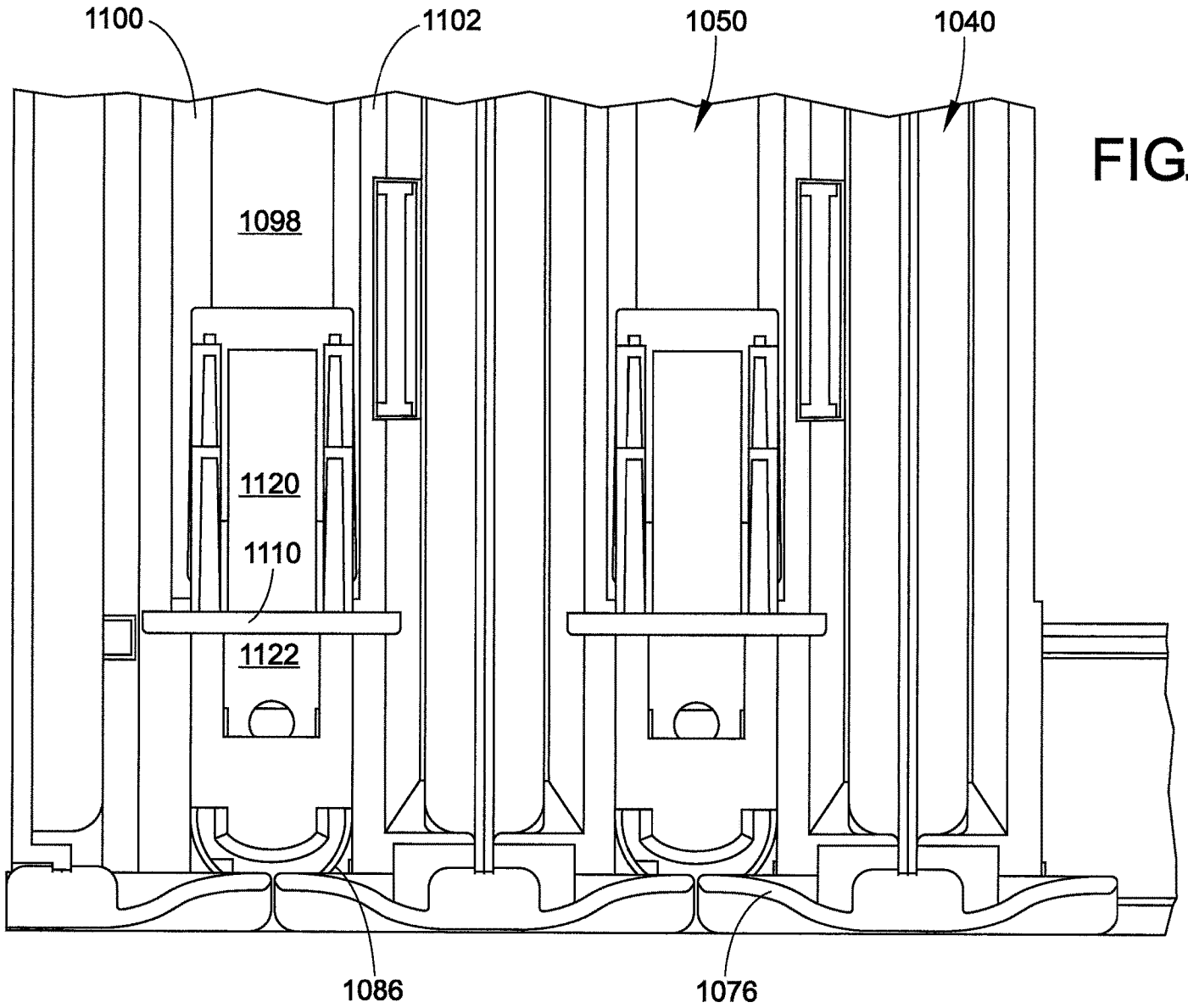
FIG. 17 is a top plan view of a merchandising assembly according to the present disclosure illustrating a plurality of divider assemblies and track assemblies mounted on a mounting member and located adjacent each other.

With reference now to FIG. 17, the track assembly 1080 further comprises a track 1098 on which are defined a first rail 1100 and a second rail 1102 spaced from the first rail. Mounted on the track is a pusher 1110. The pusher is resiliently biased forwardly via a biasing member 1120, such as a coil spring. A front end 1122 of the biasing member can be connected to the front end 1084 of the base 1082. For this purpose, a downwardly extending stem 1124 is provided on the front end 1084 of the track assembly 1080 as best seen in FIG. 19. An aperture located in the front end 1122 of the biasing member allows the front end to be mounted on the stem.

With reference now to FIGS. 14 and 19, protruding laterally from the base 1082 of the track assembly 1080 and located behind the front end 1084 is at least one pin 1130. The pin comprises an enlarged head 1132 located at the distal end of a stem 1134 that is connected to or of one piece with the base 1082. In one embodiment, the track assembly 1080, other than the pusher 1110 and the coil spring or biasing member 1120, is molded as a one-piece unitary member from a suitable thermoplastic material.

Figure 15:
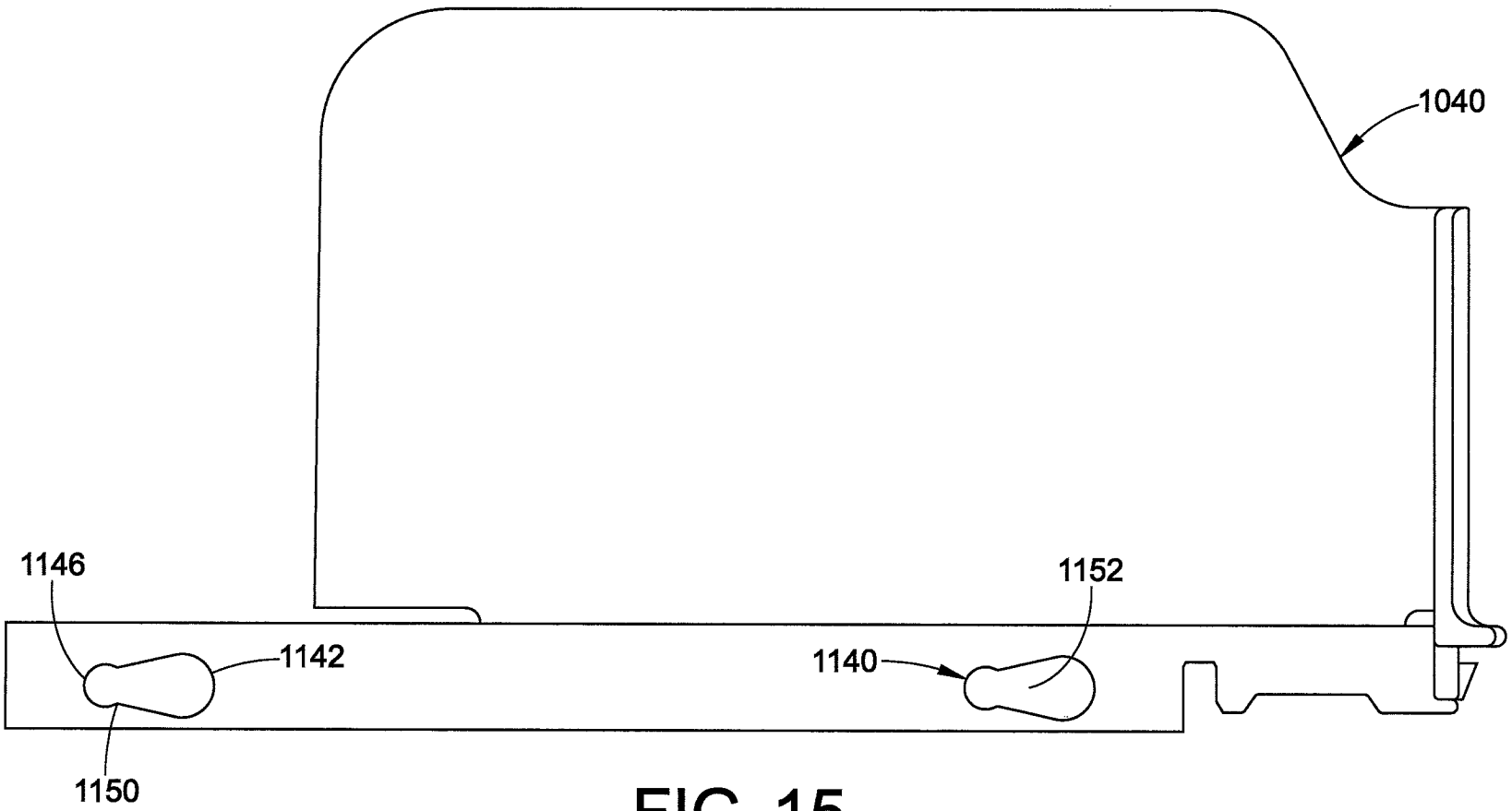
FIG. 15 is a side elevational view of a front end of the divider assembly of FIG. 13 according to one embodiment of the present disclosure.

As best illustrated in FIG. 15, a side wall 1138 of the base 1042 of the divider assembly 1040 comprises a slot 1140. The slot includes an enlarged diameter first end 1142 and a reduced diameter second end 1146. Also provided in the slot is a neck 1150 located between the first and second ends 1142 and 1146. To limit the extent to which the pin 1130 can protrude into the slot 1140, an end wall 1152 is defined in the base 1042 of the divider assembly 1040. When the head 1132 of the pin 1130 contacts the end wall 1152, further movement of the pin into the slot 1130 is blocked. It should be appreciated that a respective slot 1140 is provided in the side wall 1138 of the divider assembly 1040 for each pin 1130 provided on the side wall of the track assembly base 1082. In this way, the track assembly 1080 can be selectively connected to the divider assembly 1040 or disconnected therefrom. The neck 1150 in the slot 1140 serves as a snap-in lock (due to the resilience of the thermoplastic material from which the divider assembly 1040 can be made) to retard removal of the track assembly 1080 from its connection with the divider assembly 1040, unless that is desired.

To effect such removal, the combined track and divider assembly need to be distanced from the mounting member 1020. It should be appreciated from FIG. 16 that when the track assembly 1080 is connected to the divider assembly 1040 and the entire construction is mounted to the mounting member 1020, the first groove 1090 located on the front end 1084 of the base 1082 accommodates the rear wall 1026 of the mounting member 1020. At the same time, the groove 1048 in the divider assembly 1040 is employed to accommodate the rear wall 1026 of the mounting member 1020. At this time, the contact member 1086 of the track assembly 1080 is spaced away from the front wall 1022 of the mounting member 1020 as may be evident from FIG. 16.

However, when the track assembly 1080 is mounted on the mounting member 1020 separately from the divider assembly 1040, then the second groove 1092 of the front end 1084 of the base 1082 of the track assembly 1080 accommodates the rear wall 1026 of the mounting member 1020. Most of the track assembly front end 1084 is thus located in the channel 1028 of the mounting member 1020. At this time, the contact member 1086 is in contact with the rear face of the front wall 1022 of the mounting member 1020. In one embodiment, such contact can be with the plurality of spaced teeth 1024 thereof. In this arrangement, the contact member 1086 provides some frictional contact between the track assembly 1080 and the mounting member 1020 retarding a sideward sliding motion of the track assembly on the mounting member. However, once such frictional engagement is overcome, then such sideward sliding motion of the track assembly on the mounting member is allowed. But, a movement longitudinally of the track assembly in relation to the mounting member is not permitted due to the engagement of the rear wall 1026 of the mounting member in the second groove 1092 of the track assembly front end 1084. In order to permit such movement, the track assembly 1080 needs to be lifted away from the mounting member 1020.

With reference now to FIG. 20, the biasing member 1064 of the lock 1056 is adapted to normally bias the lock forwardly in chamber 1052. Such bias causes the at least one tooth 1060 of the lock 1056 to enter at least one of the grooves 1032 defined between the spaced teeth 1024 of the mounting member or front rail 1020 and come into engagement with a side wall of the at least one tooth 1024 of the mounting member. In the embodiment shown, this bias causes a plurality of spaced teeth 1060 of the lock 1056 to come into engagement with the plurality of spaced teeth 1024 of the mounting member 1020.

In accordance with another embodiment of the present disclosure, a clip 1160 is provided for selectively securing a suitably configured track to a suitably configured divider. In this embodiment, the clip 1160 comprises a base wall 1162 in which there is defined a longitudinally extending groove 1164. The clip also comprises a first side wall 1166 and, spaced therefrom, a second side wall 1168. Thus, the clip comprises a somewhat U-shaped body in cross section. Protruding from an inner face 1174 of the base wall 1162 are spaced first and second ribs 1176 and 1178. The ribs can be aligned with each other and with the pair of side walls 1166 and 1168. In one embodiment, the ribs extend from a front end of the clip to a rear end thereof. Thus, they are aligned with and extend the same distance as the side walls 1166 and 1168. It should be appreciated that the side walls 1166 and 1168 in this embodiment taper outwardly such that the side walls are further apart from each other at their apex then they are at their root. It should also be appreciated that the ribs 1176, 1178 and side walls 1166, 1168 define a set of longitudinally extending channels on the inner face of the base wall. More particularly, defined between the first rib 1176 and the first side wall 1166 is a first channel 1182. Defined between the pair of ribs 1176 and 1178 is a second channel 1184. Finally, defined between the second rib 1178 and the second side wall 1168 is a third channel 1186. Located at the distal ends of the two side walls 1166 and 1168 are respective thickened or protruding sections or portions 1192 and 1194.

Figure 22:
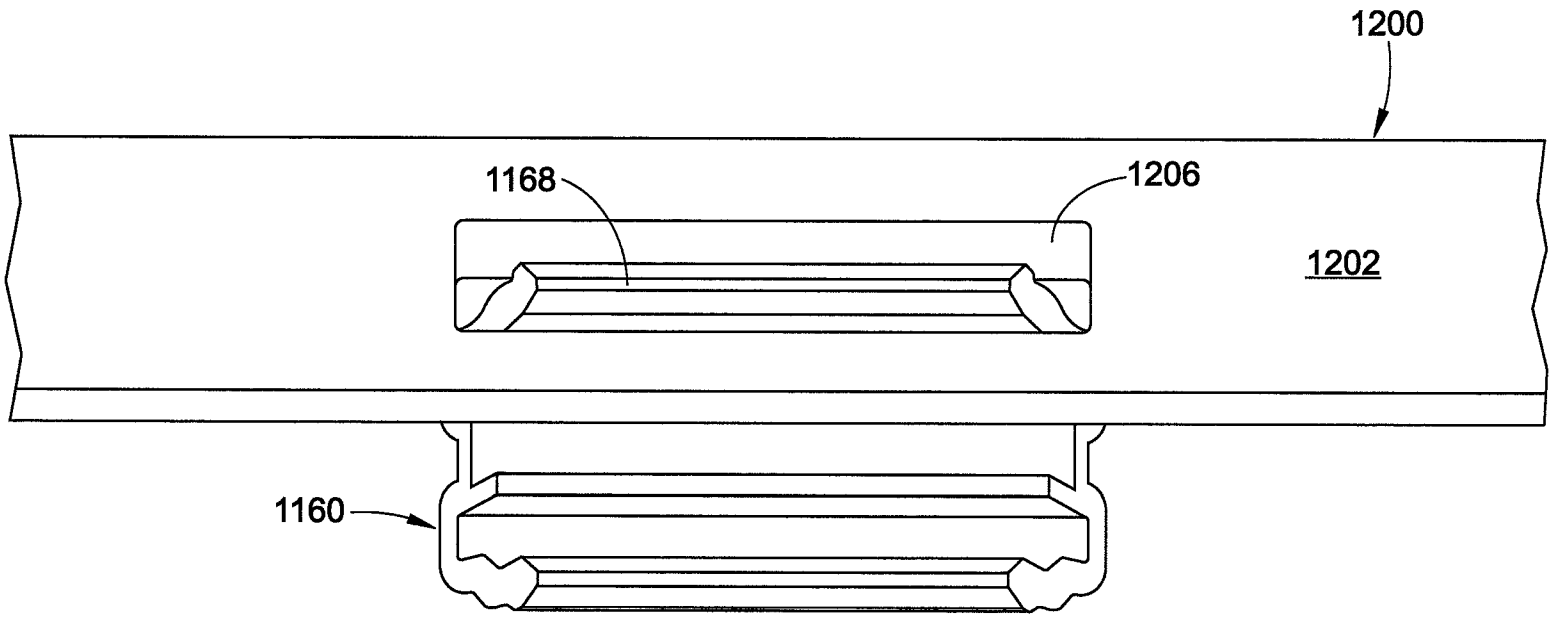
FIG. 22 is a top plan view of the clip as mounted to a track assembly.
Figure 23:
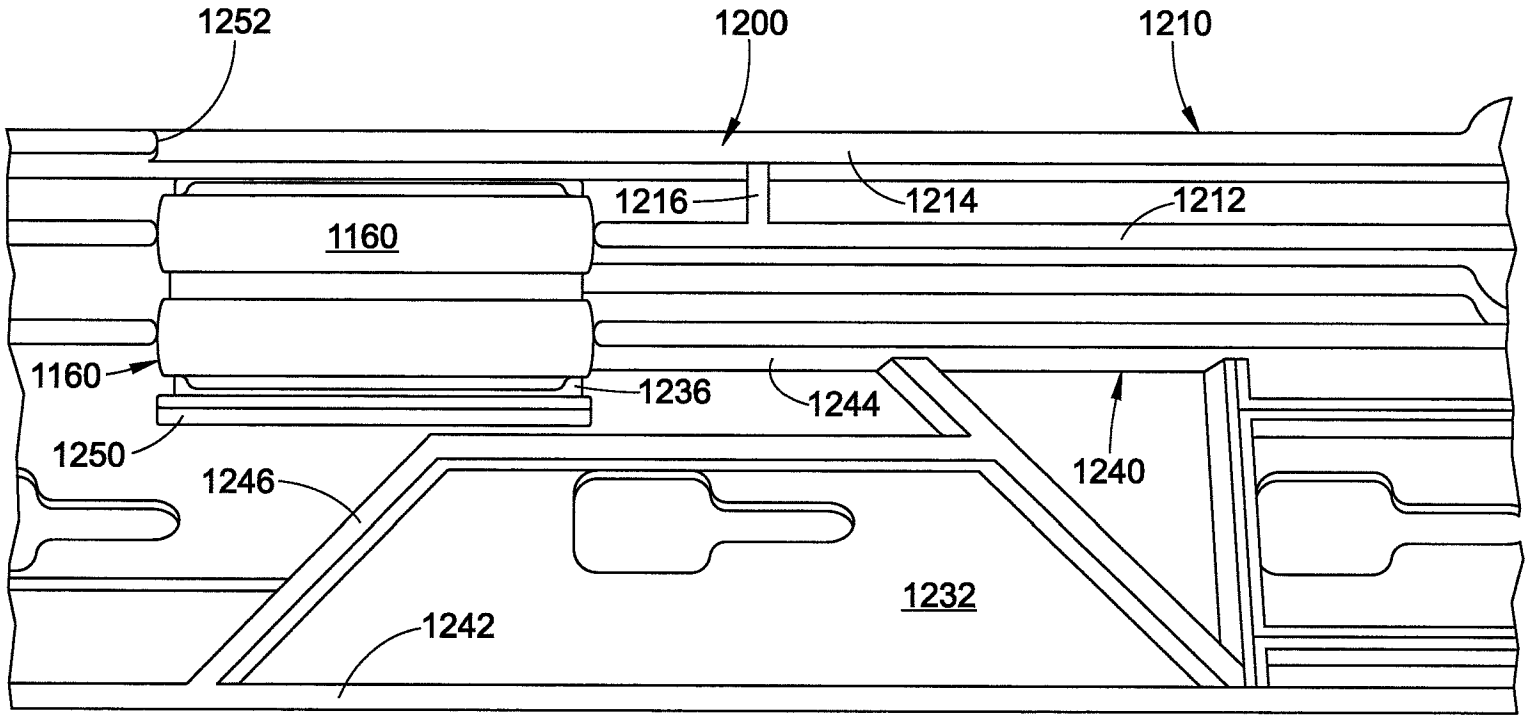
FIG. 23 is a bottom plan view illustrating the clip as connecting a track assembly to a divider assembly.

With reference now also to FIG. 22, there, the clip 1160 is shown as being mounted to a track assembly 1200. In this embodiment, the track assembly comprises a top wall 1202 in which is defined a slot 1206. The track assembly also comprises a base 1210 as best seen in FIG. 23. The base 1210 comprises a first leg 1212 and spaced therefrom a second leg 1214. The legs 1212 and 1214 can extend along a longitudinal axis of the track. If desired, a cross brace 1216 can be employed at one or more locations between the first and second legs 1212 and 1214 to stiffen the base while reducing the amount of material employed for the base.

With further reference to FIG. 23, the clip 1160 is meant to selectively connect the track assembly 1200 to a divider assembly 1230. The divider assembly comprises a top wall 1232, in which is defined a slot 1236, and a base 1240. The base 1240 can comprise first and second legs 1242 and 1244, which are spaced from each other, and one or more bracing members 1246 which are positioned between the pair of spaced legs 1242 and 1244 and serve to reinforce the base. Also provided in this embodiment is a back wall or rib 1250, which is located along one longitudinal edge of the slot 1236 in a manner spaced from the leg 1244. As illustrated in FIG. 23, the clip 1160 selectively connects the track assembly 1200 to the divider assembly 1230. For this purpose, extending into the first channel 1182 is the second leg 1244 of the divider assembly 1230. In addition, extending into the third channel 1186 is the first leg 1212 of the track assembly base 1210. In this way, the clip can hold the track assembly 1200 and divider assembly 1230 in a generally stable relationship with each other. The clip 1160 is desirably long enough so as to provide a stable connection between the track assembly 1200 and the divider assembly 1230. In the embodiment disclosed, only a single such clip is provided. However, it should be appreciated that multiple clips could be provided depending on the length of the track assembly and the divider assembly in question. It should also be appreciated that due to the construction of the clip assembly, it maintains a desired spacing between the track assembly and the divider assembly when they are connected to each other. The size of that spacing is controlled by the width between the first and second ribs 1176 and 1178. In other words, the spacing is controlled by the width of the second channel 1184.

It should be appreciated that suitable cutouts (not visible in FIG. 23) can be provided in the track assembly first leg 1212 and, similarly, in the divider assembly second leg 1244. One such cutout 1252 is visible in the track assembly second leg 1214. The purpose for the cutout is to accommodate the thickness of the base wall 1162 of the clip 1160 so that the combined track assembly and divider assembly 1200, 1230 can sit stably on a subjacent surface, such as a shelf. In order to retard removal of the clip 1160 from the respective slots 1206 and 1236 in the track assembly top wall 1202 and the divider assembly top wall 1232, the thickened sections 1192 and 1194 of the clip side walls 1166 and 1168 can frictionally engage wall surfaces of the track assembly and divider assembly. In one embodiment, all of the clip 1160, the track assembly 1200 and the divider assembly 1230 are made of a suitable, somewhat flexible material, such as a known thermoplastic. However, it should be appreciated that any of the clip, the track assembly or the divider assembly could be made from any other known type of material, such as a metal or a fiber reinforced resin or the like.

Figure 24:
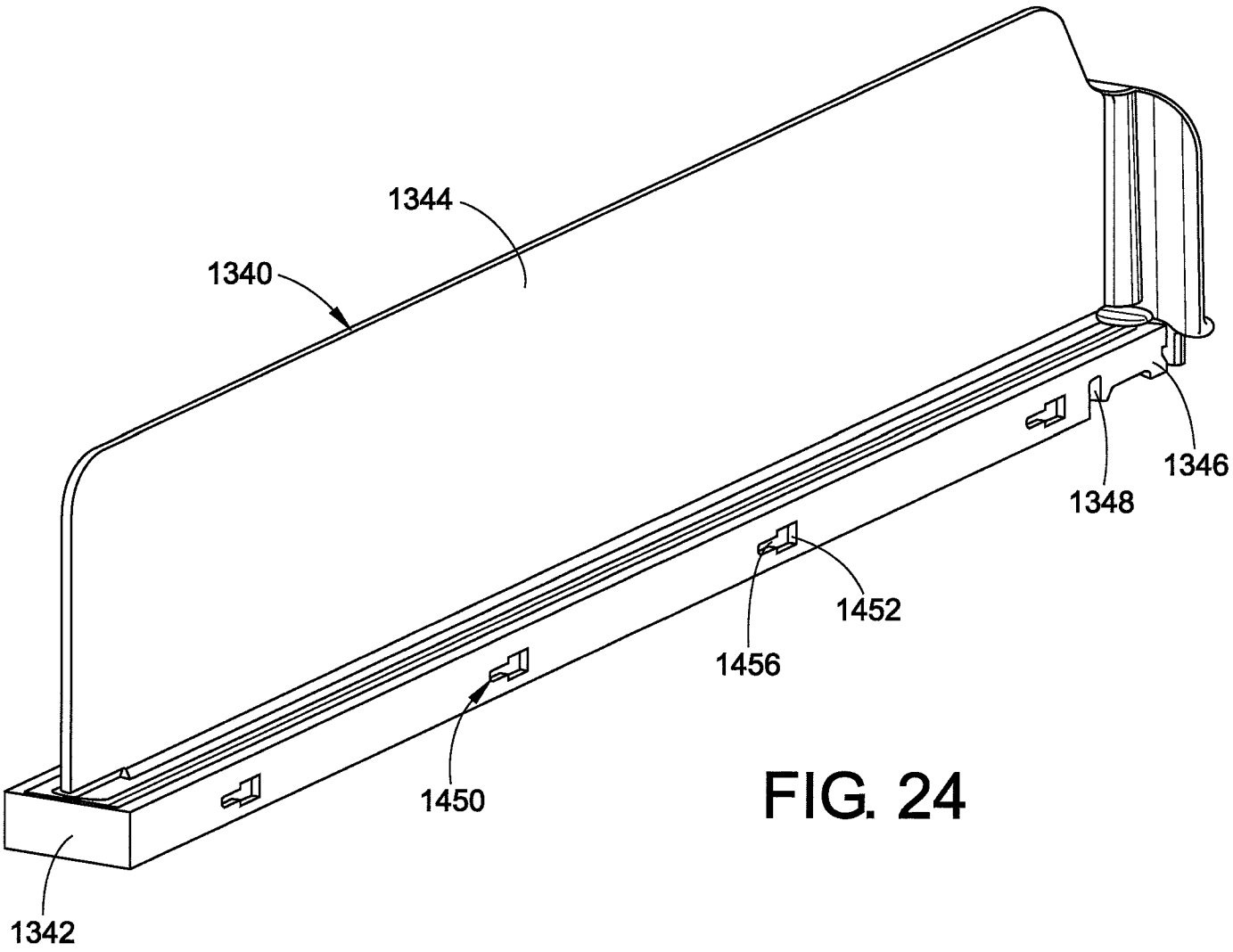
FIG. 24 is a rear perspective view of a divider assembly which can be connected to a track assembly according to yet another embodiment of a merchandising system according to the present disclosure.
Figure 28:
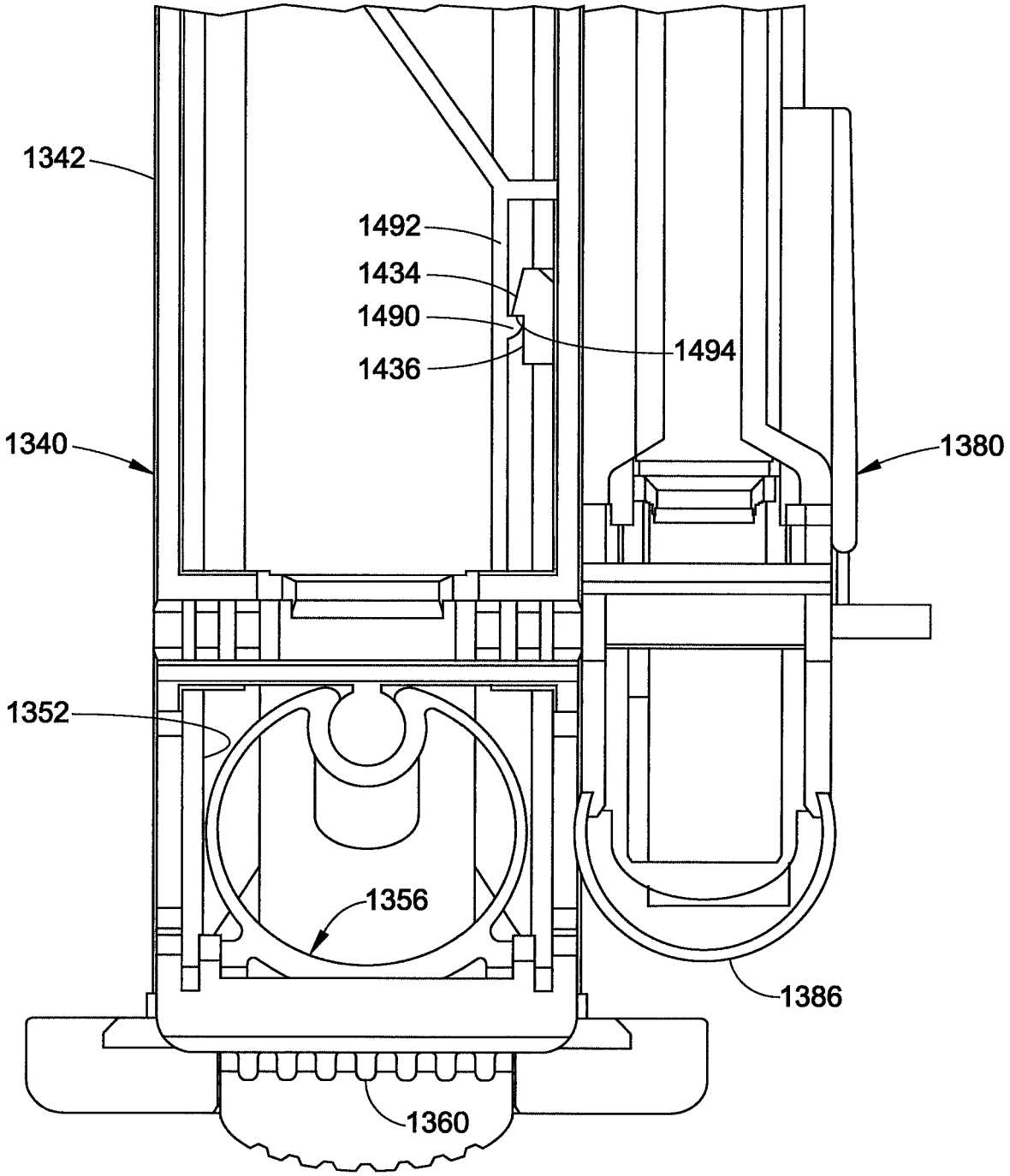
FIG. 28 is a bottom plan view of the track assembly of FIG. 25 as connected to the divider assembly of FIG. 24; and, FIG. 29 is a rear elevational view of the track assembly of FIG. 25.

With reference now to FIG. 24, yet a further embodiment of the present disclosure pertains to a merchandising system including a first cooperating member in the form of a divider assembly 1340 which comprises a base 1342. Extending upwardly away therefrom is a divider member 1344. The base includes a front end 1346 in which is defined a transverse groove or slot 1348. With reference now also to FIG. 28, defined in the front end 1346 of the base is a chamber 1352. Mounted in the chamber is an engaging member or lock 1356. As in the previous embodiments, the lock 1356 is biased to an end position. But the lock can be manually moved away from the end position so as to retract the one or more teeth 1360.

The merchandising system further comprises a second cooperating member in the form of a track assembly 1380. With reference now also to FIG. 25, the track assembly comprises an elongated base 1382 including a front end 1384. The front end comprises at its proximal end a contact member 1386 which can be resilient. Defined in the front end 1384 of the track assembly 1380 is a first transverse groove 1390 and, spaced therefrom, a second transverse groove 1392. As in the previous embodiments, each of these is adapted to accommodate a mounting member rear rail. The track assembly further comprises a track section 1398 on which can move a pusher 1410. Protruding from a side wall 1418 of the track assembly base 1382 are one or more pins 1420. With reference now to FIG. 26, in this embodiment, each pin can comprise an enlarged head 1422 and a stem 1424. The head includes a flat back face 1430, a flat forward face 1432, and a contact face having a tapered section 1434 and a recessed section 1436. The head 1422 can also include a flat rear face 1438. The several faces can also have different shapes if so desired.

The pin 1420 is adapted to selectively engage in a slot 1450 defined in the base 1342 of the divider assembly 1340, as shown in FIG. 24. The slot 1450 can include an enlarged width section 1452 and a reduced width section 1456. One could consider the slot 1450 to be somewhat T-shaped.

Figure 27:
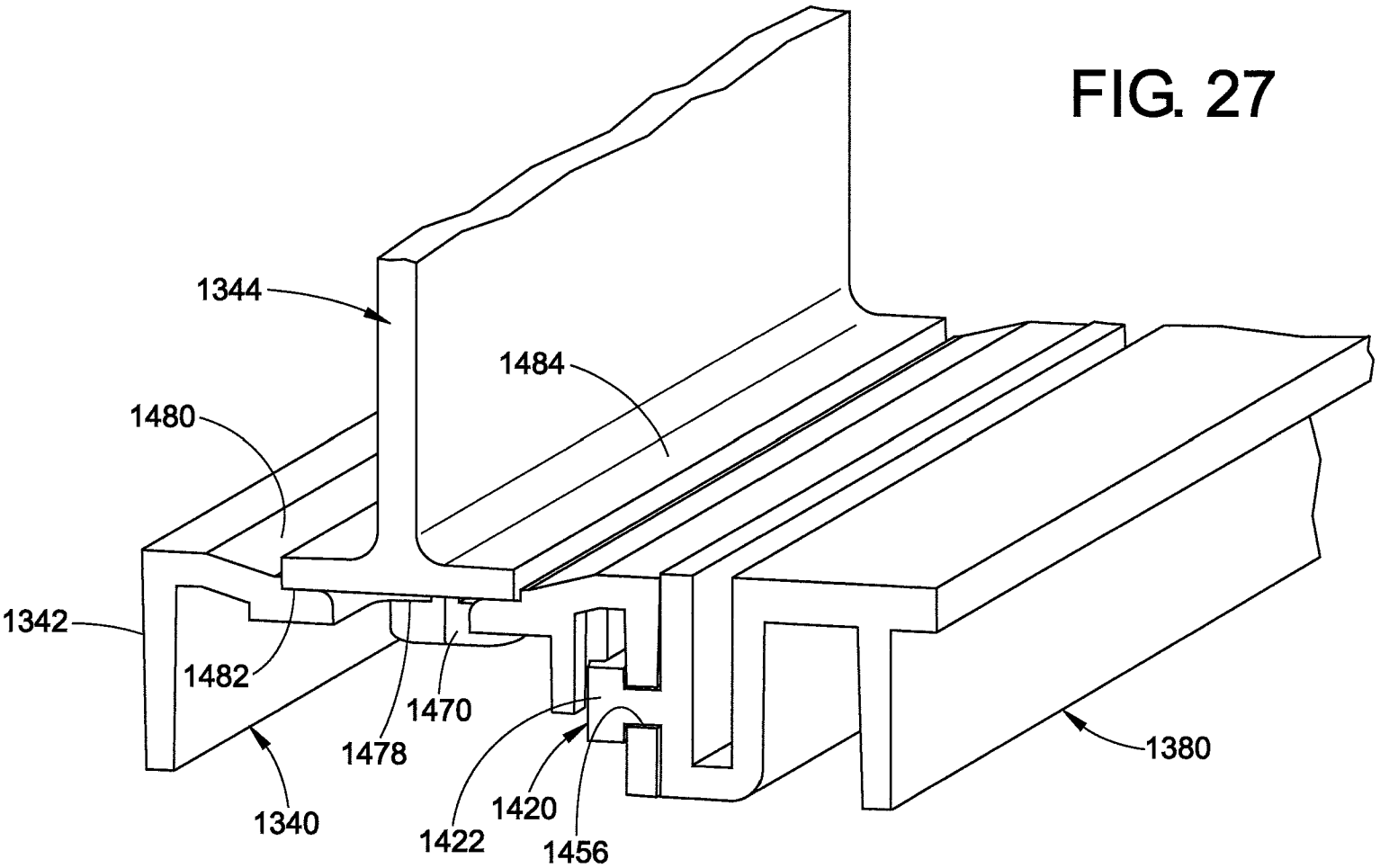
FIG. 27 is a broken away perspective view in cross section of the track assembly of FIG. 25 as connected to the divider assembly of FIG. 24.

With reference now to FIGS. 27 and 28, the head 1422 of the pin 1420 is adapted to enter the enlarged width section 1452 of the slot 1450 and be slid towards the reduced width section 1456 thereof. This is shown in FIG. 27. Also illustrated in FIG. 27 is that in this embodiment, the divider 1344 can be of the type which is selectively mounted to and disengaged from the base 1342 of the divider assembly 1340. To this end, one or more connector pins 1470 can protrude from a base of the divider 1344 and engage in one or more respective apertures 1478 defined in a top wall 1480 of the divider base 1342. The top wall 1480 also includes a recessed section 1482 in which the apertures 1473 are defined in order to accommodate a base portion 1484 of the divider 1344. In this way, the selectively disengageable divider 1344 does not protrude away from a top surface of the base 1342 despite the provision of the base portion 1484 on the divider 1344.

Illustrated in FIG. 27 is the pin 1420 as its head 1422 is seated in the reduced width section 1456 of the slot 1450. FIG. 28 illustrates that during the process of connecting the track assembly 1380 to the divider assembly 1340, the one or more pins 1420 slide along the slot 1450 such that the tapered contact surface 1434 of the pin enlarged head engages a tab, knob, or bump 1490 positioned on a vertically oriented wall 1492 defined on the divider base 1342. Once the pin 1420 is moved into the reduced width section 1456 of the slot 1450, the tab 1498 will engage the recessed section 1436 behind the tapered section 1434 in order to lock the pin 1420 in place thereby securing the track assembly 1380 in place on the divider assembly 1340. The tab 1490 will abut a shoulder 1494 of the contact face on the pin 1420. In order to disengage these two components, the track assembly 1380 is slid in the opposite direction. The resistance of the shoulder 1494 against the tab 1490 is overcome due to the inherently resilient nature of the thermoplastic material from which one or both of the track assembly 1380 and the divider assembly 1340 can be made.

Figure 29:
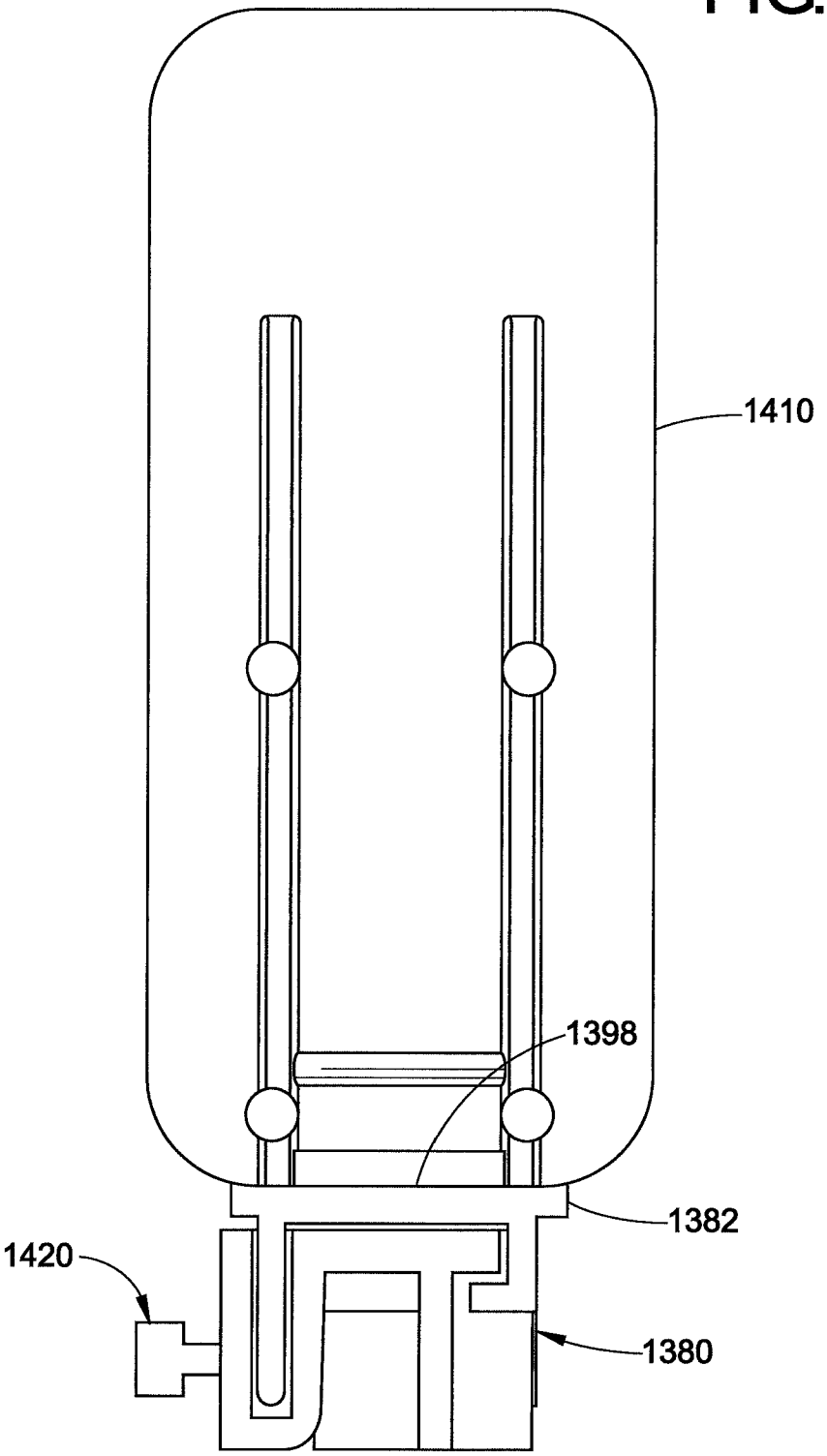

FIG. 29 illustrates a rear view of the track assembly 1380 showing a different version of a track 1398 according to this embodiment of the instant disclosure, which is different from the track illustrated in FIG. 10, or example.

Disclosed has been a merchandising system comprising a first cooperating member and a second cooperating member which are adapted to be selectively connected together so as to enable the corrected structure to be selectively mounted to a mounting member. At the same time, each of the cooperating members can be separately mounted to the mounting member. In one embodiment, the first cooperating member and second cooperating member are connected together by connecting structures or elements which are integral with, or of one piece with, the respective cooperating members. In another embodiment, a separate connecting member, such as a clip, is employed to connect suitably configured cooperating members to each other.

Disclosed has been a merchandising system which comprises an elongated mounting member selectively securable to an associated shelf and a cooperating member received on the mounting member, wherein the cooperating member extends rearwardly over the associated shelf. The mounting member comprises a wall. The cooperating member in one embodiment comprises an elongated body including at least one tooth. The at least one tooth is movably mounted to the cooperating member and selectively engages the wall of the elongated mounting member.

In one embodiment, an elongated mounting member wall comprises at least one tooth which selectively engages the at least one tooth of the cooperating member. The at least one tooth is located on a front end of the cooperating member and is adapted to engage the wall of the mounting member. The cooperating member can include a chamber accessible through a slot defined in the front end.

In one embodiment, a lock is mounted to the cooperating member. The lock includes at least one tooth located at a first end of a lock body and a resilient member located at a second end thereof. The resilient member is adapted to bias the at least one tooth of the lock into engagement with at least one tooth of the mounting member.

If desired, a protrusion can be mounted on the lock which protrusion is accessible from a portion of the cooperating member.

In one embodiment, the mounting member and the lock include a plurality of spaced teeth which are each adapted to selectively engage each other.

A connection system can connect the lock to the cooperating member. In one embodiment, the connection system includes a protrusion located in the slot of the cooperating member and a clip defined on the lock. The clip selectively mounts to the protrusion in order to hold the lock in the slot.

In one embodiment, a front wall is slidably mounted to a divider portion which protrudes from the base portion. If desired, the front wall can be made of a transparent material.

The disclosure has been described with reference to several embodiments. Obviously, modifications and alterations will occur to others upon a reading and understanding of the preceding detailed description. It is intended that the instant disclosure be construed as including all such modifications and alterations insofar as they come within the scope of the appended claims or the equivalents thereof.

The invention claimed is:

1. A merchandising system comprising:

a rail including a bottom wall, a first wall extending from the bottom wall and having a first engagement surface, and a second wall extending from the bottom wall and including a second engagement surface facing the first engagement surface and spaced apart from the first engagement surface by a channel; and a cooperating member including a base extending from a first end to a second end and defining an upper surface, the base including (i) a first portion defining a chamber below the upper surface adjacent to the first end, the chamber receiving a resilient member configured to be selectively disposed within the channel between the first engagement surface and the second engagement surface and (ii) a second portion including the upper surface and extending an opposite direction than the first portion from the second wall of the rail, the resilient member operable to continuously bias the first portion to engage each of the first engagement surface and the second engagement surface.

2. The merchandising system of claim 1, wherein the resilient member is operable to bias the first portion into engagement with the first engagement surface and the second engagement surface.

3. The merchandising system of claim 1, wherein the first wall includes a flange spaced apart from the bottom wall and extending towards the second wall.

4. The merchandising system of claim 3, wherein the first portion is received between the flange and the bottom wall.

5. The merchandising system of claim 3, wherein the first engagement surface includes a plurality of first teeth disposed between the bottom wall and the flange.

6. The merchandising system of claim 5, wherein the first portion includes an engagement mechanism including a plurality of second teeth resiliently engaged with the plurality of the first teeth.

7. The merchandising system of claim 6, wherein the second teeth are received between the flange and the bottom wall.

8. The merchandising system of claim 6, wherein the plurality of second teeth are biased into engagement with the plurality of the first teeth by the resilient member.

9. The merchandising system of claim 1, wherein the cooperating member includes a groove configured to receive the second wall of the rail.

10. A merchandising system comprising:

a rail including a bottom wall, a first wall extending from the bottom wall and having a first engagement surface, and a second wall extending from the bottom wall and including a second engagement surface facing the first engagement surface and spaced apart from the first engagement surface by a channel; and a cooperating member including a base extending from a first end to a second end and defining an upper surface, the base including (i) a first portion defining a chamber below the upper surface adjacent to the first end, the chamber receiving an engagement mechanism having a resilient member configured to be selectively disposed within the channel and configured to apply a first biasing force to the first engagement surface in a first direction and a counter biasing force to the second engagement surface in a second direction facing away from the first direction and (ii) a second portion extending from the second wall of the rail, the first portion including the resilient member being operable between a first configuration to restrict movement of the cooperating member along the rail and a second configuration to permit movement of the cooperating member along the rail.

11. The merchandising system of claim 10, wherein the first wall includes a flange spaced apart from the bottom wall and extending towards the second wall.

12. The merchandising system of claim 11, wherein the first portion is received between the flange and the bottom wall.

13. The merchandising system of claim 11, wherein the first engagement surface includes a plurality of first teeth disposed between the bottom wall and the flange.

14. The merchandising system of claim 13, the engagement mechanism includes a plurality of second teeth resiliently engaged with the plurality of the first teeth.

15. The merchandising system of claim 14, wherein the second teeth are received between the flange and the bottom wall.

16. The merchandising system of claim 14, wherein the plurality of second teeth are biased into engagement with the plurality of the first teeth by the resilient member.

17. The merchandising system of claim 10, wherein the cooperating member includes a groove configured to receive the second wall of the rail.

* * * * *